US007422313B2

(12) United States Patent
Umeda et al.

(10) Patent No.: US 7,422,313 B2
(45) Date of Patent: Sep. 9, 2008

(54) LIQUID DROPLET EJECTING APPARATUS

(75) Inventors: Takaichiro Umeda, Nagoya (JP); Yuji Koga, Nagoya (JP); Takatoshi Takemoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 338 days.

(21) Appl. No.: 11/275,716

(22) Filed: Jan. 25, 2006

(65) Prior Publication Data

US 2006/0164475 A1 Jul. 27, 2006

(30) Foreign Application Priority Data

| | | |
|---|---|---|
| Jan. 26, 2005 | (JP) | 2005-017711 |
| Jan. 31, 2005 | (JP) | 2005-024426 |
| Feb. 28, 2005 | (JP) | 2005-053067 |
| Mar. 7, 2005 | (JP) | 2005-062240 |

(51) Int. Cl.
*B41J 2/04* (2006.01)
*B41J 2/045* (2006.01)

(52) U.S. Cl. ..... 347/57; 347/68

(58) Field of Classification Search ..... 347/20, 347/44, 54, 65, 66, 67, 68, 70–72
See application file for complete search history.

(56) References Cited

U.S. PATENT DOCUMENTS

| | | | | |
|---|---|---|---|---|
| 4,514,742 A | * | 4/1985 | Suga et al. | 347/85 |
| 4,887,093 A | | 12/1989 | Derks | |
| 5,409,138 A | | 4/1995 | Nakano | |
| 5,485,187 A | | 1/1996 | Okamura et al. | |

(Continued)

FOREIGN PATENT DOCUMENTS

JP 63-41148 A 2/1988

(Continued)

*Primary Examiner*—Anh T. N. Vo
(74) *Attorney, Agent, or Firm*—Baker Botts L.L.P.

(57) ABSTRACT

There is disclosed a liquid droplet ejecting apparatus including: a tank storing a liquid; a nozzle from which the liquid is ejected in the form of a droplet; a first pressure-feed portion which is disposed between the tank and the nozzle, and pressure-feeds the liquid as supplied from the tank, to eject the liquid droplet from the nozzle; a second pressure-feed portion which has an inner volume larger than that of the first pressure-feed portion, and is disposed between the tank and the first pressure-feed portion, the second pressure-feed portion pressure-feeding the liquid as supplied from the tank to the nozzle via the first pressure-feed portion, to eject the liquid from the nozzle in an amount larger than an amount of the liquid ejected by the first pressure-feed portion as the liquid droplet; and the second pressure-feed portion including: a pressure chamber; a pressurizing member that pressurizes the liquid in the pressure chamber by decreasing an inner volume of the pressure chamber; and a liquid communication passage which holds the tank and the nozzle in communication with each other via the pressure chamber, and which includes a flow resistance generator which is disposed in at least one of a portion of the liquid communication passage between the tank and the pressure chamber, and a portion of the liquid communication passage between the pressure chamber and the nozzle, the flow resistance generator giving a flow resistance to the liquid as flowing in the at least one of the two portions of the liquid communication passage.

48 Claims, 35 Drawing Sheets

U.S. PATENT DOCUMENTS

| | | | | |
|---|---|---|---|---|
| 5,631,683 | A | 5/1997 | Nishioka et al. | |
| 5,831,650 | A | 11/1998 | Reinten | |
| 6,134,761 | A * | 10/2000 | Usui | 29/25.35 |
| 6,152,559 | A | 11/2000 | Kojima | |
| 6,270,203 | B1 * | 8/2001 | Kitahara et al. | 347/70 |
| 6,273,552 | B1 | 8/2001 | Hawkins et al. | |
| 6,290,340 | B1 * | 9/2001 | Kitahara et al. | 347/70 |
| 6,460,977 | B2 * | 10/2002 | Cho et al. | 347/65 |
| 6,899,418 | B2 | 5/2005 | Sasaki et al. | |
| 6,905,313 | B2 | 6/2005 | Sasa | |
| 6,945,636 | B2 * | 9/2005 | Sakaida et al. | 347/68 |
| 7,152,966 | B2 | 12/2006 | Sasaki et al. | |
| 2005/0099474 | A1 | 5/2005 | Sasaki et al. | |

FOREIGN PATENT DOCUMENTS

| | | | |
|---|---|---|---|
| JP | 1-105744 | A | 4/1989 |
| JP | 64-90755 | A | 4/1989 |
| JP | 5-92578 | A | 4/1993 |
| JP | 6-99589 | A | 4/1994 |
| JP | 6-246924 | A | 9/1994 |
| JP | 7-81054 | A | 3/1995 |
| JP | 7-232436 | A | 9/1996 |
| JP | 10-129008 | A | 5/1998 |
| JP | 10-151761 | A | 6/1998 |
| JP | 2774883 | B2 | 7/1998 |
| JP | 2819639 | B2 | 8/1998 |
| JP | 2894992 | B2 | 3/1999 |
| JP | 11-19840 | A | 7/1999 |
| JP | 11-235831 | A | 8/1999 |
| JP | 2000-177121 | A | 6/2000 |
| JP | 2000-238267 | A | 9/2000 |
| JP | 2001-232807 | A | 8/2001 |
| JP | 2002-264358 | A | 9/2002 |
| JP | 2004-106509 | A | 4/2004 |

* cited by examiner

LIQUID DROPLET EJECTING APPARATUS

INCORPORATION BY REFERENCE

The present application is based on Japanese Patent Applications No. 2005-017711, filed on Jan. 26, 2005, No. 2005-024426, filed on Jan. 31, 2005, No. 2005-053067, filed on Feb. 28, 2005, and No. 2005-062240, filed on Mar. 7, 2005, the contents of which are incorporated herein by reference.

BACKGROUND OF THE INVENTION

1. Field of the Invention

The invention relates to a liquid droplet ejecting apparatus including a temporary storing chamber which stores a liquid as supplied from a main tank, and from which the liquid is supplied to an ejecting head having nozzles, from which the liquid is ejected in the form of droplets. In particularly, the invention relates to a liquid droplet ejecting apparatus having a purging mechanism for restoring an ejection performance of the apparatus.

2. Description of Related Art

In an inkjet recording apparatus as a kind of a liquid droplet ejecting apparatus, as the recording apparatus is used for a relatively long term, a liquid may evaporate from an ink, with which an image is formed by ejecting droplets thereof onto a recording medium from nozzles formed in a recording head in the recording apparatus, thereby making the ink highly viscous, and also bubbles of air may be accumulated in the recording head. The air bubbles in the recording head are produced such that the air is introduced from the exterior to the interior of the recording head through nozzles, or the air dissolved in the ink aggregate and grow into the bubbles in the ink as temporarily stored in a sub tank as a temporary storing chamber. Further, the air bubbles may be produced when the ink in the sub tank is shook or moved during the inkjet recording apparatus is transferred. The highly viscous ink and the bubbles in the recording head clog the nozzles to deteriorate the ink ejection performance of the recording head, namely, droplets of the ink may not be ejected as desired in forming an image. In addition, the ink may contain a foreign material such as dust and dirt and ink powder or the ink as dried. Such a foreign material may also cause the clogging of the nozzles. Since the thus deteriorated ink ejection performance leads to degradation in the quality of the formed image, an inkjet recording apparatus typically includes a purging mechanism for implementing a restoring operation for eliminating the highly viscous ink, bubbles, and others, in order to restore the ink ejection performance of the recording head to the initial, excellent level.

The restoring operation is roughly divided into a purging operation, which may be implemented cyclically for instance, and a flashing operation (or a preliminary ejection operation). The purging operation is implemented to discharge the fresh ink along with the highly viscous ink, the ink powder, the air bubbles, the dust, and the others, by (i) forcibly sucking the fresh ink from the exterior of the recording head through the nozzles, by applying a negative pressure, or (ii) forcibly pressure-feeding the fresh ink into the recording head from the upstream side of the recording head with respect to an ink communication passage that communicates a main tank with the nozzles in the recording apparatus. On the other hand, the flashing operation is implemented mainly during a continuous operation of the recording apparatus, in order to discharge the ink whose viscosity has been increased during the operation, from the nozzles. It is usual that the flashing operation is implemented more frequently than the purging operation, but the amount of the ink as discharged along with the viscous ink and others in the flashing operation is smaller than that in the purging operation.

In the former way of purging where the ink is sucked by a negative pressure to eliminate the bubbles and the foreign material, a cap is used to cover the nozzles so as to receive the ink as discharged or sucked from the recording head. Hence, the fresh ink is necessarily sucked to an amount corresponding to an inner volume of the cap, leading to a large volume of the ink wasted.

In the latter way of purging (i.e., "the positive-pressure purging") where the ink is applied with a positive pressure from an internal side of the recording head opposite to the nozzles (that is, from a side from which the ink is supplied) so that the ink is pressure-fed into the recording head, the amount of the ink wasted can be reduced as compared with the former way of purging. That is, in the latter way also, the fresh ink is wasted since the ink is discharged along with the bubbles and foreign material, but by applying the positive pressure for a short time period and quickly eliminating the positive pressure, the amount of the waste ink can be made relatively small.

JP-A-10-151761 (hereinafter referred to as "first publication") discloses an inkjet recording apparatus including a pump used in the purging operation. The pump is operated to pressurize an ink tank storing an ink, in order to eliminate bubbles and a solid material in an inset recording head and an ink communication passage in the recording apparatus.

However, the inkjet recording apparatus disclosed in the first publication has a drawback that even when the pump is reduced in size, employment of the pump and a driving device for the pump is essential, making the structure of the apparatus complex, and an overall size of the apparatus large.

JP-A-11-235831 (hereinafter referred to as "second publication") discloses an inkjet recording apparatus including an ink cartridge that stores an ink and has a lid. The lid has a protrusion that pressurizes the ink in the ink cartridge as the lid is closed, in order to forcibly pressure-feed the ink to an inkjet recording head, thereby accomplishing the purging operation.

However, the inkjet recording apparatus disclosed in the second publication where the lid is manually closed by a user to apply a pressure to the air and in turn the ink in the ink cartridge, has a drawback that a speed at which the lid is closed fluctuates, thereby causing a variation in the applied pressure, and making it difficult to stably implement the purging operation.

It is also known to use, in the positive-pressure purging, a valve to eliminate the once applied positive pressure, namely, the valve is opened when the positive pressure is to be eliminated. In operation, the opening of the valve should be made instantly and stably in order to control the amount of the waste ink. Thus, it is desirable to use a solenoid valve having a stable opening characteristic. However, a solenoid valve is generally large in size and high in price, which works against the downsizing and cost reduction of the inkjet recording apparatus. Thus, in practice, a solenoid valve can not be used in view of the cost effectiveness.

To solve this problem, Japanese Patent No. 2819639 (hereinafter referred to as "third publication") for instance, discloses a pump mechanism including a plunger and a cylinder for pressurizing an ink stored in a sub tank to pressure-feed the ink into a recording head, in order to restore an ink ejection performance of the recording head.

In this pump mechanism for restoring the ink ejection performance, the plunger is slidably received in the cylinder that is vertically displaceable in the sub tank. The plunger is normally biased by a restoring spring to an upper position to open an ink supply port formed at a bottom of the ink tank. An O-ring is interposed between the cylinder and the plunger to seal therebetween.

When a head portion of the plunger is pushed downward against a biasing force of the restoring spring, the cylinder is initially displaced to a position to cover the ink supply port and stops there. Then, by the head portion of the plunger being further pushed down, the plunger slides down in the currently stationary cylinder. Since a bottom of the cylinder covering the ink supply port has an opening, the plunger, as pushed down to the position to contact the bottom of the ink tank, pressure-feeds the ink into the recording head, thereby discharging the ink containing the bubbles and others to the exterior through the nozzles.

Upon termination of the pushing of the plunger, the plunger and the cylinder are integrally displaced upward by the biasing force of the restoring spring. Then, the cylinder is brought into contact with an inner wall surface of the ink tank and stops there, and thereafter only the plunger is displaced to its original position by the spring force of the restoring spring.

The pump mechanism for restoring the ink ejection performance is disadvantage in the following. The O-ring disposed between the cylinder and the plunger to allow the relative sliding movement in friction between the plunger and the cylinder may be damaged by wear or secular change or for other reasons. This causes the cylinder to fall to the lowermost position in the ink tank by its, own weight, and then the cylinder is held there. This means that the bottom of the cylinder keeps closing the ink supply port, inhibiting the supply of the ink, whether by the pressure-feeding or not, into the recording head.

Further, since the technique of the third publication requires the O-ring and the vertically displaceable cylinder, the number of components and accordingly the cost of the recording apparatus are large, and also the number of production steps can not be reduced.

Meanwhile, JP-A-5-92578 (hereinafter referred to as "fourth publication") (see FIG. 1) for instance, discloses, as another example of the positive-pressure purging, an arrangement where an air pressure pump is used to compress the air in a sub tank, in turn applying a positive pressure to the ink in the sub tank so as to pressure-feed the ink to the downstream side with respect to an ink communication passage into a recording head, from which the ink is discharged to the exterior.

However, in the arrangement of the fourth publication, the pressurizing of the ink is made such that initially the air is compressed to produce a pressure which is then transmitted to a surface of the ink in the sub tank. Thus, the pressure loss is large, making the purging operation inefficient. In addition, by the compression of the air, the ink may flow in the reverse direction also, that is, the ink may flow back toward an ink supply source as well as toward the recording head, thereby further lowering the efficiency of the purging. In order to prevent the ink flow in the reverse direction, it is essential to dispose a check valve at an appropriate position.

To restore the ink ejection performance of the recording head, it is necessary to discharge the ink from the nozzles in an amount sufficiently large in each discharging, or at a speed sufficiently high. In the arrangement where the air is compressed first, the speed of the ink flow rises relatively slowly, due to the large pressure loss. Hence, before the speed reaches the sufficient level for purging, a large amount of the ink flows out of the recording head, leading to much waste of ink.

Further, in the arrangement of the fourth publication where the air pressure pump is used to compress the air in the sub tank in order to restore the ink ejection performance of the recording head, the air pressure pump is required in the purging mechanism, and a drive source and a link mechanism for transmitting a driving force for the air pressure pump are also required. Hence, an overall size of the apparatus and the cost are increased, while the load imposed on the purging mechanism is high.

To overcome the drawbacks of such an arrangement involving the air compression, JP-A-7-232436 (hereinafter referred to as "fifth publication") for instance, discloses another arrangement for the positive-pressure purging, which includes a head case, a sub tank (or an ink sack) of elastic material which is accommodated in the head case and storing an ink, and a pressure chamber at least a part of which is formed of an elastic member, and which is in communication with the head case. In the purging operation, in order to discharge the ink from the nozzles, a user manually or with fingers presses the elastic member to change an inner volume of the head case, thereby applying a positive pressure to the sub tank to reduce an inner volume of the sub tank.

In the arrangement of the fifth publication where the ink discharge is made by a change in the inner volume of the head case, the speed of the ink flow rapidly rises up to the level sufficient for the purging operation, thereby reducing the amount of the ink wasted in the purging operation. However, this arrangement may generate ink flow in the reverse direction toward the ink supply source when the pressure applied to change the inner volume is eliminated, thereby lowering the efficiency. Hence, in this arrangement, too, a check valve is essentially disposed.

Further, when the inner volume of the head case is restored, or when the sub tank is restored to its original shape, after the purging operation, a negative pressure is produced at the nozzles, thereby causing flow of the ink in the reverse direction from the nozzles back into the recording head. Depending on the magnitude of the negative pressure, meniscuses formed in the nozzles may be broken.

The arrangement of the fifth publication, where the elastic member is pressed to pressurize the air in the head case and in turn presses the sub tank in order to purge the nozzles, can omit the air pressure pump and the associated devices, but requires the user to manually press the elastic member each time the purging operation is to be implemented. This troubles the user very much, deteriorating the user-friendliness.

All the above-described drawbacks are seen not only in the inkjet recording apparatus, but also in various kinds of liquid droplet ejecting apparatuses where a liquid stored in a sub tank is supplied to an ejecting head having a nozzle from which the liquid is ejected in the form of droplets.

SUMMARY OF THE INVENTION

The present invention has been developed in view of the above-described situations, and it is an object of the invention to provide a liquid droplet ejecting apparatus having a purging mechanism that restores an ejection performance of a recording head by pressurizing a liquid in a temporary storing chamber to pressure-feed the liquid toward the nozzle, without increasing the numbers of components and assembly steps and the cost.

To attain the above objects, this invention provides a liquid droplet ejecting apparatus including:

a tank storing a liquid;

a nozzle from which the liquid is ejected in the form of a droplet;

a first pressure-feed portion which is disposed between the tank and the nozzle, and pressure-feeds the liquid as supplied from the tank, to eject the liquid droplet from the nozzle;

a second pressure-feed portion which has an inner volume larger than that of the first pressure-feed portion, and is disposed between the tank and the first pressure-feed portion, the second pressure-feed portion pressure-feeding the liquid as supplied from the tank to the nozzle via the first pressure-feed portion, to eject the liquid from the nozzle in an amount larger than an amount of the liquid ejected by the first pressure-feed portion as the liquid droplet; and the second pressure-feed portion including:

a pressure chamber;

a pressurizing member that pressurizes the liquid in the pressure chamber by decreasing an inner volume of the pressure chamber; and a liquid communication passage which holds the tank and the nozzle in communication with each other via the pressure chamber, and which includes a flow resistance generator which is disposed in at least one of a portion of the liquid communication passage between the tank and the pressure chamber, and a portion of the liquid communication passage between the pressure chamber and the nozzle, the flow resistance generator giving a flow resistance to the liquid as flowing in the at least one of the two portions of the liquid communication passage.

The second pressure-feed portion is operated to implement the purging, namely, to discharge the liquid from the nozzle in an amount larger than an amount of the liquid ejected by the first pressure-feed portion in the form of the liquid droplet, in order to eliminate clogging of the nozzle. In discharging the liquid in this way, as the pressurizing member advances, the liquid in the pressure chamber is pressure-fed toward the nozzle, but a part of the liquid is flown in a reverse direction toward the tank, since the tank and the nozzle are held in communication with each other through the liquid communication passage.

When the pressurizing member is retracted, the pressure chamber is replenished with the liquid that is supplied from the tank along the liquid communication passage, but a part of the liquid tends to in a reverse direction from the nozzle toward the pressure chamber. When flow in the reverse direction actually occurs, a meniscus formed in a nozzle is broken, thereby making it impossible to normally eject the liquid droplet next time.

Such reverse flow may be prevented by disposing a suction valve and a discharge valve as those of a usual pump, at suitable positions, but this makes the structure of the apparatus complex. Hence, in the invention, the tank and the nozzle, are held in communication with each other through the liquid communication passage having a flow resistance, and the advancement of the pressurizing member is made at a high speed, in order to pressure-feed the liquid from the pressure chamber to the nozzle in a sufficiently large amount, but the retraction of the pressurizing member is made at a low speed in order to replenish the pressure chamber with the liquid supplied from the tank in a sufficient amount while the reverse flow from the nozzle toward the pressure chamber is prevented.

When the liquid droplet ejecting apparatus includes a pressurizing-member driving device, the device is constructed to have such characteristics, but provision of the pressurizing-member driving device is not essential. Namely, the pressurizing member can be manually displaced by a user.

The flow resistance generator is preferably disposed in the portion of the liquid communication passage between the pressure chamber and the tank to be highly effective, but can give some effect even when disposed between the pressure chamber and the nozzle. A flow resistance generator disposed in the portion between the pressure chamber and the tank restricts the reverse flow of the liquid from the pressure chamber to the tank in order to effectively flow the liquid to the nozzle, and a flow resistance generator disposed in the portion between the pressure chamber and the nozzle restrains the reverse flow of the liquid from the nozzle toward the pressure chamber in order to prevent breakage of the meniscus. When a flow resistance generator is disposed at both of the portions, with their function to generate a flow resistance being appropriately adjusted, the liquid can be effectively discharged from the nozzle while the meniscus is maintained, with enhanced reliability.

The flow resistance generator may be a flow restrictor that restricts flow of the liquid. When the flow resistance generator is the flow restrictor, the liquid communication passage can be referred to as "restricting communication passage".

According to this apparatus, the suction valve and discharge valve used in the conventional arrangement are omitted.

The invention also provides a liquid droplet ejecting apparatus including:

a main tank which stores a liquid;

a head unit including:

a temporary storing chamber which temporarily stores the liquid as supplied from the main tank;

a nozzle; and a first pressure-feed portion which pressure-feeds the liquid as supplied from the temporary storing chamber to the nozzle so that the liquid is ejected from the nozzle in the form of a droplet;

a unit moving device which moves the head unit within a predetermined moving range;

a second pressure-feed portion including:

the temporary storing chamber; and an operable member which protrudes from an external wall surface of the temporary storing chamber, and is moved toward an internal space of the temporary storing chamber so that the liquid is pressure-fed to the nozzle via the first pressure-feed portion from the temporary storing chamber; and an operating member which operates the operable member as a result of the movement of the head unit by the unit moving device, such that the operable member is moved toward the internal space of the temporary storing chamber.

According to this apparatus, a purging operation can be performed efficiently and reliably, by applying a positive pressure with a simple structure, and an amount of the liquid wasted is reduced.

The invention also provides a liquid droplet ejecting apparatus including:

a head unit including:

a temporary storing chamber which temporarily stores the liquid as supplied from the exterior;

a nozzle; and a first pressure-feed portion which pressure-feeds the liquid as supplied from the temporary storing chamber to the nozzle so that the liquid is ejected from the nozzle in the form of a droplet;

a second pressure-feed portion including an actuator which constitutes at least a part of a wall of the temporary storing chamber and is deformed upon application of a voltage to the actuator to change an inner volume of the temporary storing chamber, the second pressure-feed portion pressure-feeding the liquid to the nozzle via the first pressure-feed portion to eject the liquid from the nozzle; and a reverse flow restrictor which is disposed on an upstream side of the temporary storing chamber with respect to flow of the liquid, and allows flow of the liquid from the exterior into the temporary storing chamber, but restricts flow of the liquid in the opposite direction from the temporary storing chamber toward the exterior.

According to this apparatus, a purging operation can be performed by applying a positive pressure with a simple structure that requires neither a relatively complex device for the purging operation including a plurality of movable members, nor manual manipulation of any operating members by a user.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIGS. 4A and 4B are detail views of a head unit of the recording apparatus, in which FIG. 4A is a cross-sectional view as seen from the front side, and FIG. 4B is a cross-sectional view taken along line B-B in FIG. 4A;

FIGS. 5A and 5B are explanatory views of a mesh pressurizing member and a connecting member constituting a positively pressurizing portion of the head unit, in which FIG. 5A is a plan and an elevational view of the mesh pressurizing member, and FIG. 5B is a plan and an elevational view of the connecting member;

FIGS. 20A and 20B are views showing a structure of a head unit according to an eleventh embodiment of the invention, in which FIG. 20A is a cross-sectional view as seen from the front side, and FIG. 20B is a cross-sectional view taken along line B-B in FIG. 20A;

FIGS. 27A and 27B are cross-sectional views of a sub tank unit and a check valve of the head unit, in which FIG. 27A shows a normal or non-operated state, and FIG. 27B shows an operated state where a voltage is applied to a conducting polymer actuator of the sub tank unit;

DETAILED DESCRIPTION OF PREFERRED EMBODIMENTS

Hereinafter, there will be described presently preferred embodiments of the invention, by referring to the accompanying drawings.

First Embodiment

Referring to FIGS. 1 to 9, there will be described an inkjet recording apparatus according to a first embodiment of the invention, as used in a multifunction apparatus having a plurality of functions such as print function, scan function, copy function, and facsimile function.

<General Structure of Multifunction Apparatus 1>

Figure 1:
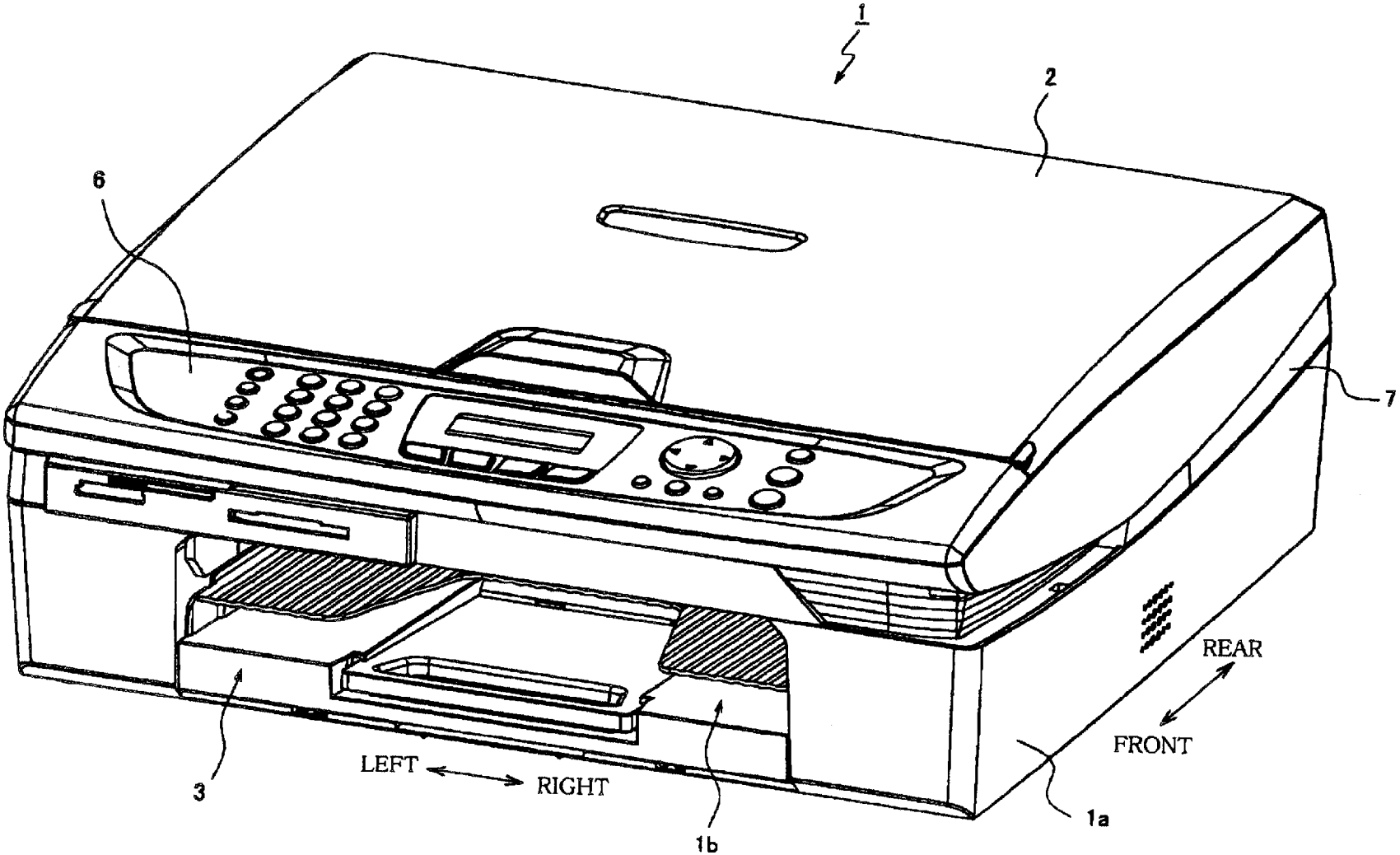
FIG. 1 is an external perspective view of a multifunction apparatus including an inkjet recording apparatus according to a first embodiment of the invention.
Figure 2:
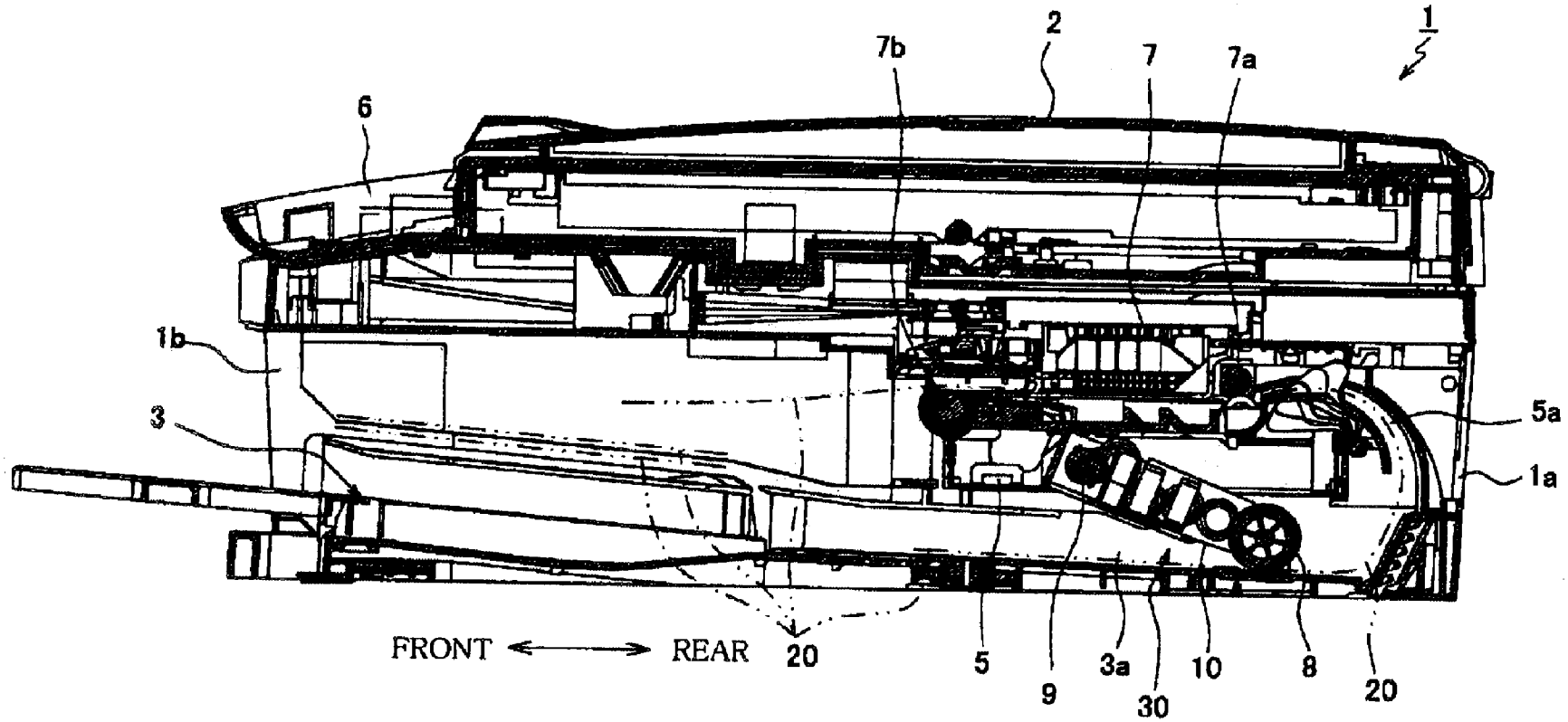
FIG. 2 is a cross-sectional view of the multifunction apparatus shown in FIG. 1.

In FIGS. 1 and 2, reference numeral 1 generally denotes a multifunction apparatus 1 according to the first embodiment, which has a casing 1*a*, and a scanner 2 disposed on an upper side of the casing 1*a*. In an upper portion of an internal space of the casing 1, an inkjet recording apparatus 7 that performs recording, namely, forming an image on a recording medium 20 in an operation of any relevant one of the various functions. In a lower portion of the internal space of the casing 1*a*, a medium feeder 30 is disposed.

In a rear portion of the space inside the casing 1*a* and above the medium feeder 30, a box-shaped metal frame 5 is disposed. The frame 5 has a substantially rectangular shape extending across a width of the multifunction apparatus 1.

The inkjet recording apparatus 7 is disposed in an upper portion of a space inside the frame 5, and a feeding path 5*a* is formed on a rear side of the frame 5 in order to guide a recording medium 20 from a rear side of the medium feeder 30 to the inkjet recording apparatus 7. The inkjet recording apparatus 7 has a feeder roller 7*a* adjacent to an outlet of the feeding path 5*a*, and an ejector roller 7*b* at a position where the recording medium 20 on which an image has been recorded is ejected. The feeder roller 7*a* is rotated by a driving force from a line feed motor 123 (shown in FIG. 7). The inkjet recording apparatus 7 are shown in detail in FIG. 3, and will be fully described later.

The medium feeder 30 has a medium supply cassette 3 that is inserted from an opening 1*b* of the casing 1*a* to be set in position. The medium supply cassette 3 has a medium accommodating portion 3*a* in which a stack of recording media 20 is accommodated. When the medium supply cassette 3 is inserted into the casing 1*a*, the stack of the recording media 20 in the medium accommodating portion 3*a* is located in the rear portion of the space inside the casing 1*a*.

The topmost one of the recording media 20 stacked in the medium accommodating portion 3*a* is fed out into the inkjet recording apparatus 7 along the feeding path 5*a* by a pickup roller 8 rotated. The pickup roller 8 is rotatably held at an end of a long arm 10 that is pivotally supported by a drive shaft 9. When the drive shaft 9 is rotated by a driving force from a medium supply motor 122 (not shown in FIG. 2 but shown in FIG. 7), the rotation of the drive shaft 9 is transmitted to the pickup roller 8 to rotate the pickup roller 8.

In an upper front surface of the multifunction apparatus 1 is disposed an operator panel 6 in which various manual operation buttons and a liquid crystal panel are arranged. Through the operator panel 6, a user can make various settings for the various functions of the multifunction apparatus 1, make inputs of data or the like such as facsimile numbers, and check an operating condition of the apparatus 1 or a history of communications ever made.

<Structure of the Inkjet Recording Apparatus 7>

Figure 3:
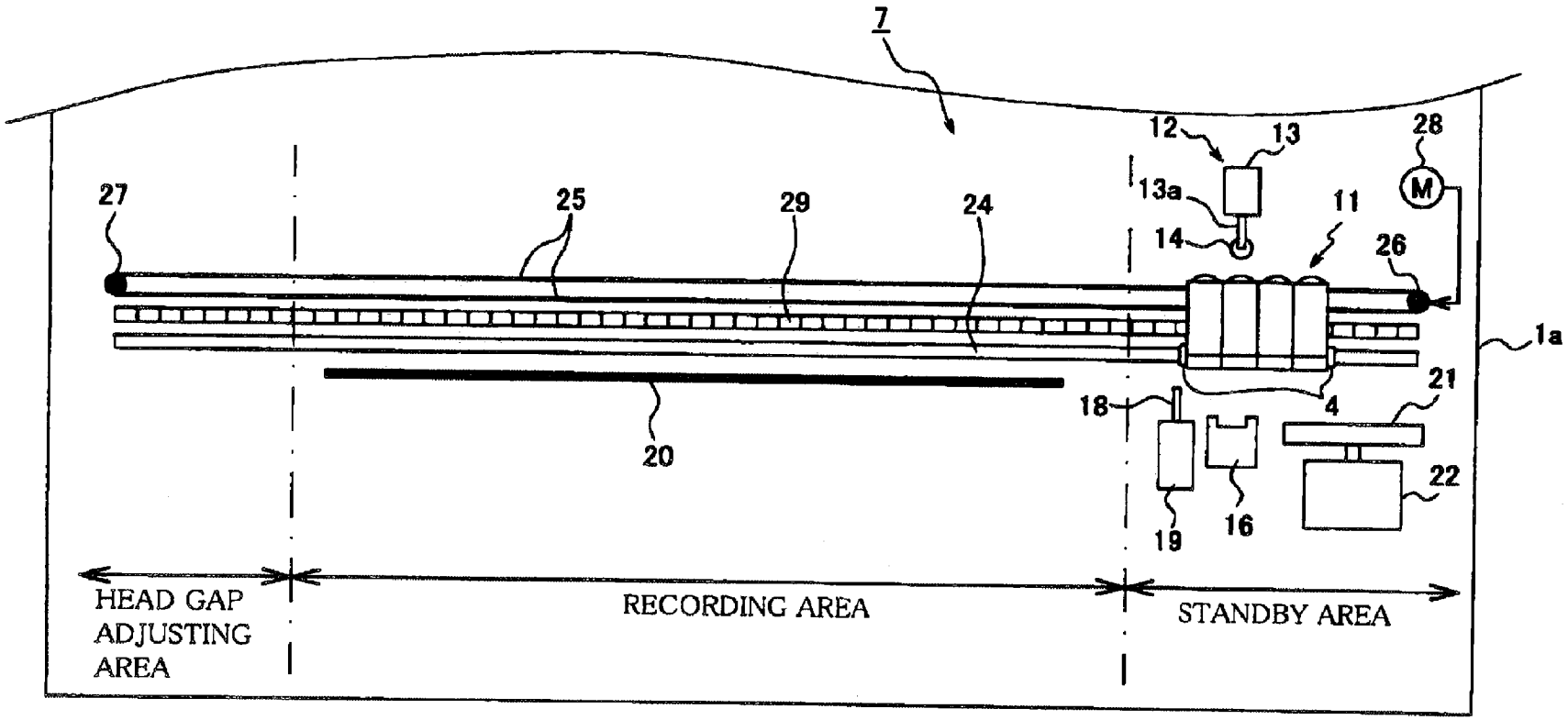
FIG. 3 schematically illustrates the inkjet recording apparatus of the multifunction apparatus.

With reference to FIG. 3, there will be now described in detail a structure of the inkjet recording apparatus 7 incorporated in the multifunction apparatus 1. The inkjet recording apparatus 7 corresponds to a liquid droplet ejecting apparatus according to the invention.

As shown in FIG. 3, a guide rod 24 extends in the inkjet recording apparatus 7, in a width direction of the recording medium 20 as being fed by the feeder roller 7*a* and others. The guide rod 24 extends through a portion of a carriage 4, on which a head unit 11 is mounted. The head unit 11 performs recording on the recording medium 20 by ejecting droplets of inks of respective colors from nozzles 37, 47, 57, 67 (shown in FIG. 4A) formed in a recording head 69. The four color inks are supplied from respective ink cartridges 71 (shown in FIG. 4B) as main tanks. The head unit 11 will be fully described later.

The carriage 4 is coupled with an endless belt 25 extending along the guide rod 24. More specifically, the endless belt 25 is wound around a pulley 26 and an idle pulley 27. The pulley 26 is disposed at a position corresponding to an end of the guide rod 24 and connected to a carriage motor 28, and the idle pulley 27 is disposed at a position corresponding to the other end of the guide rod 24.

The carriage 4 can be reciprocated along the guide rod 24, that is, in the width direction of the recording medium 20, by a driving force of the carriage motor 28 transmitted via the endless belt 25. The mechanism for reciprocating the carriage 4 corresponds to a unit moving device.

In the vicinity of the guide rod 24, a timing strip 29 extends along the guide rod 24. In the timing strip 29 are formed, at constant intervals, a plurality of slits having a same width.

Under the carriage 4 is disposed a sensor in the form of a photo interrupter (not shown) including a photoemitter and a photoreceptor that are disposed on the opposite sides of the timing strip 29. The sensor cooperates with the timing strip 29 to constitute a linear encoder 118 for detecting movement of the carriage (i.e., a carriage movement encoder) (shown in FIG. 7). The carriage movement encoder 118 detects an amount of displacement, or the position, of the carriage 4 and accordingly of the head unit 11.

As shown in FIG. 3, an area across which the carriage 4 reciprocates along the guide rod 24 is constituted by three areas, namely, a recording area, a standby area, and a head gap adjusting area. Recording on the recording medium 20 is performed while the head unit 11 is moved within the recording area. While the head unit 11 is within the standby area, recording is not performed.

The standby area is disposed near the end of the guide rod 24 corresponding to the pulley 26. A maintenance operation is performed while the head unit 11 is located within the standby area. The standby area includes a home position, which is located at the rightmost position in FIG. 3 and at which the carriage 4 stands still while none of operations such as a recording operation and the maintenance operation is performed. The maintenance operation includes a wiping operation to wipe off the ink on a nozzle surface of the recording head 69, in which the nozzles 37, 47, 57, 67 open, and a positive-pressure purging operation to remove the ink as dried in the nozzles and a foreign material introduced into the recording head 69, by applying a positive pressure from an internal side of the recording head 69, in order to make the recording head 69 capable of normally ejecting ink droplets.

A head gap adjuster (not shown) that adjusts a head gap, which is a clearance between the nozzles 37, 47, 57, 67 (shown in FIG. 4A) of the recording head 69 and the recording medium 20, is operable while the head unit 11 is within the head gap adjusting area.

In the standby area, and at a position to be opposed to the recording head 69 of the carriage, 4, as stationary at the home position, there is disposed a cap 21. The cap 21 is to cover all the nozzles 37, 47, 57, 67 of the recording head 69 while the recording apparatus 7 is not operated, in order to prevent drying of the inks. The cap 21 is operated by a cap driving portion 22.

That is, while the carriage 4 is stationary at the home position, the cap 21 is raised to cover the recording head 69 disposed at the bottom of the head unit 11. When the carriage 4 is to be moved, for instance when a recording or maintenance operation is to be performed, the cap 21 having covered the nozzles 37, 47, 57, 67 is lowered to expose the nozzles 37, 47, 57, 67 to the exterior, thereby preparing for lateral movement of the carriage 4 thereafter.

At a position adjacent the cap 21 in the direction of the lateral movement or reciprocation of the carriage 4, a receiver dish or a cap 16 that receives in the purging operation the waste ink discharged from the nozzles 37, 47, 57, 67, and a wiper blade 18 for wiping off the ink and others adhering to the nozzle surface. The wiper blade 18 is displaceable by a wiper-blade driving portion 19 in a vertical direction as seen in FIG. 3, and normally held at a lowered position on the side of the wiper-blade driving portion 19. The wiper blade 18 is raised to wipe the nozzle surface after the positive-pressure purging operation is implemented.

Although detailed description of the purging operation will be provided later, the purging operation is briefly described here. That is, the purging operation is implemented such that the inks are discharged through the nozzles 37, 47, 57, 67 having been moved to the position opposed to the cap 16, so that the inks and others adhering to the nozzle surface are wiped off by the wiper blade in the purging operation.

Figure 4A:
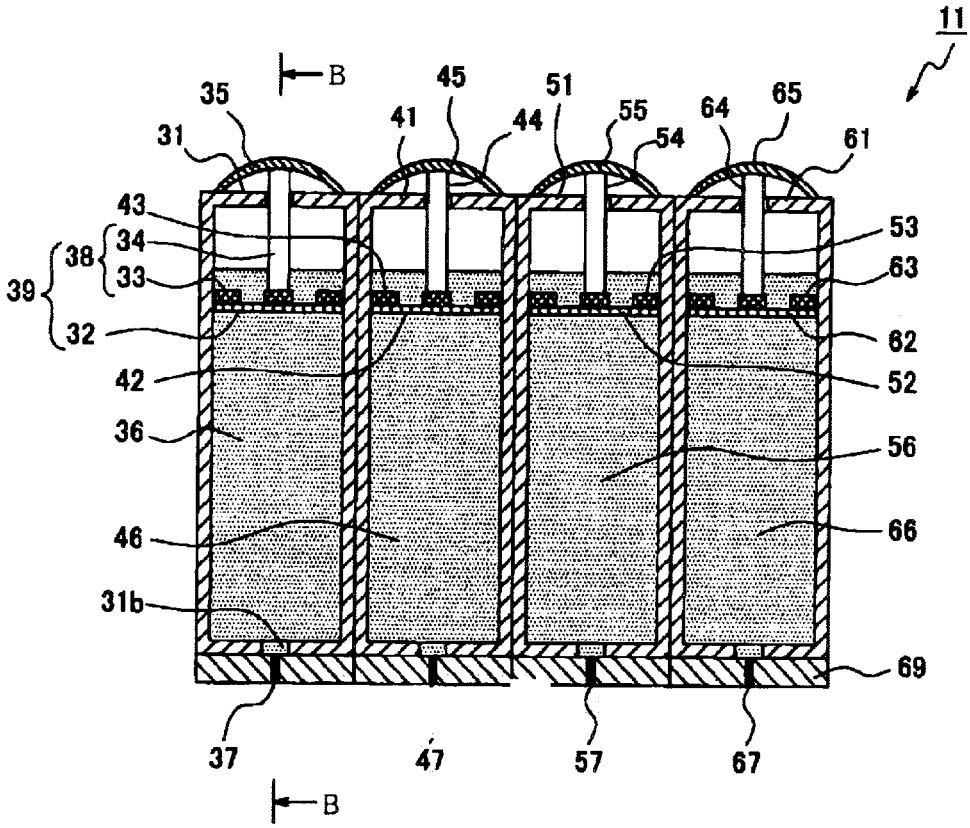

In the standby area, a pushing device 12 (corresponding to a pressurizing-member driving device) is disposed over a head unit 11, that is, on a side of the head unit 11 remote from the recording head 69. The pushing device 12 includes a roller shaft 13*a*, a presser roller 14 (corresponding to an operating member and a rotary member) that is rotatably attached to an end of the roller shaft 13*a*, and a roller-shaft driving portion 13 that moves the roller shaft 13*a* in a vertical direction. A vertical position or a level of the presser roller 14 is adjusted such that in a normal state where the purging operation is not implemented, the presser roller 14 does not contact the head unit 11, and when the purging operation is to be performed, the roller shaft 13*a* and accordingly the presser roller 14 is lowered so that the presser roller 14 can be brought into contact with each of elastic support members 35, 45, 55, 65 (corresponding to an operable member) disposed at an upper portion of each of four sub tank units of the head unit 11, as shown in FIG. 4A, as the carriage 4 is laterally moved. A combination of the roller-shaft driving portion 13 and the roller shaft 13*a* corresponds to an operating-member driving device and an operating-member moving device.

In the thus constructed inkjet recording apparatus 7, upon initiation of the recording operation, the maintenance operation, or like operations, the cap 21 covering the recording head 69 is retracted away from the nozzle surface and then the carriage 4 having been held at the home position starts moving toward the recording area.

In a case where the operation to be performed is the maintenance operation, or a recording operation which requires implementation of the maintenance operation prior to that recording operation (for instance, in a case where a predetermined time period has elapsed after the last recording operation), the presser roller 14 of the pushing device 12 is lowered, so that the elastic support members 35, 45, 55, 65 at the upper portion of the sub tank units of the head unit 11 are sequentially pushed or pressed by the presser roller 14 as the carriage 4 moves, thereby accomplishing the purging operation. In the purging operation, the ink droplets and other materials discharged from the nozzles 37, 47, 57, 67 are accumulated in the cap 16 as described above.

After the purging operation, as the carriage 4 further moves toward the recording area, the inks and others adhering to the nozzle surface is wiped off by the wiper blade. When the wiping operation is finished, all the inks of respective colors are mixed on the nozzle surface, and if the nozzle surface is left in this state, an ink of a color different from a color of an ink to be ejected from each nozzle is introduced into that nozzle, causing color mixing. Hence, each time the wiping operation is finished, the carriage 4 is returned to the position to be opposed to the cap 16, and at this position the recording head 69 is normally operated as in a usual recording operation to discharge the inks from the nozzles 37, 47, 57, 67. This is a so-called preliminary ejection operation, or a flashing operation.

Where only the maintenance operation is necessary upon completion of the flashing operation the head unit 11 is returned to the home position at which the recording head 69 is capped or covered by the cap 21. On the other hand, where a recording operation is also to be performed thereafter, the carriage 4 moves to the recording area where the recording operation is implemented. More specifically, upon initiation of the recording operation, the carriage 4 is once moved into the head gap adjusting area to be brought into contact with a left-hand end as seen in FIG. 3 of the head gap adjusting area, and then returned by a predetermined distance or moved to the recording area, where the carriage 4 is stopped. Thus, the carriage 4 or the recording head, 69 is set at an initial position.

<Structure of the Had Unit>

Figure 4B:
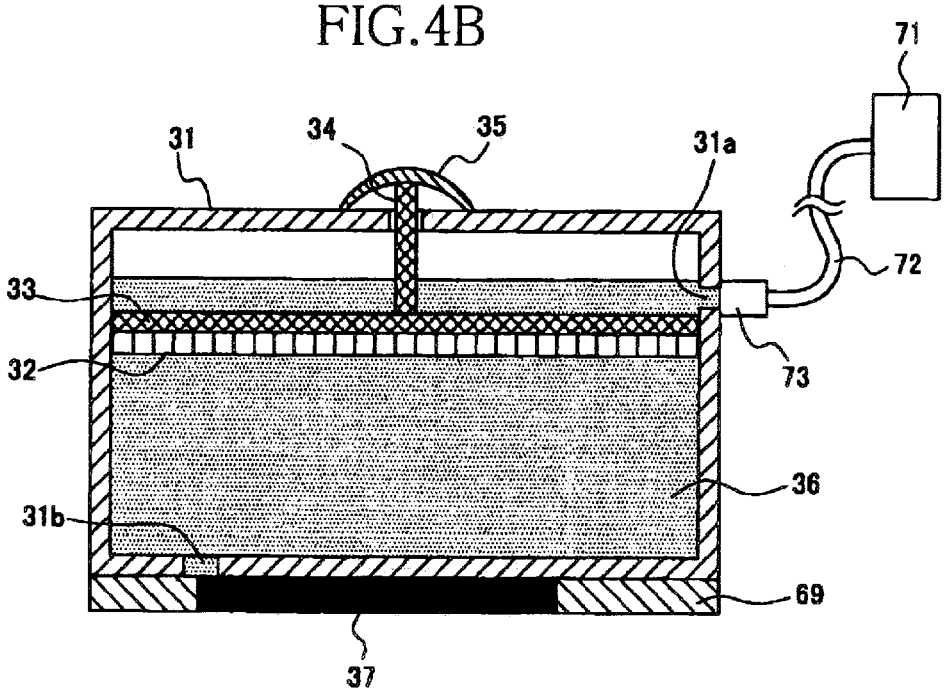

There will be now described in detail a structure of the head unit 11, with reference to FIGS. 4A and 4B that are detailed views of the structure, in which FIG. 4A is a cross-sectional view as seen from the front side and FIG. 4B is a cross-sectional view taken along line B-B in FIG. 4A.

As shown in FIG. 4A, the head unit 11 has at its lower portion the recording head 69, over which are disposed four sub tank units each mainly constituted by a sub tank 31, 41, 51, 61 (corresponding to a cylinder and a temporary storing chamber) storing one of the color inks. More specifically, as seen in FIG. 4A, the sub tank units respectively including the sub tanks 31, 41, 51, 61 that store black ink 36, cyan ink 46, yellow ink 56, and magenta ink 66, respectively, are arranged in this order from left to right.

In the recording head 69 under the sub tank units including the sub tanks 31, 41, 51, 61 (hereinafter abbreviated as "sub tanks 31, 41, 51, 61" for convenience), there are formed the nozzles 37, 47, 57, 67 through which droplets of the inks in the sub tanks are ejected onto the recording medium 20. The recording head 69 is of known piezoelectric type where ink droplets are ejected from the nozzles upon deformation (contraction/expansion) of a piezoelectric element, and detailed description thereof is dispensed with.

There will be now described in further detail an internal structure of the sub tanks 31, 41, 51, 61. Structures of the respective sub tanks 31, 41, 51, 61 are identical with each other, except the colors of the inks stored therein. Hence, in the following description, the leftmost one 31 (as seen in FIG. 4A), of the sub tanks that stores the black ink 36 is mainly described, and description of the other sub tanks 41, 51, 61 is omitted.

As shown in FIGS. 4A and 4B, an ink outlet 31*b* is formed in a bottom wall of the sub tank 31 storing the black ink 36, and an ink inlet 31*a* is formed in an upper portion of a side wall of the sub tank 31. The ink inlet 31*a* is connected by means of a joint 73 to a flexible ink supply tube 72 that is in turn connected to an ink cartridge 71 accommodating the black ink 36.

The black ink in the ink cartridge 71 is supplied via the ink supply tube 72 into the sub tank 31 through its ink inlet 31*a*. The ink 36 flowing into the sub tank 31 is once stored therein, and when the restoring operation or the recording operation is to be performed and it is required to discharge or eject droplets of the ink 36 through the nozzles 37, the ink 36 in the sub tank 31 is supplied to the recording head 69 through the ink outlet 31*b* formed at the bottom thereof, to be discharged or ejected from the nozzles 37.

As shown in FIGS. 4A and 4B, the ink 36 is normally stored in the sub tank 31 to a level slightly above the ink inlet 31*a*, and each time a droplet of the ink 36 is discharged or ejected through the nozzle 37, an amount of the ink corresponding to that of the discharged or ejected ink is introduced into the ink tank 31 from the ink cartridge 71 and via the ink supply tube 72.

The sub tank 31 has a positively pressurizing portion 39 operated in the purging operation, and an elastic support member 35 supporting the positively pressurizing portion 39 (more strictly, the elastic support member 35 supports an end of a connecting rod 34).

The positively pressurizing portion 39 includes a plate-like mesh pressurizing member 32 corresponding to a flow resistance generator, a throughhole member, and a porous member, and a connecting member 38 (corresponding to a transmitting device) that connects the mesh pressurizing member 32 with the elastic support member 35. The connecting member 38 includes a support plate 33 connected to the mesh pressurizing member 32, and the connecting rod 34. The connecting rod 34 can be considered to correspond to a connecting member. The connection between the pressurizing member with the connecting member 38 (more specifically, its support plate 33) may be made with a mechanical part, or by bonding with adhesive. Alternatively, the pressurizing member 32 and the connecting member 38 may be integrally formed. The connection may be direct or indirect connection. That is, the connection may be made anywise as long as the pressurizing member 32 is displaced, at a speed to enable the purging, to the downstream side with respect to an ink communication passage (corresponding to a liquid communication passage) as a result of manipulation of the connecting member from the exterior of the sub tank, or as a result of an elastic deformation (described later) of the elastic support member 35. One of opposite ends of the connecting rod 34 is connected to the support plate 33, while the other end thereof is connected to the elastic support member 35. The connection between the connecting member 38 (more specifically, its connecting rod 34) and the elastic support member 35 may be otherwise made, similarly to the connection between the pressurizing member with the connecting member 38.

Figure 5A:
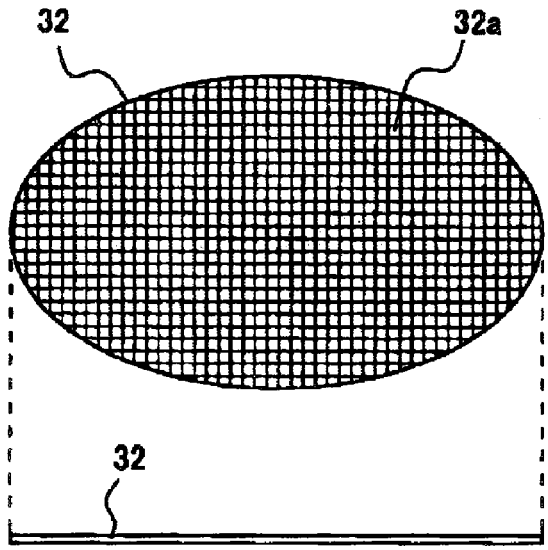
Figure 5B:
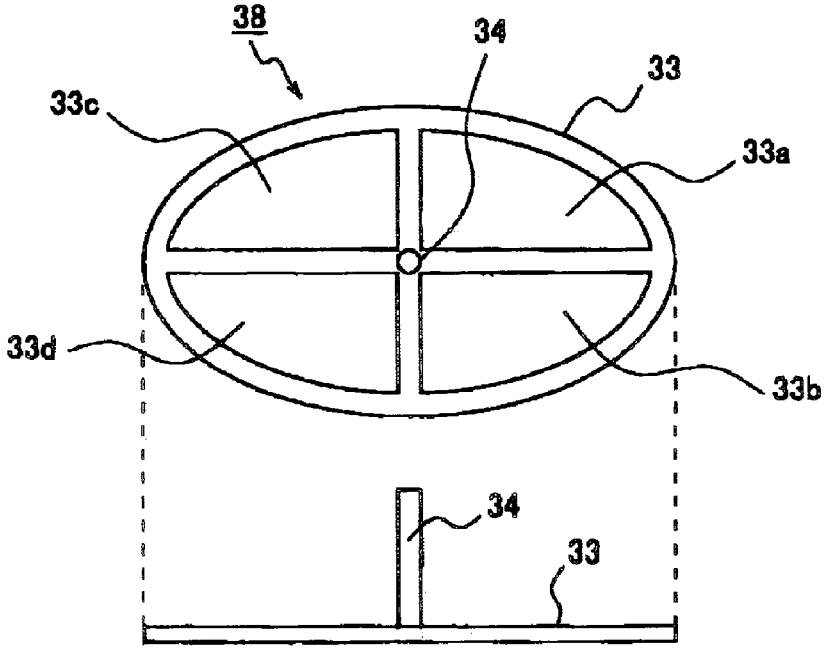

FIGS. 5A and 5B are further detailed views of the mesh pressurizing member 32 and connecting member 38 that constitute the positively pressurizing portion 39. FIG. 5A is a plan and an elevational view of the mesh pressurizing member 32. As shown in FIG. 5A, the mesh pressurizing member 32 is generally elliptical plate-like member having a plurality of ink passages 32*a* in the form of rectangular throughholes of a same cross-sectional area, that are arranged over an entire area of the mesh pressurizing member 32.

FIG. 5B is a plan and an elevational view of the connecting member 38. As shown FIG. 5B, in the connecting member 38, the connecting rod 34 vertically extends from a central portion of the support plate 33 that is the same in size and shape as the mesh pressurizing member 32. The support plate 33 has four throughholes 33*a*, 33*b*, 33*c*, 33*d*. All the throughholes 33*a*-33*d* have a same shape.

The thus constructed positively pressurizing portion 39 is held by the elastic support member 35 in the sub tank 31 and on the downstream side of the ink inlet 31*a* with respect to the ink communication passage. That is, the mesh pressurizing member 32 is located at such a position that while the head unit 11 is stationary, the ink inlet 31*a* is not on the downstream side of the mesh pressurizing member 32 with respect to the ink communication passage, and a portion of an internal space (corresponding to a pressure chamber) of the sub tank 31 on the downstream side of the mesh pressurizing member 32 is filled with the ink, so that the ink in the sub tank does not tend to flow in the reverse direction to the upstream side, namely, toward the main tank or the ink cartridge 71, through the ink inlet 31*a*, when the purging is performed.

As shown in FIG. 4B, the mesh pressurizing member 32 has an elliptical shape that conforms to a contour of a cross-sectional shape of the internal space of the sub tank 31. That is, the mesh pressurizing member 32 is formed and disposed to contact an inner wall surface of the sub tank 31 along an entire circumference thereof, without forming a clearance. Hence, a clearance that allows passage of the ink is not formed between the inner wall surface of the sub tank and the mesh pressurizing member, but the ink passages are formed in the pressurizing member. Thus, the mesh pressurizing member 32 is disposed across the ink communication passage in the sub tank 31, however, the mesh pressurizing member 32 has the ink passages 32*a* formed over the entire area of the mesh pressurizing member 32 in a mesh-like manner, and thus the mesh pressurizing member 32 does not completely shut off the ink communication but allows passage of the ink therethrough by means of the ink passages 32*a*. The arrangement where a clearance is not formed between the inner wall surface of the sub tank and the mesh pressurizing member reduces the variation in the flow resistance given to the ink flow from the downstream side of the pressurizing member to the upstream side of the pressurizing member, which flow occurs when the pressurizing member is pushed down, thereby reducing the variation in the restoration of the ejection performance and in the amount of the discharged ink in the purging. This enhances the stability in the purging, and reduces the running cost of the apparatus.

On the other hand, the elastic support member 35 connected to the other end of the connecting rod 34 is formed of an elastic material having no permeability, or a low permeability, to gas, such as butyl rubber and fluororubber, and in a spherical shape. An outer circumference of the elastic support member 35 is fixed to the sub tank 31 to be supported thereby. The end of the connecting rod 34 that extends through a hole formed in an upper wall of the sub tank 31 is connected, for instance bonded with an adhesive, to a central portion of a surface of the elastic support member 35 which is opposed to the sub tank 31. Thus, it can be said that an internal space of the sub tank 31 where the ink 36 is stored is partially defined by the elastic support member 35.

With the end of the connecting rod 34 connected to the elastic support member 35, the positively pressurizing portion 39 is held stationary in the sub tank 31 in a state as shown in FIGS. 4A and 4B while a downward load is not imposed on the elastic support member 35. When a downward load is imposed on the elastic support member 35 from the upper side, the elastic support member 35 is elastically flattened or depressed, namely, deformed into the internal space of the sub tank 31, thereby pushing down the connecting rod 34 and accordingly the mesh pressurizing member 32, toward the upper surface of the sub tank 31 or to the downstream side with respect to the ink communication passage.

When the load imposed on the elastic support member 35 is removed to place the elastic support member 35 in a free state, the elastic support member 35 having been depressed is restored to its original shape by its own resiliency. The mesh pressurizing member 32 having been displaced to the downstream side is accordingly moved to the upstream side and back to its original position. The original position of the mesh pressurizing member 32 is where the mesh pressurizing member 32 is located under an ink surface while the downward load is not imposed and the positively pressurizing portion 39 is stationary A combination of the elastic support member 35 and the connecting member 38 corresponds to a biasing device.

<Flow of the Purging Operation>

Figure 6:
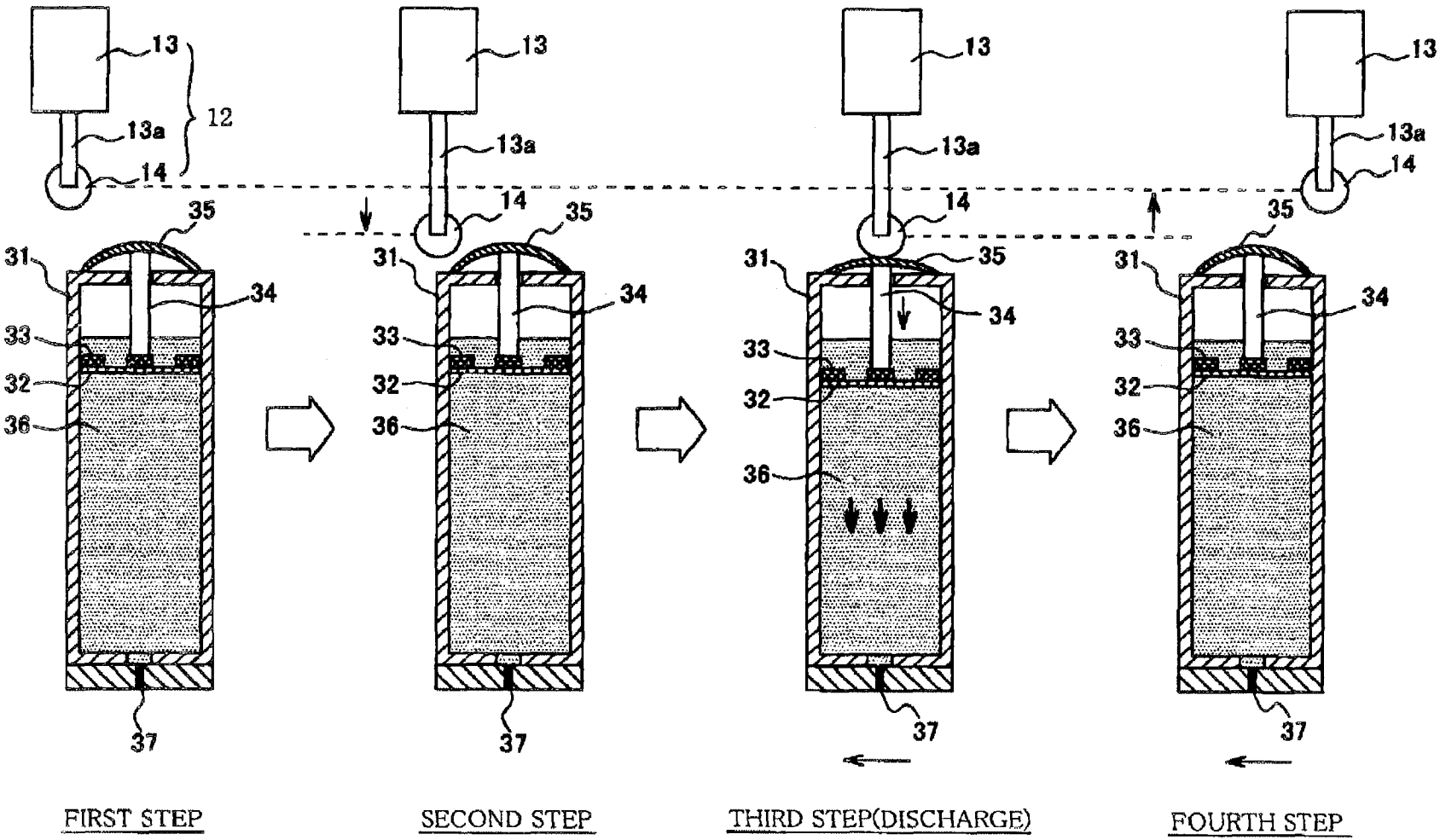
FIG. 6 illustrates a process of restoring an ink ejection performance of a recording head, as performed for one of four sub tank units in the head unit.

A process of the positive-pressure purging operation in the inkjet recording apparatus 7 will be described, by referring to FIG. 6. As shown in FIG. 6, in a first step before the purging is initiated, the presser roller 14 of the pushing device 12 is located at a lateral position that is a pushing position within the standby area, and at a vertical position corresponding to a retracted position above a top end surface of the elastic support member 35, and the mesh pressurizing member 32 is at the original position. The original position is the position illustrated in FIGS. 4A and 4B.

In a second step after initiation of the purging, the roller-shaft driving portion 13 operates to extend the roller shaft 13*a* downward to locate the presser roller 14 at a level or a vertical position close to the sub tank 31, and holds the presser roller 14 there. The vertical position of the presser roller 14 as the roller-shaft driving portion 13 is lowered and the roller shaft 13*a* is fixed in position in the second step, that is, the level of the presser roller 14 in the second and third steps of FIG. 6, corresponds to an operating position.

In the third step, as the carriage 4 holding the head unit 11 moves toward the recording area, the elastic support member 35 disposed in the upper portion of the sub tank 31 approaches the presser roller 14 to be finally brought into contact therewith. As the carriage 4 further moves laterally, that is, as the sub tank 31 moves leftward as seen in FIG. 6, the elastic support member 35 in contact with the pressure roller 14 receives a load from the presser roller 14 to be elastically flattened or deformed into the internal space of the sub tank 31, thereby pushing down the connecting rod 34 and in turn pushing the mesh pressurizing member 32 to the downstream side.

Here, the moving speed of the mesh pressurizing member 32 depends on a velocity of the carriage 4. The velocity of the carriage 4 is determined so that a pressure necessary to discharge the ink 36 from the nozzles 37 is applied to a portion of the ink communication passage on the downstream side of the mesh pressurizing member 32 when the mesh pressurizing member 32 is pushed to the downstream side. More specifically, the velocity of the carriage 4 is determined based on the number, the cross-sectional area, and positions of the ink passages 32*a* of the mesh pressurizing member 32, while taking account of the fact that in order to sufficiently pressurize the downstream portion of the ink communication passage with respect to the mesh pressurizing member 32, a certain degree of resistance should be given to the ink flow in the reverse direction (from the downstream side to the upstream side of the mesh pressurizing member 32) at the ink passages 32*a* when the mesh pressurizing member 32 is moved to the downstream side, by making sufficiently high the speed of the movement of the mesh pressurizing member 32, which is determined based on the velocity of the carriage. In other words, the velocity of the head unit when the head unit is laterally moved to depresses the elastic support member, which velocity determines a speed at which the elastic support member deforms, needs to be higher than a value that ensures a minimum required value of a pressure applied to the ink, below which the fluid in the sub tank can not be sufficiently pressurized and the ink discharge from the recording head is disabled.

Thus, as the carriage 4 moves, the elastic support member 35 elastically deforms to push the connecting rod 34 downward so that the connecting member 38 in turn pushes the mesh pressurizing member 32 downward. When the pressurizing member 32 as receiving the pushing or pressing force from the connecting member 38 moves to the downstream side while directly pressurizing the ink 36, the ink 36 flows from the downstream side of the mesh pressurizing member 32 to the upstream side thereof through the ink passages 32*a*. However, a resistance to the ink flow in such a direction is given at the ink passages 32*a*, and thus the ink 36 can be pushed or pressurized toward the downstream side of the mesh pressurizing member 32. This pressurizing action forcibly discharges the inks and others to the exterior through the nozzles 37 of the recording head 69. In this way, an ejection performance restoring function or the positive-pressure purging operation is realized.

As briefly mentioned above, the material forming the elastic support member 35 is preferably an elastic material having no permeability; or a low permeability, to gas. This is in order that the ink in the sub tank 31 does not deteriorate or change its properties due to influence of the atmosphere. That is, drying of the ink, introduction of the atmospheric air into the ink, and other inconveniences are prevented. Although there is stored an amount of the air in the sub tank 31, an adverse influence of the air on the ink is negligibly small when the sub tank is air-tightly closed.

In a fourth step after the purging, the carriage 4 further moves so that the presser roller 14 finally separates from the elastic support member 35, and then the presser roller 14 is returned to the original or retracted position at which the presser roller 14 was placed in the first step. Thus, the load that has been imposed by the presser roller 14 on the elastic support member 35 in order to depress the elastic support member 35 is removed, thereby placing the elastic support member in the free state so as to return the elastic support member to its original shape that is the shape taken in the first step. This restoring force or the resiliency of the elastic support member serves as a biasing force to lift the connecting rod 34 so as to return the mesh pressurizing member, 32 to its original position. Thus, as the elastic support member 35 restores to its original shape, the mesh pressurizing member 32 returns to the original position.

When this returning or lifting of the mesh pressurizing member 32 is abruptly made, a negative pressure may occur on the downstream side of the mesh pressurizing member 32 at such a level as to break meniscuses of the ink formed in the nozzles 37, depending on a speed at which the lifting is made. Hence, according to this embodiment, the material, shape, and other: properties of the elastic support member 35 are selected so that the mesh pressurizing member 32 is lifted at a speed that maintains the meniscuses at the nozzles 37. That is, the elastic support member 35 biases the connecting rod 34 and accordingly the mesh pressurizing member 32 such that the meniscuses in the nozzles 37 are maintained even with the negative pressure produced on the downstream side of the mesh pressurizing member 32 upon lifting of the mesh pressurizing member.

There have been described, with reference to FIGS. 4-6, the structure of the sub tank 31 storing the black ink 36, and the purging operation performed at the sub tank 31. The structure of the other three sub tanks 41, 51, 61 and the purging operation performed thereat are identical with those of the sub tank 31, except the colors of the inks stored in the sub tanks 41, 51, 61.

More specifically, as shown in FIG. 4A, the sub tank 41 storing the cyan ink 46 includes a mesh pressurizing member 42, a connecting member including a connecting shaft 44 and a support plate 43, and an elastic support member 45 connected to an end of the connecting shaft 44. The sub tank 51 storing the yellow ink 56 includes a mesh pressurizing member 52, a connecting member including a connecting shaft 54 and a support plate 53, and an elastic support member 55 connected to an end of the connecting shaft 54. The sub tank 61 storing the magenta ink 66 includes a mesh pressurizing member 62, a connecting member including a connecting shaft 64 and a support plate 53, and an elastic support member 65 connected to an end of the connecting shaft 64.

Although not shown, the sub tanks 41, 51, 61 are connected to ink cartridges accommodating the inks of the respective colors via the ink supply tubes, so that the inks are supplied from the ink cartridges into the sub tanks 41, 51, 61.

<Purging Operation>

Figure 7:
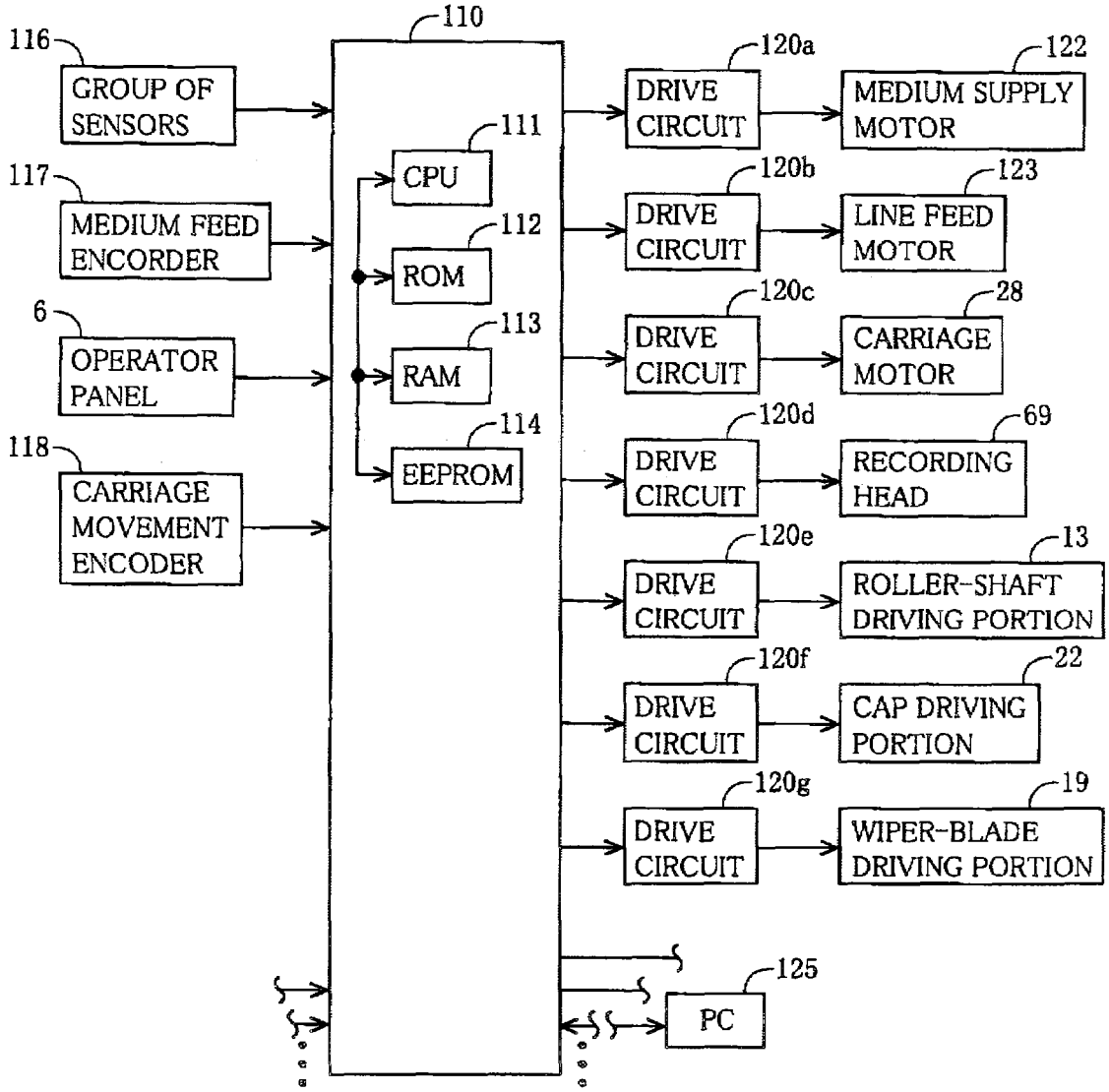
FIG. 7 is a block diagram of a controller that controls an operation of the recording apparatus.

There will be now described an electrical structure of the inkjet recording apparatus 7, by referring to a block diagram of FIG. 7. As shown in FIG. 7, the inkjet recording apparatus 7 includes a controller having a CPU 111, a ROM 112, a RAM 113 and an EEPROM 114.

The controller 110 is electrically connected to a group 116 of sensors 116 including a medium sensor and a register sensor that are well known in the art, a medium feed encoder 117, the operator panel 6, a carriage movement encoder 118, and others. The medium sensor detects presence/non-presence of the recording medium 20, and the register sensor detects a leading end, a rear end, a lateral end, for instance, of the recording medium 20. The medium feed encoder 117 detects an amount of feeding, or the position, of the recording medium 20.

Further, the controller 110 is electrically connected to drive circuits 120*a*-120*g* respectively for driving the medium supply motor 122, the line feed motor 123, the carriage motor 28, the recording head 69, the roller-shaft driving portion 13, the cap driving portion 22, and the wiper-blade driving portion 19. The drive circuit 120*d* drives the recording head 69 to eject ink droplets therefrom, by applying a voltage to driving elements or active portions of the recording head 69, that correspond to first pressure-feed portions.

The CPU 111 controls the drive circuits 120*a*-120*g* according to various programs stored in the ROM 112 and the EEPROM 114, to drive and control the elements or devices 122, 123, 28, 69, 13, 22, 19. The medium supply motor 122 is operated to rotate the pickup roller 8 as described above, and the line feed motor 123 is operated to rotate the feeder roller 7*a*.

The controller 110 is connected to a personal computer (hereinafter referred to as "PC") 125 and capable of communication therewith. The PC sends the controller 110 an instruction to implement known recording processing for recording an image on the recording medium 20, along with image data representative of the image. Upon receiving the instruction and the image data, the controller 110 operates to implement the recording processing. During the recording processing is implemented, the purging operation is performed as needed. A portion of the controller 110 that implements the purging operation and stores data necessary for the purging operation corresponds to an association controller.

There will be described the recording processing, by referring to FIG. 8 which is a flowchart illustrating a program of the recording processing executed by the CPU 111. In the multifunction apparatus 1, the recording processing program is executed each time image recording is performed. More specifically, the CPU 111 reads out the recording processing program from the ROM 112 and executes the recording processing program, at the timing when recording of an image on the recording medium 20 becomes necessary, such as when the instruction to implement the recording processing is received from the PC 125, when facsimile data is received, or when a recording operation is desired while the copy function of the multifunction apparatus 1 is active.

The recording processing program is initiated with step S110 to operate the cap driving portion 22 to separate the cap 21 away from the recording head 69. The flow then goes to step S120 to determine whether it is the timing for performing the purging operation. For instance, this determination may be made based on whether a predetermined time has elapsed from the last performed recording processing. When it is not the timing for performing the purging operation, that is, when a negative decision (NO) is made in step S120, the flow goes to step S200 to implement the image recording. That is, the image recording is initiated without implementing the purging operation On the other hand, when it is the timing for performing the restoring operation, that is, when an affirmative decision (YES) is made in step S120, the flow goes to step S130 to lower the presser roller 14. That is, the pushing device 12 is placed in the state of the second step shown in FIG. 6. The flow then goes to step S140 to determine whether a "purging pressure" is set at HIGH or LOW. It may be configured such that an initial setting of the purging pressure is one of HIGH and LOW and the user can change the initial setting through manipulation of the operator panel 6, or alternatively such that the controller 110 automatically selects and sets one of HIGH and LOW based on the time that has elapsed from the last performed recording processing. In the latter case, it may be configured such that when the elapsed time is larger than a threshold, the purging pressure is set at HIGH, and when the elapsed time is not larger than the threshold, the purging pressure is set at LOW.

When it is determined that the purging pressure is set at HIGH in step S140, the flow goes to step S150 to laterally move the carriage 4 at a velocity a toward the recording area, thereby performing the positive-pressure purging. On the other hand, when it is determined that the purging pressure is set at LOW in step S140, the flow goes to step S160 to laterally move the carriage 4 at velocity b that is smaller than a (a>b), toward the recording area, thereby performing the positive-pressure purging. That is, when the purging pressure is set at HIGH, the velocity of the carriage 4 is made high to increase the pressure applied to the ink on the downstream side of the mesh pressurizing member 32, 42, 52, 62 so as to powerfully discharge the ink from the nozzles. When the purging pressure is set at LOW, on the other hand, the velocity of the carriage 4 is made relatively low to decrease the pressure applied to the ink on the downstream side of the mesh pressurizing member 32, 42, 52, 62 so as to gently discharge the ink.

Thus, the velocity, at which the carriage 4 holding the head unit 11 laterally moves so as to elastically deform the elastic support member 35 by contact with the presser roller 14, is selectable between a and b.

Figure 9:
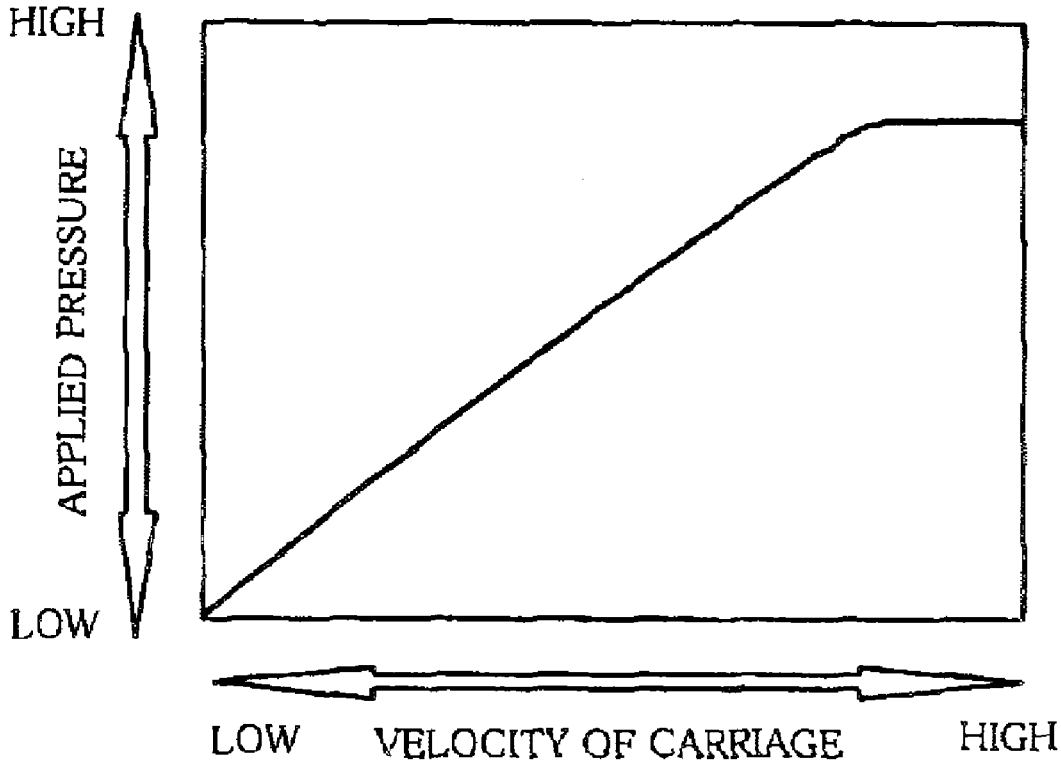
FIG. 9 represents velocity of a carriage of the recording apparatus as plotted against applied pressure.

FIG. 9 represents the velocity of the carriage 4 as plotted against the pressure applied to the ink on the downstream side of the mesh pressurizing member 32. As can be seen from FIG. 9, the applied pressure increases with the velocity of the carriage 4 (although the applied pressure saturates when the velocity reaches a certain value). Hence, the applied pressure and accordingly the amount of the discharged ink become larger when the velocity of the carriage is set at a, namely, when the purging pressure is set at HIGH, than when the velocity of the carriage is b (b<a), namely, when the purging pressure is set at LOW.

After the purging has been performed for all of the four sub tanks 31, 41, 51, 61 in step S150 or S160, the flow goes to step S170 to perform the wiping operation as mentioned above. Then, in the following step S180, the presser roller 14 is returned to the original, retracted position. The flow then goes to step S190 to move the carriage 4 to the home position in order to have the recording head 69 opposed to the cap 16. Then, the above-mentioned flashing operation is performed.

After the purging operation and the accompanying wiping and flashing operations have been performed, the flow goes to step S200 to perform the image recording. When the image recording is terminated, the carriage 4 returns to the home position, and the recording head 69 is again covered with the cap 21 in step S210, and the execution of the program of this cycle is terminated.

Effects of the First Embodiment

According to the inkjet recording apparatus 7 described above, the purging operation is realized such that the internal space of the sub tank 31, 41, 51, 61 is partially defined by the elastic support member 35, 45, 55, 65 and a head-unit moving mechanism that includes the carriage motor 28 and the carriage 4 and is essentially disposed in the recording apparatus 7 to reciprocate the head unit 11, is utilized to elastically deform the elastic support member 35, 45, 55, 65 by bringing the elastic support member into contact with the presser roller 14 as the head unit 11 is laterally moved, thereby displacing the mesh pressurizing member 32 to the downstream side via the connecting member 38. With the mesh pressurizing member 32 thus displaced, the ink on the downstream side of the mesh pressurizing member 38 is directly pressure-fed to be discharged from the nozzles 37.

Thus, there is reduced the number of members required for the purging operation that conventionally include an air pressure pump and a drive source for the pump and a drive link mechanism. In this way, the positive-pressure purging operation is enabled with a simple structure and without requiring the user to manually operate any operating members.

In other words, the displacement of the mesh pressurizing member 32 to the downstream side, or the application of the load to the elastic support member 35, is realized by utilizing a mechanism to laterally moving the carriage that is essentially disposed in any inkjet recording apparatus of the present kind, such that the elastic support member 35 is brought into contact with the presser roller 14 to be flattened or deformed downward while the carriage 4 is laterally moved. That is, the kinetic energy of the head unit is utilized to implement the purging operation. Hence, any special mechanism for pressing the elastic support member 35 is not required, but merely it is required that the presser roller 14 is vertically movable as needed, and thus the structure of a mechanism for deforming or driving the elastic support member is simplified.

The purging operation where the ink 36, 46, 56, 66 in the sub tank 31, 41, 51, 61 is directly pressurized is realized with the simple structure that the mesh pressurizing member 32, 42, 52, 62 is displaced via the connecting member 38, 48, 58, 68 to the downstream side with respect to the ink communication passage. This reduces the pressure loss and the waste of the ink in the purging operation, as well as enhances the efficiency and reliability of the ink discharge. The mesh pressurizing member 32, 42, 52, 62 has a plurality of the ink passages 32*a* and the ink 36, 46, 56, 66 can be kept supplied to the recording head 69 via the ink passages 32*a* even during recording on the recording medium is performed. When the mesh pressurizing member 32, 42, 52, 62 is returned to the original position or displaced to the upper stream side after the purging operation, the ink passages 32*a* allow flow of the ink 36 across the mesh pressurizing member 32, namely, the ink flow from the upstream side of the mesh pressurizing member 32 to the downstream side thereof, thereby preventing the flow of the ink in the reverse direction, i.e., from the nozzles 37.

The end of the connecting rod 34, 44, 54, 64 is connected to the elastic support member 35, 45, 55, 65 to be held thereby, and in the purging operation this elastic support member 35, 45, 55, 65 elastically deforms downward by receiving an external force, thereby displacing the mesh pressurizing member 32 to the downstream side. When the external force imposed on the elastic support member 35, 45, 55, 65 is removed after the purging, the elastic support-member 35, 45, 55, 65 restores to its original shape by its own resiliency, thereby applying a biasing force to the mesh pressurizing member 32, 42, 52, 62 that thus returns to its original position. In this way, with a simple structure and without requiring the user to manually operate any operating members, the mesh pressurizing member 32, 42, 52, 62 can be held, and returned to its original position after pushed downward. That is, the displacement of the pressurizing member to the downstream side and the restoration of the same member to the original position are automatically implemented. In this relation, it is noted that the operation of the connecting member to displace the pressurizing member to the downstream side to perform the purging, and then return the pressurizing member to the original position, can be manually made by the user. However, the manual operation of the connecting member by the user causes various inconveniences, such as occurrence of a variation in the amount of the ink discharged from the recording head in the purging, a possibility of insufficient restoration of the ink ejection performance, and such an operation being troublesome to the user. Hence, the arrangement of the embodiment where the elastic support member and the connecting member that constitute a biasing device cooperate to naturally return the pressurizing member to the original position after the purging is performed, even where the pressurizing member is manually operated, is preferable.

In the mesh pressurizing member 32, the ink passages 32*a* having the same shape and cross-sectional area are arranged regularly over the entire area of the mesh pressurizing member 32, in the form of a mesh. Thus, the resistances of the respective ink passages 32*a* to the upward flow of the ink 36 generated when the mesh pressurizing member 32 is displaced to the downstream side are uniform over the entire area of the mesh pressurizing member 32, thereby pressurizing the ink 36 downstream of the mesh pressurizing member 32 uniformly across the entire area thereof. Hence, pressurizing the downstream side in a balanced manner is enabled, thereby enhancing the efficiency of the restoring operation.

The elastic support member 35 elastically deforms by contacting the presser roller and receiving the load therefrom, and the direction of the lateral movement of the elastic support member 35 is substantially the same as the direction of rotation of the presser roller 14. When the elastic support member 35 laterally moves in contact with the presser roller 14, the presser roller 14 is rotated by a load in the direction of its rotation received from the elastic support member 35, Thus, the durability of both the presser roller 14 and the elastic support member 35 is enhanced.

Only when it is the timing for performing the restoring operation, the presser roller 14 is lowered to perform the restoring operation, and when it is not such timing, the presser roller 14 is held at its retracted position so that the elastic support member 35 does not contact the presser roller 14. Thus, the restoring operation is not performed every time the head unit 11 passes under the presser roller 14, that is, the restoring operation is not performed unless it is the timing for performing the restoring operation. This prevents waste of the ink, and enhances the efficiency of the restoring operation.

Depending on the velocity of the head unit 11, the purging pressure in the restoring operation can be determined, namely, selected between HIGH and LOW, that is, the amount of the ink to be discharged in the restoring operation is selected between two values. Hence, the restoring operation can be performed with the amount of the elastic deformation of the elastic support member 35, or the pressurizing force, that is suitable for the current state of the nozzles, thereby enabling to enhance the efficiency of the restoring operation.

Second Embodiment

Figure 10:
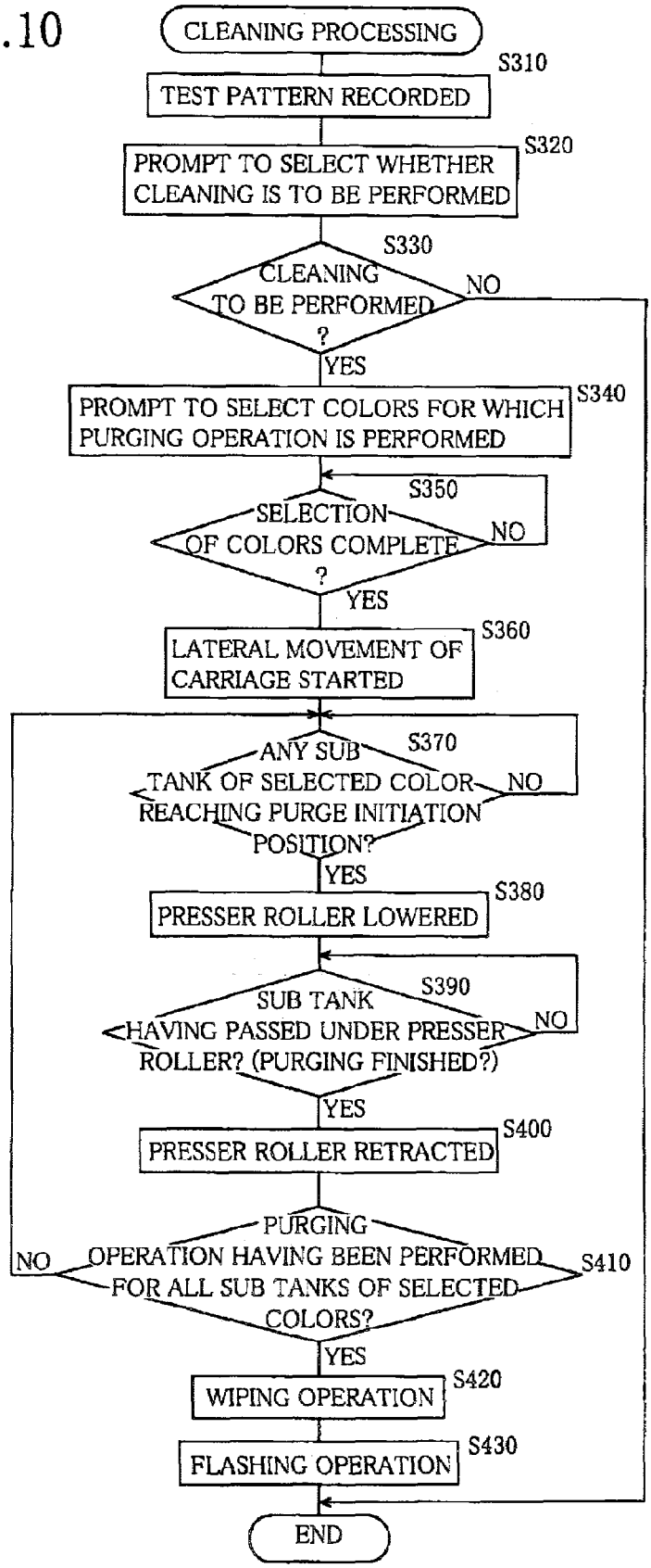
FIG. 10 is a flowchart illustrating a program according to which a recording apparatus according to a second embodiment of the invention performs a cleaning.

There will be now described an inkjet recording apparatus according to a second embodiment of the invention, by referring to FIG. 10.

Figure 8:
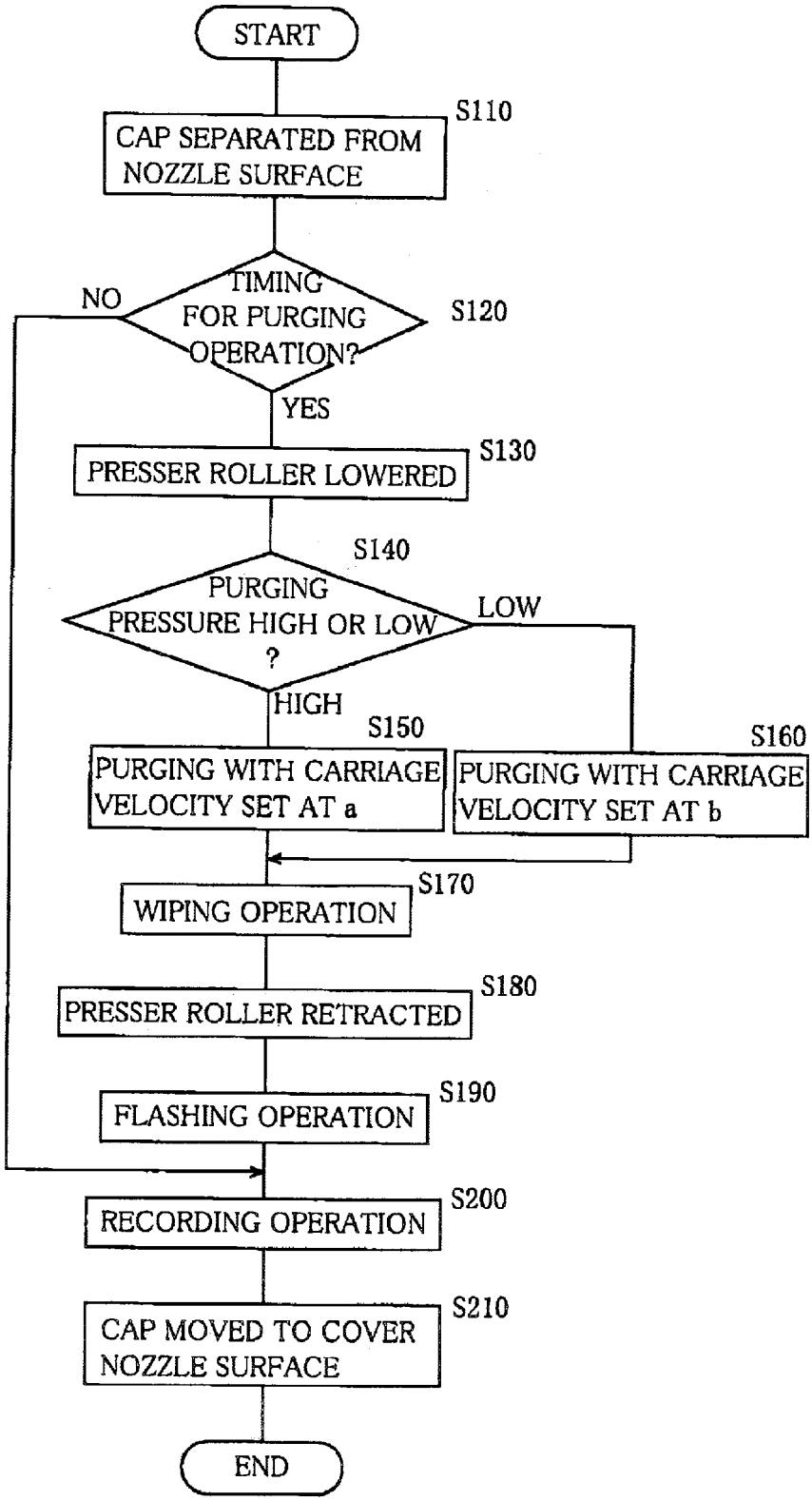
FIG. 8 is a flowchart illustrating a program according to which the recording apparatus performs a recording operation.

In the first embodiment, as described with respect to the recording processing shown in FIG. 8, when the purging operation is performed at the relevant timing, once, the presser roller 14 is lowered down to the predetermined pressing position, the presser roller is held at this pressing position until all the four sub tanks 31, 41, 51, 61 have passed under the presser roller 14 and thus the purging has been performed for all the sub tanks 31, 41, 51, 61, and thereafter the presser roller 14 is returned to the retracted position.

On the other hand, according to the second embodiment, it is selectable whether the presser roller 14 is to be lowered to the pressing position, for each of the sub tanks 31, 41, 51, 61. Except this feature, the second embodiment is identical with the first embodiment, and thus the corresponding elements or parts will be denoted by the same reference numerals and description thereof is dispensed with. The different part from the first embodiment, which relates to the contents of the processing implemented during the purging operation, will be described with reference to FIG. 10.

FIG. 10 is a flowchart illustrating a program of cleaning processing according to the present embodiment, which includes a purging operation. In the cleaning processing, the state of a recording head 69 is first checked by the user, and the purging operation is initiated only when the user desires to have the purging operation performed and makes a relevant input as predetermined through an operator panel 6.

More specifically, the cleaning processing program is initiated with step S310, in which a test pattern is recorded on a recording medium 20, namely, a predetermined pattern is recorded by ejecting droplets of inks of respective colors from the recording head 69 while the carriage 4 is laterally moved. After the test pattern is recorded, the user is prompted to select whether the cleaning processing is to be implemented, in step S320. This prompting may be made, for instance, such that an appropriate message is presented on the operator panel 6, or on a display device (not shown) of an information processing apparatus of a personal computer or others connected to a multifunction apparatus 1 including the inkjet recording apparatus 7.

The user sees the recorded test pattern and determines whether the cleaning processing is necessary for the recording head 69, that is, whether the positive-pressure purging operation is to be performed. When the test pattern appears normal and the user determines that cleaning is unnecessary, the user makes an input indicating this determination through the operator panel 6 or the above-mentioned information processing apparatus, that is, a negative decision (NO) is made in step S330, and the execution of the cleaning processing program of this cycle is terminated.

On the other hand, when the recorded test pattern appears abnormal and the user determines that cleaning is necessary, the user makes an input indicating this determination through the operator panel 6 or the information processing apparatus, an affirmative decision (YES) is made in step S330 and the flow goes to step S340 in which the user is prompted to select the color(s) of the ink(s) for which the purging should be performed. This prompting may also be made by presenting an appropriate message on the operator panel 6 or the information processing apparatus, for instance.

When the user has selected and inputted the color(s) for which the purging should be performed, an affirmative decision (YES) is made in step S350, and the flow goes to step S360 to start laterally moving the carriage 4 and accordingly the sub tanks 31, 41, 51, 61. In the subsequent step S370, it is determined whether any sub tank storing the ink of the selected color has reached a predetermined position that is located to the right (as seen in FIG. 3) of a purge initiation position at which the elastic support member 35 of that sub tank, is brought into contact with the presser roller 14. This determination, and the determination made in step S390 described later, are made based on the position of the carriage 4 as detected by a carriage movement encoder 118.

When the sub tank storing the ink of the selected color reaches the purge initiation position, that is, when an affirmative decision (YES) is made in step S370, the flow goes to step S380 to lower the presser roller 14 to a pressing position (S380), thus arranging for the purging for that sub tank.

Then, as the carriage 4 continues to laterally move, the elastic support member 35 of the sub tank storing the ink of the selected color is finally brought into contact with the presser roller 14 and thus elastically deforms. This deformation pushes the mesh pressurizing member 32 downward to the downstream side with respect to the ink communication passage, and the ink is discharged from the nozzles corresponding to that sub tank, thereby accomplishing the purging.

When the purging terminates and the elastic support member separates from the presser roller 14, that is, when an affirmative decision (YES) is made in step S390, the flow goes to step S400 to return the presser roller 14 to its retracted position. Then, the flow goes to step S410 to determine whether the purging has been performed for all the sub tanks storing the inks of the selected colors. When the purging has not been performed for all those sub tanks yet, the flow returns to step S370 to repeat steps S370-S410. On the other hand, when the restoring operation has been performed for all the sub tanks of the selected colors, the flow goes to step S420 to perform a wiping operation and then to step S430 to perform a flashing operation, and the cleaning processing of this cycle terminates. The wiping and flashing operations are those as have been described above with respect to the first embodiment. After the flashing operation, the recording head 69 is covered by the cap 21.

Where cyan and yellow are selected as the colors for which the restoring operation should be performed, when the sub tank 31 storing a black ink approaches the presser roller 14, as the carnage 4 laterally moves, the first among all the sub tanks 31-61, the presser roller 14 is not lowered but held at the retracted position.

When the next sub, tank 41 storing a cyan ink with the elastic support member 45 reaches the purge initiation position, that is, when an affirmative decision (YES) is made in step S370, the presser roller 14 is lowered, thereby having the elastic support member 45 and the presser roller 14 in contact with each other as the carriage 4 laterally moves. The elastic support member 45 thus receives a load and elastically deforms, with the mesh pressurizing member 42 displaced to the downstream side in the ink communication passage. Consequently, the cyan ink is discharged from the nozzles 47, thereby accomplishing the purging.

Thereafter, the presser roller 14 is once returned to the retracted position in step S400, but when the sub tank 51 storing an yellow ink and having an elastic support member 55 reaches the purge initiation position, that is, when an affirmative decision (YES) is made in step S370, the presser roller 14 is again lowered, and the purging is performed in the same way as with the sub tank 41 storing the cyan ink. Then, since the purging has been performed for all the selected colors, the presser roller 14 is returned to the retracted position.

According to the second embodiment, while the plurality of sub tanks 31, 41, 51, 61, that are arranged along the direction of the lateral movement of the carriage 4 holding the head unit 11, sequentially passes under the presser roller 14, the presser roller 14 is lowered to the pressing position only when the sub tank(s) for which the purging should be performed passes under the presser roller, and the presser roller 14 is placed at the retracted position when the other sub tank(s) not requiring the purging passes under the presser roller 14, thereby enabling to prevent waste of the ink and efficiently perform the purging depending as needed.

A portion of the controller 110 that implements the selection of the sub tank units for which the purging is to be performed, namely, the portion for executing relevant steps in the program of FIG. 10, corresponds to a determining portion.

In the cleaning processing according to the second embodiment, the sub tank storing the inks of respective colors are divided into a group requiring the purging and another group not requiring the purging, so that the purging is selectively performed. This arrangement is not limitedly applied to the cleaning processing, but may be applied to the recording processing according to the first embodiment as illustrated in FIG. 8. That is, when the purging operation is performed at the relevant timing, the purging is actually performed only for the sub tank(s) requiring the purging, namely, the presser roller 14 is lowered only when those sub tank(s) requiring the purging passes thereunder. The categorizing between the sub tanks requiring the purging and the sub tanks not requiring the purging is made, for instance, such that the inkjet recording apparatus 7 automatically determines the frequency of ink use for the respective sub tanks, and only the sub tank(s) of the inks used at low frequency is/are subjected to the purging, or alternatively such that the user is prompted to select whether the purging is to be performed for each of the sub tanks before the purging operation is initiated.

Third Embodiment

In the first embodiment, as described above with respect to the recording processing illustrated in FIG. 8, when the purging is performed at the timing for that operation, the velocity of the carriage 4 is selectively set at a or b to adjust the amount of the ink to be discharged.

In the present embodiment, on the other hand, the pressure applied upon the positive-pressure purging, and accordingly the amount of the discharged ink is made adjustable, by selecting whether the presser roller 14 brought into contact with the elastic support member of the sub tank is thereafter held in the contacting state until the presser roller 14 naturally separates from the elastic support member as the sub tank holding the head unit 11 laterally moves, or the presser roller 14 is retracted to the retracted position before the presser roller 14 naturally separates from the elastic support member as the sub tank laterally moves and while the elastic support member 35 is being elastically deformed by contact with the presser roller 14. Except this feature, the third embodiment is identical with the first embodiment, and thus the corresponding elements or parts will be denoted by the same reference numerals and description thereof is dispensed with. The different part from the first embodiment, which relates to the contents of the purging operation will be described with reference to FIGS. 11-14.

Figure 11:
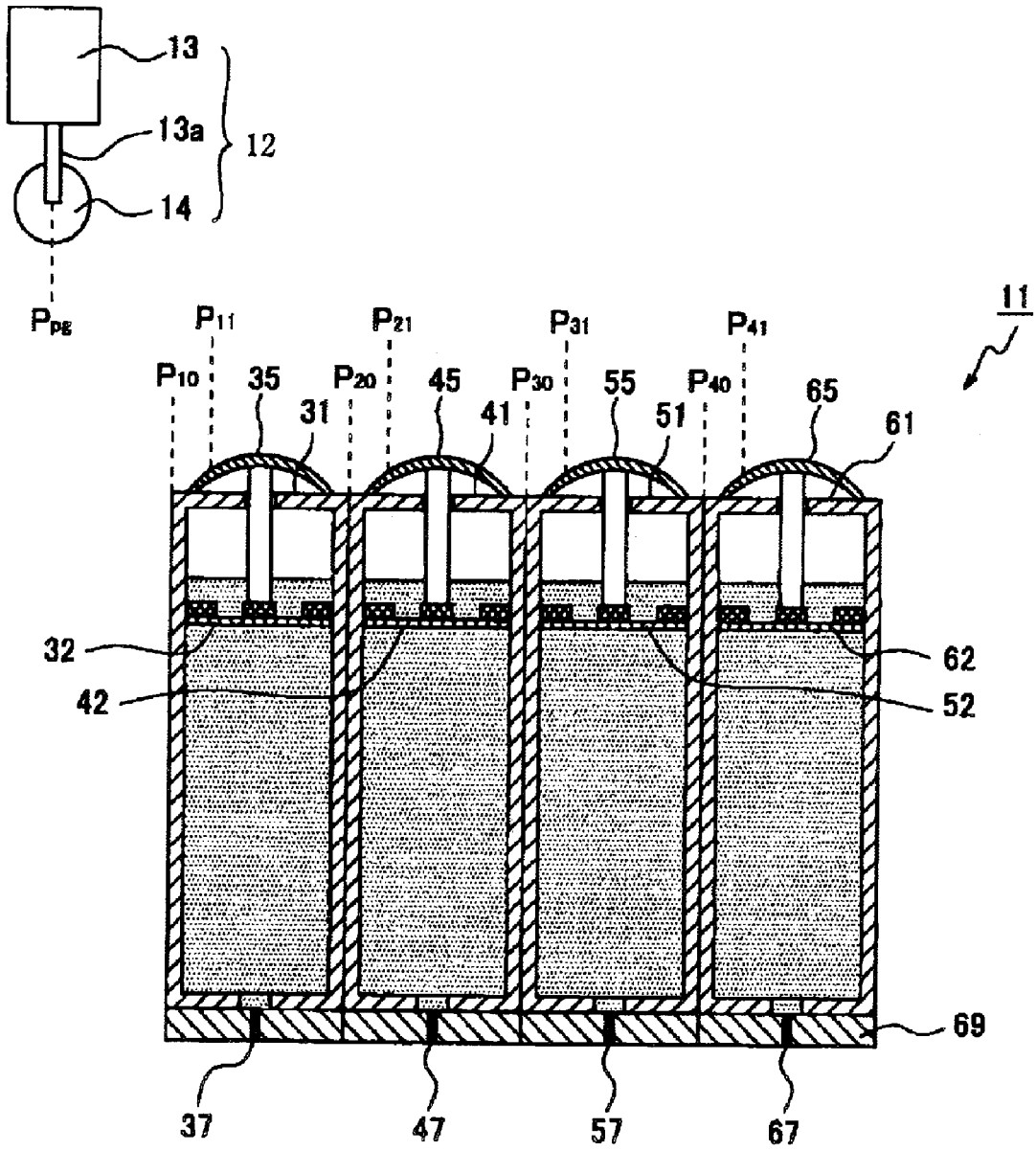
FIG. 11 illustrates a positional relationship between a head unit and a presser roller in a recording apparatus according to a third embodiment of the invention.

FIG. 11 illustrates a positional relationship between a head unit 11 and a presser roller 14 according to the third embodiment. In the third embodiment, a purging pressure applied in a positive-pressure purging operation is selectable between HIGH and LOW, like in the first embodiment. That is, when the purging pressure, is set at HIGH, the presser roller 14 is lowered to the pressing position and held thereat until all the elastic support members 35, 45, 55, 65 have passed under the presser roller 14.

On the other hand, when the purging pressure is set at LOW, the presser roller 14 brought into contact with the elastic support member 35, 45, 55, 65 is returned to the retracted position after the elastic support member 35, 45, 55, 65 (or the head unit 11) has been laterally moved by a predetermined distance and before the presser roller 14 naturally separates from the elastic support member 35, 45, 55, 65, as the elastic support member 35, 45, 55, 65 is being kept laterally moved. More specifically, as shown in FIG. 11, when a lateral end position P10 in the sub tank 31 reaches or coincides with a position Ppg of the presser roller 14 in the lateral direction, as the head unit 11 moves in the direction to approach the presser roller 14, i.e., leftward as seen in FIG. 11, the presser roller 14 is lowered. When a stop position P11 in the sub tank 31 coincides with the position Ppg of the presser roller 14 as the head unit 11 further moves, the presser roller 14 is returned to the retracted position while the elastic support member 35 is still being elastically deformed by contact with the presser roller 14.

Thereafter, the presser roll 14 is again lowered when its position Ppg coincides with a lateral end position P20 in a sub tank 41, and returned to the retracted position when the position Ppg coincides with a stop position P21 in the sub tank 41, in the similar way as with the sub tank 31. Then, the same operation is repeated for the sub tanks 51 and 61. Namely, presser roll 14 is lowered when the position Ppg coincides with a lateral end position P30 in a sub tank 51 and returned to the retracted position when the position Ppg coincides with a stop position P31 in the sub tank 51, and then lowered when the position Ppg coincides with a lateral end position P40 in a sub tank 61 and returned to the retracted position the position Ppg coincides with a stop position P41 in the sub tank 61. In this way, the presser roller 14 that is normally (that is, when the purging is not performed) held in the retracted position repeatedly moves to and from the pressing position.

Figure 12A:
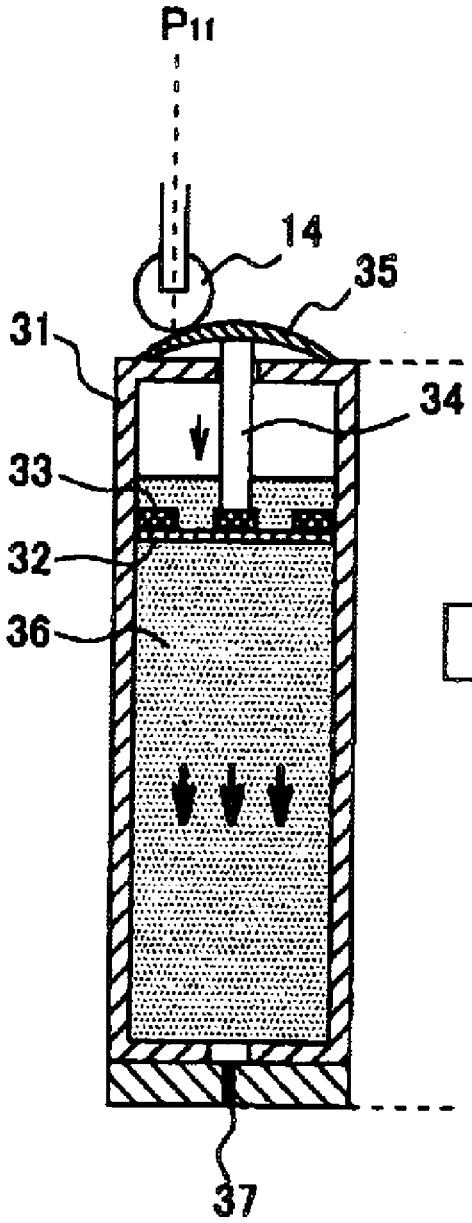
FIGS. 12A and 12B illustrate how elastic deformation of an elastic support member varies depending on the relative position between the elastic support member and the presser roller.
Figure 12B:
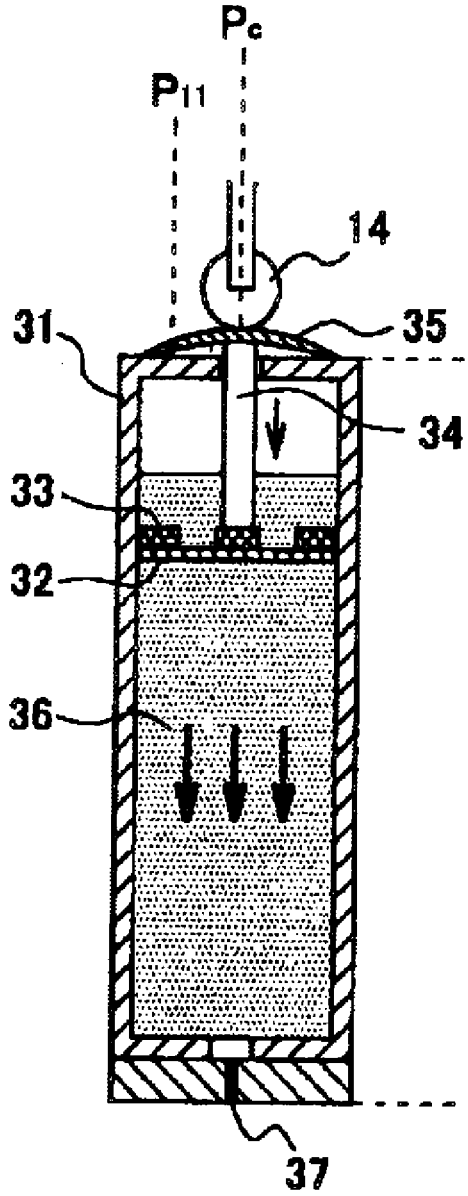

The state where the stop position P11 in the sub tank 31 coincides with the position Ppg of the presser roller 14 is shown in FIG. 12A. FIG. 12B shows the state where a center position Pc of the sub tank 31 (that corresponds to a top position of the elastic support member 35) reaches or coincides with the position Ppg of the presser roller 14.

As shown in FIGS. 11 and 12, when the stop position P11 reaches or coincides with the position Ppg of the presser roller 14 (a first time point), the elastic support member 35 is being elastically deformed by the presser roller 14 to some degree. However, at a second time point when the position Ppg of the presser roller 14 coincides with the center position Pc, the elastic support member 35 is being elastically deformed toward the internal space of the sub tank 31 more greatly than at the first time point.

That is, when the purging pressure is set at HIGH, the presser roller 14 is held at the lowered position or the pressing position until all the elastic support members 35, 45, 55, 65 have completely passed thereunder, so that each of the elastic support members 35, 45, 55, 65 sufficiently deforms as shown in FIG. 12B. On the other hand, when the purging pressure is set at LOW, the presser roller 14 is returned to the retracted position each time the stop position P11, P21, P31, P41 (corresponding to an operation terminating position) in the elastic support member 31, 41, 51, 61 coincides with the position Ppg of the presser roller 14, so that the amount of the elastic deformation of the elastic support member 35, 45, 55, 65 is relatively small.

Figure 13:
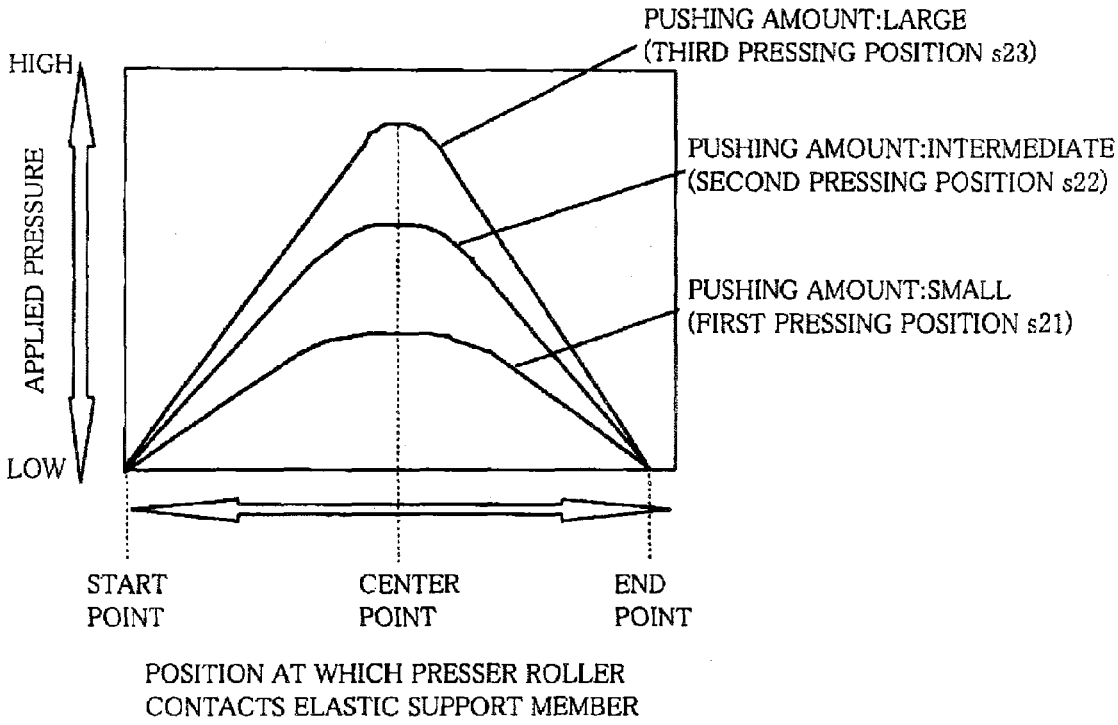
FIG. 13 represents vertical position of the presser roller at which the presser roller contacts the elastic support member, as plotted against applied pressure.
Figure 14:
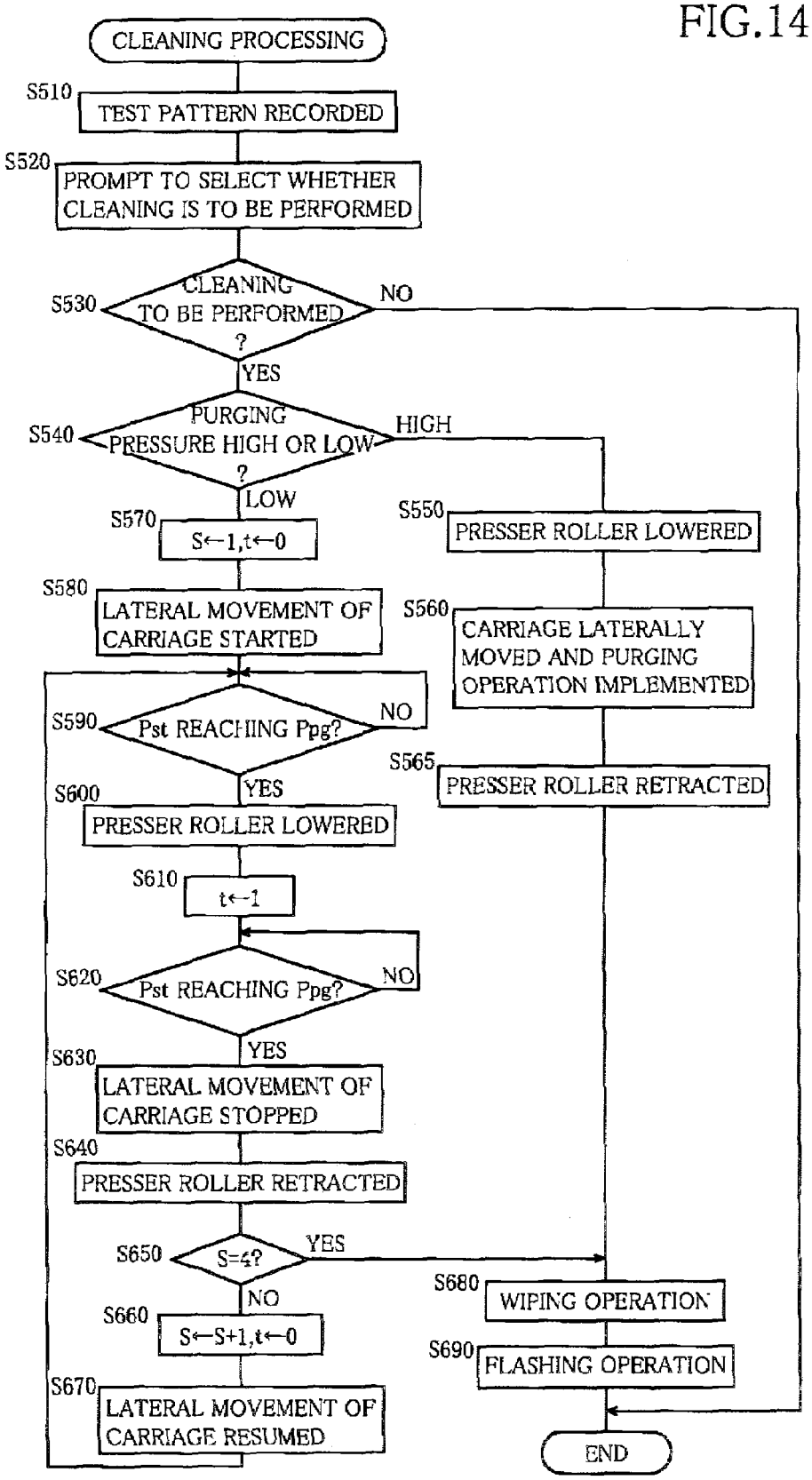
FIG. 14 is a flowchart illustrating a program according to which the recording apparatus performs cleaning.

In this way, the amount of the elastic deformation of the elastic support member, and accordingly the pressure applied to the ink downstream of the mesh pressurizing member, varies depending on the vertical position of the presser roller 14 relative to the elastic support member, as presented in a graph of FIG. 13, in which a "start point" at the leftmost position in the abscissa represents the point in the elastic support member where the presser roller 14 first contacts, more specifically, a position in a lateral end portion (the left-hand end portion as seen in FIG. 11) of the elastic support member 35, 45, 55, 65 which the presser roller 14 contacts slightly after the presser roller 14 has passed the lateral end position P10, P20, P30, P40 in the sub tank 31, 41, 51, 61 (shown in FIG. 11).

As the contact position at which the presser roller 14 contacts the elastic support member gradually shifts from the start point toward a "center point" corresponding to the center position Pc in the elastic support member, the applied pressure (i.e., the pressure applied to the ink on the downstream side of the mesh pressurizing member 32, 42, 52, 62) gradually increases. The applied pressure becomes maximal when the presser roller 14 reaches the center point or position Pc in the elastic support member and the amount of elastic deformation of the elastic support member is maximal. After the presser roller 14 has reached the center point or center position Pc, the elastic support member gradually restores to its original shape and the applied pressure also gradually decreases as the presser roller 14 further moves toward an "end point" that is in an opposite lateral end portion (the right-hand end portion as seen in FIG. 11) of the elastic support member. When reaching the "end point", the presser roller separates from the elastic support member, and the applied pressure becomes zero.

Thus, in the case of FIG. 12B where the carriage 4 is laterally moved at least until the center position Pc in the elastic support member 35 coincides with the position Ppg without being stopped after the presser roller 14 and the elastic support member 35 are brought into contact with each other, the ink on the downstream side of the mesh pressurizing member 32 is more greatly pressurized to more powerfully discharge the ink, than in the case of FIG. 12A where the lateral movement of the carriage 4 is stopped at the stop position P11. In the graph of FIG. 13 are presented three graph lines for respective pushing amounts corresponding to a plurality of pressing positions s21, s22, s23, and the difference among these graph lines will be described later with respect to a fourth embodiment of the present invention shown in FIGS. 15A-D.

There will be described cleaning processing according to this embodiment where the stop position is set as described above, with reference to FIG. 14.

Similarly to the cleaning processing according to the second embodiment described with reference to FIG. 10, the cleaning processing according to the third embodiment begins with the user checking the state of a recording head 69, and the restoring operation is initiated only when the user desires to have the restoring operation performed and makes a relevant input as predetermined through an operator panel 6. The contents of the steps S510-S530 initially implemented in the cleaning processing are identical with steps S310-S330 in the flowchart of FIG. 10, and description thereof is omitted.

When the recorded test pattern appears abnormal and the user determines that cleaning is necessary, the user makes an input indicating this determination through an operator panel 6 or an information processing apparatus, an affirmative decision (YES) is made in step S530 and the flow goes to step S540 to determined whether the currently set purging pressure is HIGH or LOW. This determination is identical with that made in step S140 in the recording processing program (shown in FIG. 8) according to the first embodiment.

When the purging pressure is set at HIGH, the presser roller 14 is held at the lowered position or pressing position until all the elastic support members 35, 45, 55, 65 have passed under the presser roller 14. Namely, in step S550, the presser roller 14 is lowered down to the pressing position, and in the following step S560, the carriage 4 starts laterally moving to perform the positive-pressure purging operation. After the presser roller 14 have contacted and elastically deformed all the elastic support members 35, 45, 55, 65 to the maximum amount in order to perform the positive-pressure purging for the nozzles 37, 47, 57, 67, the flow goes to S565 to return the presser roller 14 to the retracted position. Thereafter, the flow goes to step S680 to perform a wiping operation and to step S690 to perform a flashing operation. The wiping and flashing operations are identical with those described above with respect to the first embodiment. The flow terminates with covering the nozzle surface with a cap 21.

On the other hand, when the purging pressure is set at LOW, the flow goes from step S540 to step S570, to substitute 1 for a variable s, and substitute 0 for a variable t. The flow then goes to step S580 to start laterally moving the carriage 4.

After the start of lateral movement of the carriage 4, the flow goes to step S590 to determine whether a position Pst in the head unit 11 reaches or coincides with the position Ppg at which the presser roller 14 is located. This determination is made based on the position of the carriage as detected by a carriage movement encoder 118.

When the determination of step S590 is first made, the variables s and t are respectively set at 1 and 0, that is, s=1 and t=0, and hence this time it is determined whether the position P11 (shown FIG. 11) reaches the position Ppg. When the position P10 reaches the position Ppg, and an affirmative decision (YES) is made in step S590, the flow goes to step S600 to lower the presser roller 14 down to the pressing position, and then to step S610 to substitute 1 for the variable t. At this time, the variables s and t are both set at 1, that is, s=1 and t=1. Then, the flow goes to step S620 to determine whether the position Pst that is currently P11 reaches the position Ppg, that is, whether the stop position P11 in the sub tank 31 reaches the position Ppg of the presser roller 14.

When it is determined that the stop position P11 reaches the position Ppg, the flow goes to step S630 to stop the lateral movement of the carriage 4, and then to step S640 to retract the presser roller 14. Then, the flow goes to step S650 to determine whether the variable s is currently set at 4. This means that it is determined whether the stop position P41 in the elastic support member 65 of the fourth or the last sub tank 61 reaches the position Ppg of the presser roller 14.

When the variable s is not currently set at 4, the flow goes to step S660 to substitute s+1 for the variable s, and substitute 0 for the variable t. Then, the flow goes to step S670 to resume the lateral movement of the carriage 4 and again implement the processing of step S590 and the following steps S600-S650. When an affirmative decision is made in step S650, that is, when it is determined that the variable 9 is currently 4, the flow goes to step S680 and the following step to implement the wiping and flashing operations described above.

According to the third embodiment, when the purging pressure is set at LOW, the presser roller 14 is retracted at the stop position P11, P21, P31, P41 while the presser roller 14 is being in contact with and elastically deforming the elastic support member. On the other hand, when the purging pressure is set at HIGH, the presser roller is not retracted but held at the lowered, pressing position to be held in contact with the elastic support member until the elastic support member has passed under the presser roller 14. Thus, the purging operation can be performed with a suitable amount of the elastic deformation of the elastic support member (or a suitable pressurizing force) for the current state of the nozzles, thereby enabling to enhance the efficiency of the purging operation.

Although in the third embodiment a single stop position (P11, P21, P31, P41) is set in each sub tank, it may be arranged such that a plurality of stop positions are set for each sub tank, so as to enable multistep adjustment of the purging pressure.

Fourth Embodiment

There will be now described an inkjet recording head according to a fourth embodiment of the invention, by referring to FIGS. 15A-D.

In each of the first through third embodiments, it is arranged such that the presser roller 14 is operable between the retracted position and the pressing position at which the presser roller 14 contacts the elastic support member 35, 45, 55, 65. In the fourth embodiment also, the presser roller is operable between the retracted position and the pressing position, but the pressing position is selectable among three vertical positions. In other words, by selectively setting the pressing position at one of three levels, the pressure applied to the ink on the downstream side of the mesh pressurizing member 32 is set at a desired one of three values.

Thus, the fourth embodiment is identical with each of the first through third embodiments, except the structure of the pushing device 12. Hence, in the description of the fourth embodiment below, only a mechanism for moving the presser roller 14 and cleaning processing will be described by referring to FIGS. 15 and 16, and the corresponding elements and parts will be denoted by the same references and description thereof is not provided.

FIGS. 15A-15D illustrates how the vertical position of the presser roller 14 changes according to the present embodiment. A pushing device (corresponding to a pressurizing-member driving device and a pushing device) shown in FIGS. 15A-15D includes a roller holding member 130 that fixedly supports an end of a roller shaft 13*a*, an eccentric cam 132 for vertically moving the roller holding member 130, and a rotation controller (not shown) that transmits a driving force to rotate a rotational shaft 133 of the eccentric cam 132 by a selected angle. The roller holding member 130 is biased upward against the eccentric cam 132 by an elastic member such as spring (not shown). A combination of the eccentric cam 132, rotational shaft 133, roller holding member 130, roller shaft 13*a*, and elastic member (not shown) corresponds to an operating-member driving device, and an operating-member moving device.

Figures 15A, 15B, 15C, 15D:
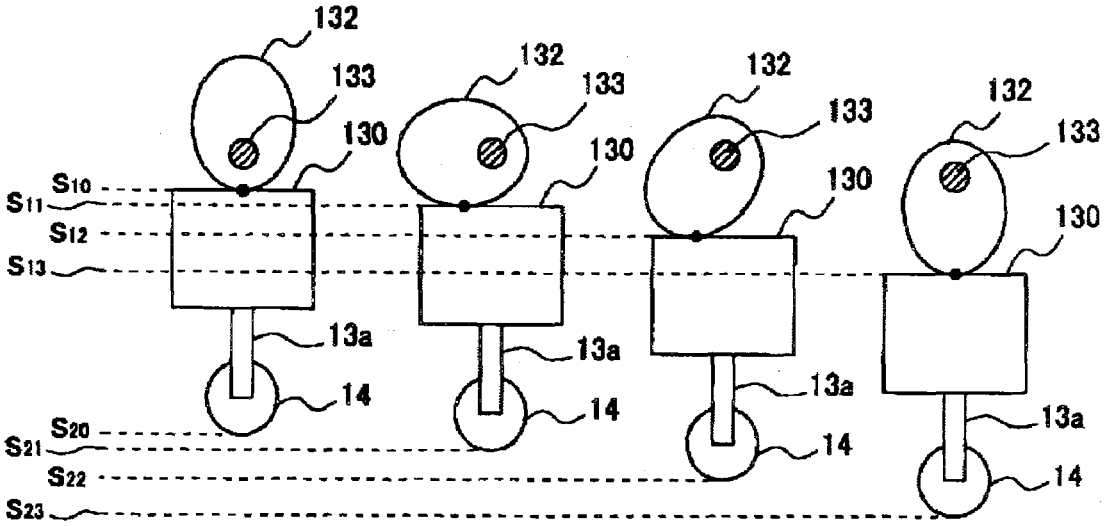
FIGS. 15A-D illustrate how a vertical position of a presser roller of a recording apparatus according to a fourth embodiment of the invention changes.

The eccentric cam 132 can be stopped at four rotational positions respectively shown in FIGS. 15A-15D. When the eccentric cam 132 is in a first rotational position as shown in FIG. 15A, the position of a top end of the roller holding member 130 is located at a vertical position or a level S10, while the position of a lower end of the presser roller 14 is located at a vertical position or a level S20. That is, the first rotational position is the uppermost position among the four rotational positions, and corresponds to the retracted position of the presser roller 14.

When rotated about 90 degrees in the counterclockwise direction from the first rotational position, the eccentric cam 132 is placed in a second rotational position shown in FIG. 15B. In the second rotational position, the position of the top end of the roller holding member 130 is at a level S11 lower than the level S10, while the position of the lower end of the presser roller 14 is at a level S21 (corresponding to a first pressing position) lower than the level S20.

When further rotated about 45 degrees in the counterclockwise direction from the second rotational position, the eccentric cam 132 is placed in a third rotational position shown in FIG. 15C. In the third rotational position, the position of the top end of the roller holding member 130 is at a level S12 lower than the level S11, while the position of the lower end of the presser roller 14 is at a level S22 (corresponding to a second pressing position) lower than the level S21.

When further rotated about 45 degrees in the counterclockwise direction from the third rotational position, the eccentric cam 132 is placed in a fourth rotational position shown in FIG. 15D. In the fourth rotational position, the position of the top end of the roller holding member 130 is at a level S13 lower than the level 812, while the position of the lower end of the presser roller 14 is at a level S23 (corresponding to a third pressing position) lower than the level S22.

Depending on the rotational position of the eccentric cam 132, the presser roller 14 is placed at one of the retracted position and the first, second, and third pressing positions. As the vertical position of the presser roller 14 lowers from the first position S21 to the second position S22 and then to the third position S23, the amount in which the elastic support member 35, 45, 55, 65 elastically deforms by contact with the presser roller 14 increases, which in turn increases the pressure applied to the ink on the downstream side of the mesh pressurizing member 32.

This is indicated in the graph of FIG. 13 as mentioned above with respect to the third embodiment. That is, the applied pressure increases with increase in the amount by which the presser roller 14 pushes the elastic support member, i.e., the amount of displacement of the mesh pressurizing member 32 to the downstream side by the elastic deformation of the elastic support member.

Figure 16:
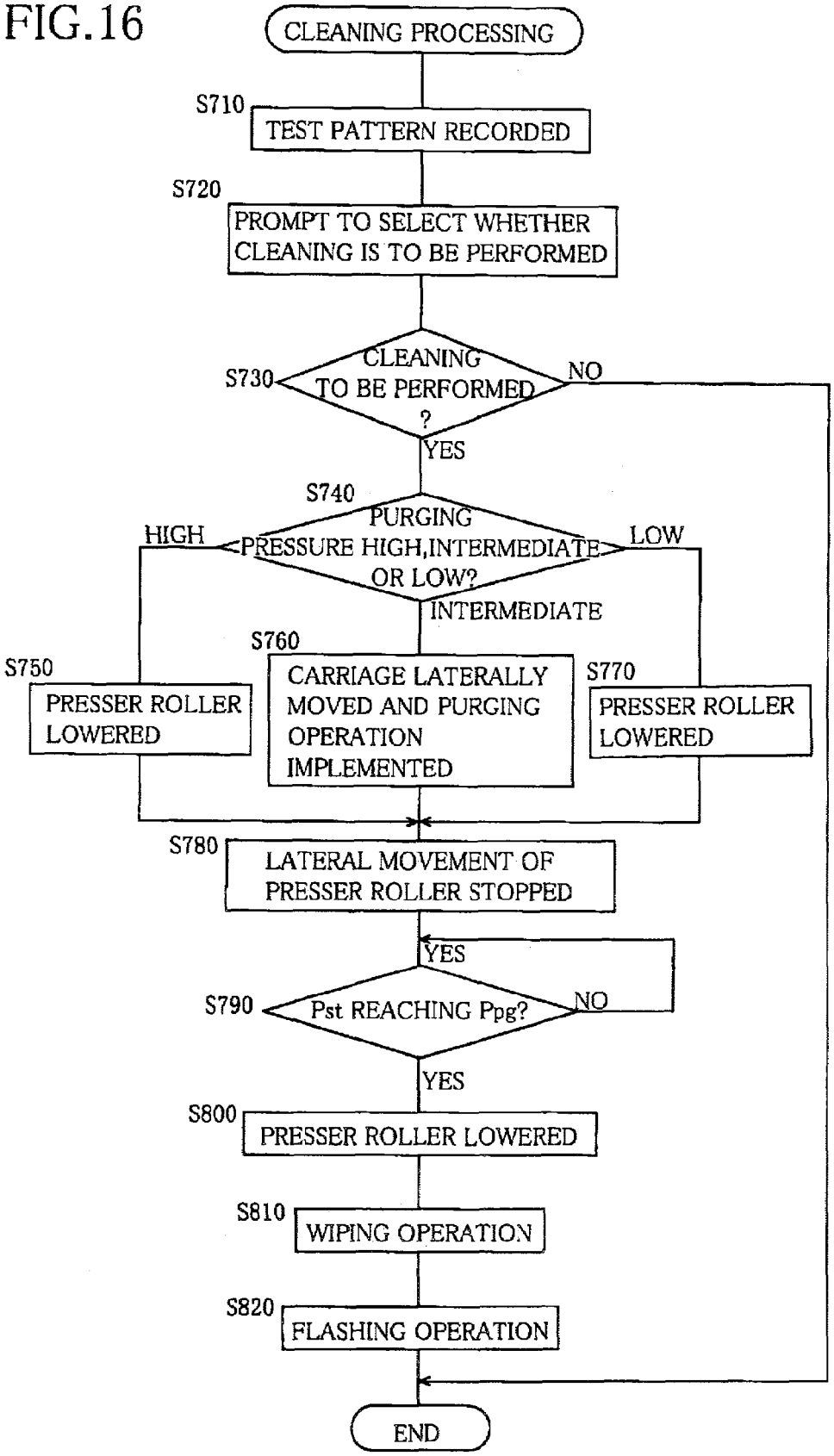
FIG. 16 is a flowchart illustrating a program according to which the recording apparatus performs cleaning.

There will be described cleaning processing according to the fourth embodiment, with reference to FIG. 16. In the present cleaning processing, processing implemented in steps S710-S730 is identical with that implemented in steps S310-S33 of the flowchart of FIG. 10, and description thereof is omitted.

When the recorded test pattern appears abnormal and the user determines that cleaning is necessary, the user makes an input indicating this determination through an operator panel 6 or an information processing apparatus, an affirmative decision (YES) is made in step S730 and the flow goes to step S740 to determine which one of HIGH, INTERMEDIATE or LOW the purging pressure is set at.

When the purging pressure is set at HIGH, the flow goes to step S750 to rotate the eccentric cam 132 to the fourth rotational position shown in FIG. 15D, in order to move the presser roller 14 to the third pressing position S23. When the purging pressure is set at INTERMEDIATE, the flow goes to step S760 to rotate the eccentric cam 132 to the third rotational position shown in FIG. 15C, in order to move the presser roller 14 to the second pressing position 822. When the purging pressure is set at LOW, the flow goes to step S770 to rotate the eccentric cam 132 to the second rotational position shown in FIG. 15B, in order to move the presser roller 14 to the first pressing position S21.

After moving the presser roller 14 to the set pressing position, the flow goes to step S780 to start laterally moving the carriage. When all the elastic support members 35, 45, 55, 65 have passed under the presser roller 14 and the purging has been performed for all the nozzles 37, 47, 57, 67, an affirmative decision (YES) is made in step S790, and the flow goes to step S800 to return the presser roller 14 to the retracted position S20. In the following steps S810 and S820, a wiping operation and a flashing operation are respectively performed. The wiping and flashing operations are identical with those in each of the above-described embodiments. Then, the recording head 69 is covered by the cap 21, and the cleaning processing of this cycle is terminated.

According to the fourth embodiment, the pressing position is set at one of a plurality (three in this specific example) of levels, so that the amount of the liquid discharged in the purging operation is adjustable correspondingly to the set level. Hence, the restoring operation can be performed with the applied pressure at a level suitable for the state of the nozzles, thereby enhancing the efficiency of the purging operation.

In each of the first through fourth embodiments, the positively pressurizing portion 39 for directly pressurizing the ink to perform the positive-pressure purging operation includes the mesh pressurizing member 32 provided by a plate-like member through which a plurality of ink passages 32*a* are formed in a mesh-like manner, and the connecting member 38 holding the mesh pressurizing member 32. However, the positively pressurizing portion 39 has been described only by way of example, and may be constructed anywise, that is, an overall shape (or a shape of an outer circumference) of the positively pressurizing portion 39, and the cross-sectional area (or a diameter), the number, the shape, and the positions of the ink passages 32*a*, may be variously changed, as long as the positively pressurizing portion 39 can directly pressurize the ink 36 on the downstream side thereof by being displaced to the downstream side with respect to the ink communication passage, and allows flow of the ink from the upstream side to the downstream side of the positively pressurizing portion 39 during recording is normally performed. Examples of other forms of the positively pressurizing portion will be hereinafter described as a fifth to eighth embodiments of the invention. Each of the fifth to eighth embodiments is identical with each of the above-described embodiments except the structure of the positively pressurizing portion, and thus the corresponding elements or parts will be denoted by the same reference numerals and description thereof is dispensed with.

Fifth Embodiment

There will be described an inkjet recording apparatus according to a fifth embodiment of the invention, by referring to FIG. 17A.

Figure 17B:
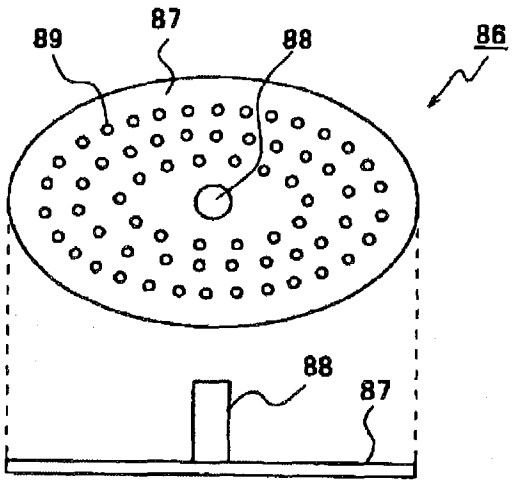
FIG. 17B is plan and elevational views of a positively pressurizing portion of a recording apparatus according to a sixth embodiment of the invention.
Figure 17D:
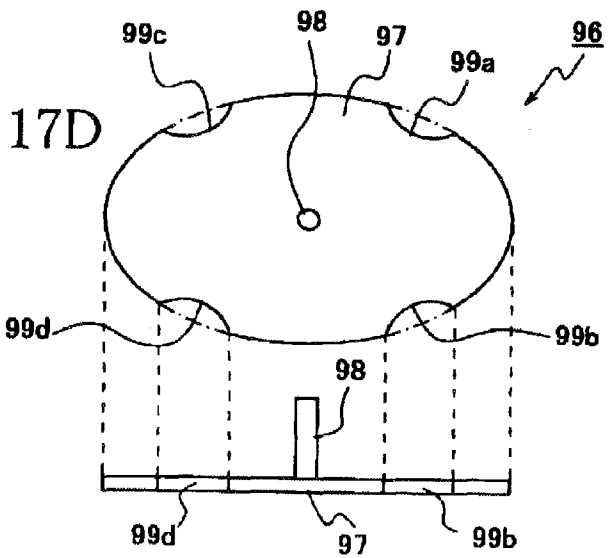
FIG. 17D is plan and elevational views of a positively pressurizing portion of a recording apparatus according to an eighth embodiment of the invention.
Figure 17A:
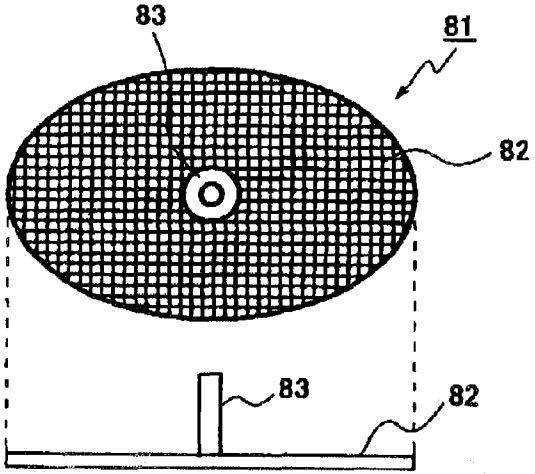
FIG. 17A is plan and elevational views of a positively pressurizing portion of a recording apparatus according to a fifth embodiment of the invention.

FIG. 17A shows a positively pressurizing portion 81 in the recording apparatus according to the fifth embodiment. The positively pressurizing portion 81 includes a mesh pressurizing member 82 (corresponding to a throughhole member) in which a plurality of ink passages are formed in a mesh-like manner, and a connecting shaft 83 extending upward from a central portion of the mesh pressurizing member 82. That is, the positively pressurizing portion 81 can be obtained by modifying the positively pressurizing portion 39 according to each of the first to fourth embodiments such that the support plate 33 is eliminated, the connecting rod 34 is directly connected to the mesh pressurizing member 32, and the ink passages are formed in the mesh-like manner in the mesh pressurizing member 32 except at the central portion thereof since the connecting shaft 83 is disposed on the central portion.

Sixth Embodiment

There will be described an inkjet recording apparatus according to a sixth embodiment of the invention, by referring to FIG. 17B.

FIG. 17B shows a positively pressurizing portion 86 in the recording apparatus according to the sixth embodiment. The positively pressurizing portion 86 includes a multihole pressurizing member 87 (corresponding to a throughhole member) in which a plurality of ink passages 89 having a same cross-sectional area are formed through the thickness of the multihole pressurizing member 87, and a connecting shaft 88 extending upward from a central portion of the multihole pressurizing member 87. In the multihole pressurizing member 87, the ink passages 89 are arranged concentrically at constant intervals.

Seventh Embodiment

There will be described an inkjet recording apparatus according to a seventh embodiment of the invention, by referring to FIG. 17C.

Figure 17C:
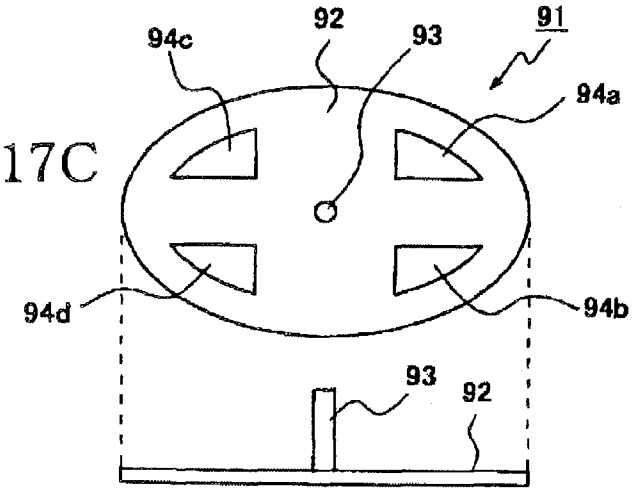
FIG. 17C is plan and elevational views of a positively pressurizing portion of a recording apparatus according to a seventh embodiment of the invention.

FIG. 17C shows a positively pressurizing portion 91 in the recording apparatus according to the seventh embodiment. The positively pressurizing portion 91 includes a multihole pressurizing member 92 (corresponding to a throughhole member) in which four ink passages 94*a*, 94*b*, 94*c*, 94*d* that are the same in shape and cross-sectional area are formed, and a connecting shaft 93 extending upward from a central portion of the multihole pressurizing member 92. More specifically, the ink passages 94*a*-94*d* are arranged at respective positions in the multihole pressurizing member 92 such that the positions of the ink passages 94*a* and 94*b* are symmetric, the positions of the ink passages 94*a* and 94*d* are symmetric, and the positions of the ink passages 94*b* and 94*c* are symmetric, with respect to the central portion of the multihole pressurizing member 92. In this relation, where a plurality of ink passages are formed in the pressurizing member, as in this and other relevant embodiments, an arrangement of the ink passages is not irregular, but the ink passages are arranged in a symmetrical relationship with respect to a center, or a center of gravity, of the pressurizing member, in order to ensure that the pressurizing member does not incline with respect to a horizontal plane.

Eighth Embodiment

There will be described an inkjet recording apparatus according to an eighth embodiment of the invention, by referring to FIG. 17D.

FIG. 17D shows a positively pressurizing portion 96 in the recording apparatus according to the seventh embodiment. The positively pressurizing portion 96 includes a pressurizing member 97 (corresponding to a throughhole member) in the form of an elliptic plate-like member with four cutouts 99*a*, 99*b*, 99*c*, 99*d* on an outer circumference thereof, and a connecting shaft 98 extending upward from a central portion of the pressurizing member 97. In the fourth embodiment, clearances or throughholes formed between the respective cutouts 99*a*, 99*b*, 99*c*, 99*d* and an inner surface of the sub tank serves as ink passages.

In each of the positively pressurizing portions 81, 86, 91, 96 shown in FIGS. 17A-17D, the pressurizing member 82, 87, 92, 97 is rigid to such a degree that even when the pressurizing member 82, 87, 92, 97 is pressed down via the connecting shaft 83, 88, 93, 98 in the purging operation, the pressurizing member 82, 87, 92, 97 does not deform by receiving the pressing force. However, in a case where the pressurizing member 82, 87, 92, 97 is formed of an elastic material, it may be arranged such that the connecting shaft 83, 88, 93, 98 is not disposed directly on the pressurizing member 82, 87, 92, 97, but the pressurizing member 82, 87, 92, 97 is connected to the connecting shaft 83, 88, 93, 98 with the support plate 33, as used in the first to fourth embodiments, interposed therebetween.

On the other hand, in each of the first to fourth embodiments, where the mesh pressurizing member 32 of the positively pressurizing portion 39 has such a rigidity that the mesh pressurizing member 32 does not deform by receiving the pressing force in the purging operation, the support plate 33 is not necessary. In this case, similarly to the fifth embodiment shown in FIG. 17A, the connecting rod 34 may be disposed directly on a central portion of the mesh pressurizing member 32.

Although in each of the first to eighth embodiments the end of the connecting rod 34, 83, 88, 93, 98 is connected to the central portion of the spherical elastic support member 35 in order to elastically hold the positively pressurizing portion 39, 81, 86, 91, 96, this is only an example of an arrangement for supporting the positively pressurizing portion. The arrangement of elastically holding the positively pressurizing portion may be realized in any other forms, as long as the positively pressurizing portion is biased such that the pressurizing member is normally held stationary at a predetermined position, and can return to this predetermined position after displaced to the downstream side in the purging operation. Hereinafter, another example of the arrangement for supporting the positively pressurizing portion will be described as a ninth embodiment of the invention.

Ninth Embodiment

There will be described an inkjet recording apparatus according to a ninth embodiment of the invention, by referring to FIG. 18. The ninth embodiment is identical with each of the first to eighth embodiments except the arrangement for supporting the pressurizing member and for displacing the pressurizing member to the downstream side, and thus the corresponding elements or parts will be denoted by the same reference numerals and description thereof is omitted.

Figure 18:
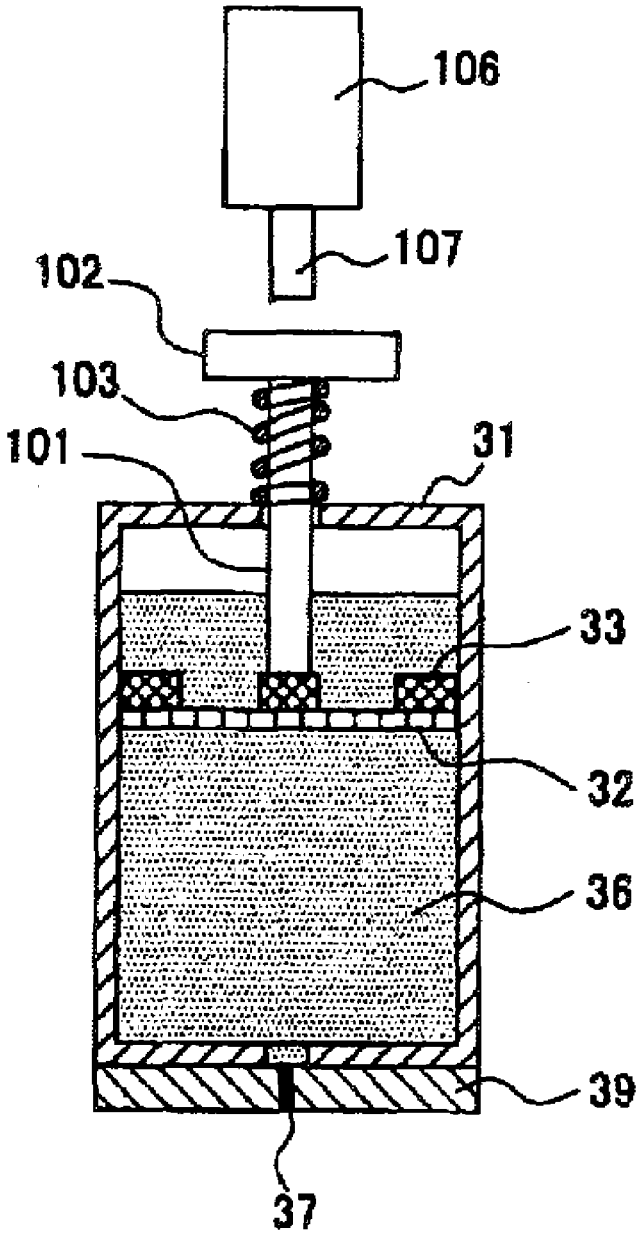
FIG. 18 illustrates a mechanism to drive and support a positively pressurizing portion of a recording apparatus according to a ninth embodiment of the invention.

According to the ninth embodiment, as shown in FIG. 18, a connecting rod 101 (corresponding to a connecting member and a transmitting device) extends upward from a central portion of a support plate 33, a flange 102 (corresponding to an operable member) is disposed on an end of the connecting rod 101, and a coil spring 103 (corresponding to an elastic member) is interposed between the flange 102 and a sub tank 31 such that the connecting rod 101 extends through the coil spring 103. As a mechanism (corresponding to a pressurizing-member driving device and a pushing device) for displacing a mesh pressurizing member 32 to the downstream side, a combination of a push rod 107 (corresponding to an operating member) and a driving portion 106 (corresponding to an operating-member driving device and an operating-member moving device) that pushes the push rod 107 may be used, as shown in FIG. 18. The driving portion 106 may be constituted by, for instance, a solenoid or a mechanism including a motor and a link, but is not limited thereto. A combination of the spring 103 and the connecting rod, 101 corresponds to a biasing device.

when a purging operation is performed, the push rod 107 is moved downward to push the flange 102 in order to in turn displace the mesh pressurizing member 32. At this time, the flange 102 receives an upward biasing force from the coil spring 103. Hence, when the push rod 107 returns to its original, retracted position after the purging, the flange 102 is pushed upward by the biasing force of the spring 103, thereby enabling the mesh pressurizing member 32 to return to its original position.

In the ninth embodiment, it may be arranged such that a speed at which the flange 102 is pushed down by the push rod 107 is selectable from a plurality of values, so that the pressure applied to the ink on the downstream side of the mesh pressurizing member 32 in the purging operation is adjustable to one of a plurality of values.

The ninth embodiment shown in FIG. 18 may be modified such that the spring 103 is omitted and an elastic member such as a spring is instead disposed in the sub tank 31 to connect the support plate 33 with an internal surface of an upper wall of the sub tank, so that the mesh pressurizing member 32 is elastically held in the sub tank by the upper wall.

Similarly, each of the first to eighth embodiments may be modified such that the elastic support member is omitted and an elastic member such as a spring is instead disposed in the sub tank 31 to connect the support plate 33 with an internal surface of an upper wall of the sub tank, so that the mesh pressurizing member 32 is elastically held in the sub tank by the upper wall.

Tenth Embodiment

There will be now described an inkjet recording apparatus according to a tenth embodiment of the invention, by referring to FIGS. 19A-19D. The recording apparatus of the tenth embodiment is identical with that of the first to ninth embodiments except the structure of the sub tank unit, and thus the corresponding elements or parts will be denoted by the same reference numerals and description thereof is omitted.

Figure 19A:
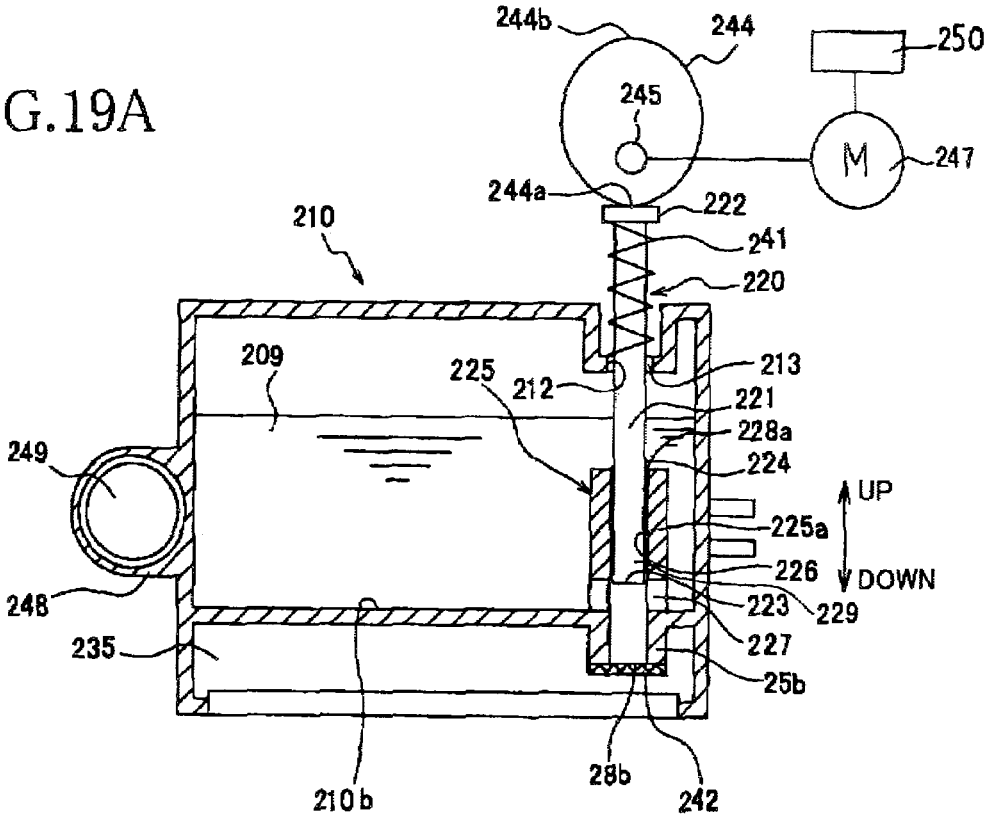
FIGS. 19A and 19B are partially cross-sectional views of a sub tank in an inkjet recording apparatus according to a tenth embodiment of the invention.
Figure 19B:
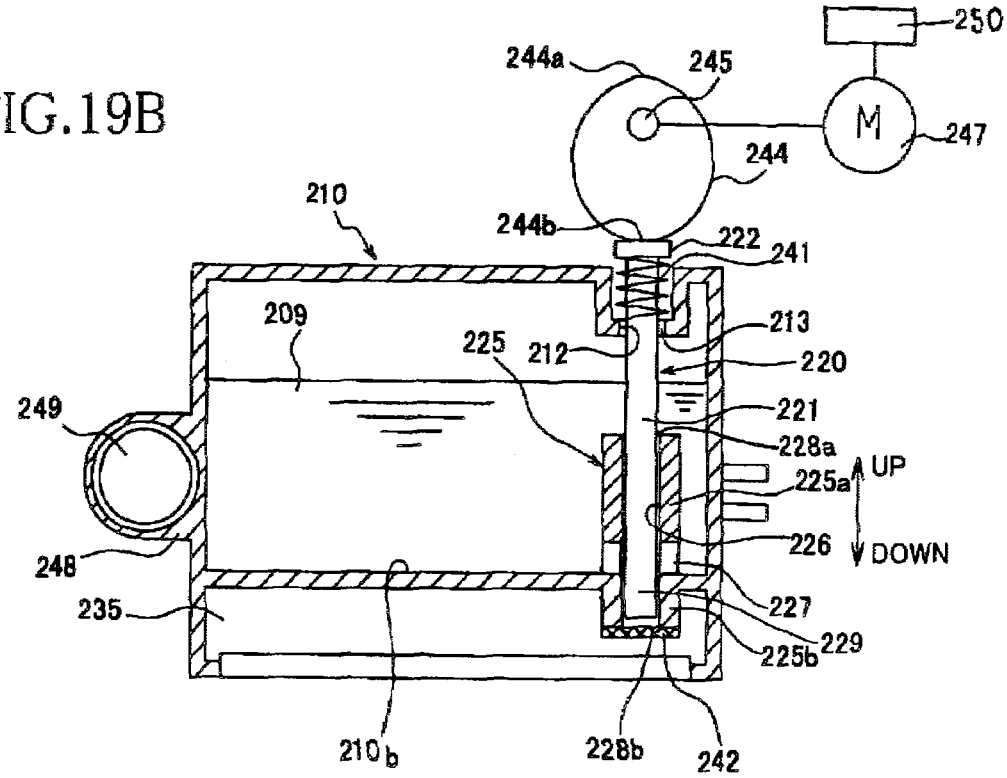

A sub tank unit mainly constituted by a sub tank or an ink storing chamber 210 as shown in FIGS. 19A and 19B stores ink 209 that is supplied to a recording head 235 for forming an image. Immediately under the sub tank 210, the recording, head 235 is disposed in connection with the sub tank 210.

The sub tank 210 has a substantially rectangular box-like shape. In an upper wall of the sub tank 210 is formed a piston bore 212 through which a plunger 220 extends. The plunger includes a rear or upper end portion 222 (corresponding to an operable member), an intermediate portion 221 (corresponding to a connecting member and a transmitting device), and a piston portion 229 (corresponding to a pressurizing member). In the sub tank 210 is disposed the plunger 220 and a cylinder 225 that cooperate to serve as an ejection performance restoring mechanism. A sealing member 213 is disposed between the piston bore 212 and the plunger 220 to seal therebetween.

On a side of the sub tank 210 is disposed a guide rod attaching portion 248 at which the sub tank unit is attached to a guide rod 249. The guide rod 249 functions as a guide when the sub tank unit is moved in a lateral direction of the inkjet recording apparatus, that is a direction perpendicular to the surface of the sheet in which FIGS. 19A and 19B are presented.

Figure 19C:
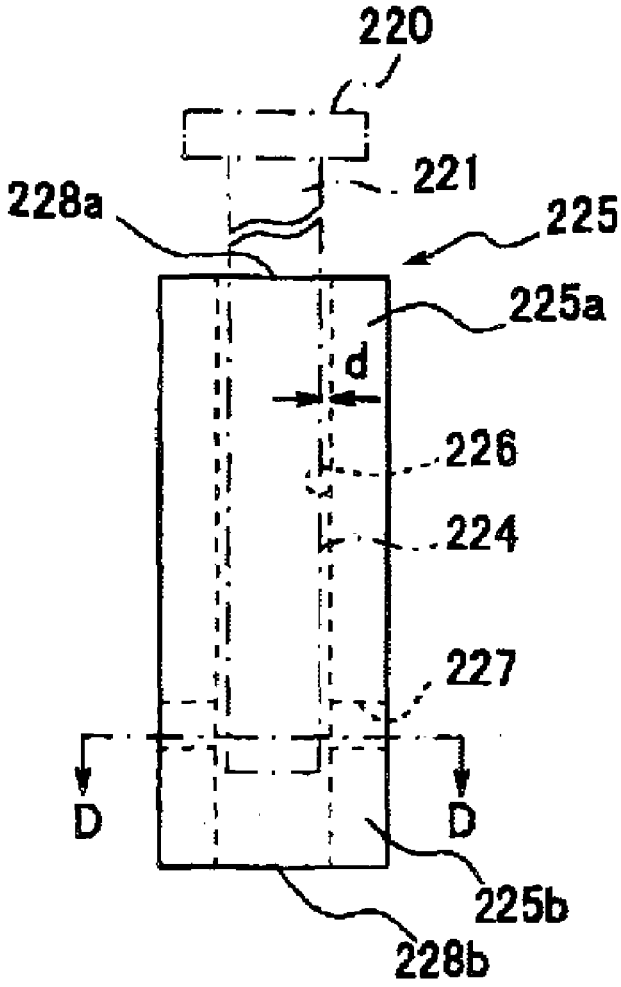
FIGS. 19C and 19D are views of a cylinder of the sub tank.
Figure 19D:
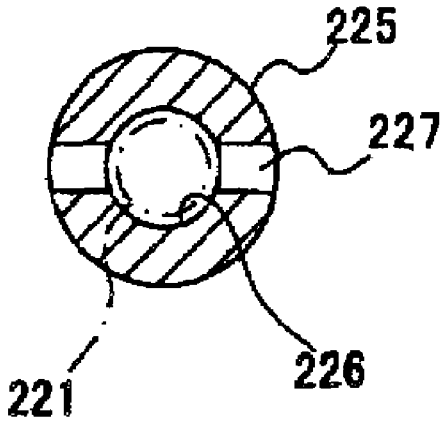

There will be now described a structure of the cylinder 225, with reference to FIGS. 19C and 19D. FIG. 19C is a side view of the cylinder 225, and FIG. 19D is a cross-sectional view taken along line D-D in FIG. 19C.

The cylinder 225 is a straight cylindrical pipe that is disposed in the sub tank 210 to vertically extend as seen in FIGS. 19A and 19B, and a lower portion thereof protrudes from a bottom wall 210*b* of the sub tank 210. The cylinder 225 is formed integrally with the sub tank 210.

An internal diameter of the cylinder 225 is larger than an external diameter of the intermediate portion 221 and the piston portion 229 of the plunger 220 by a dimension 2*d* corresponding to a clearance (corresponding to a flow, resistance generator) between the cylinder 225 and the plunger 220, as shown in FIGS. 19C and 19D. The cylinder 225 is open at its upper and lower ends, providing openings 228*a*, 228*b*. A pair of introducing holes 227 are formed through the thickness of a side wall of the cylinder 225 between the openings 228*a* and 228*b*. The introducing holes 227 are disposed at a vertical position substantially the same as that of the bottom wall 210*b* of the sub tank 210, as shown in FIGS. 19A and 19B.

This arrangement of the introducing holes 227 is made in order that when the piston portion 229 is retracted to the upper side of the introducing holes 227 as shown in FIG. 19A, the ink 209 is introduced into a lower portion 225*b* (corresponding to a pressure chamber) of an internal space of the cylinder 225 through the introducing holes 227 more rapidly as compared to the introduction of the ink 209 through the clearance d between the cylinder and the plunger, thereby effectively preventing the reverse flow of the ink from the recording head through the filter 242. When the cylinder 225 is long, the ink 209 can be introduced into the cylinder 225 through the introducing holes 227, and an upper portion of the cylinder 225 between the introducing holes 227 and the opening 228*a* functions as a guide of the plunger 220 when the plunger 220 vertically moves.

At the opening 228*b* as a liquid supply port at the lower end of the cylinder 225, a mesh filer 242 (corresponding to a multihole member and a flow resistance generator) is attached. The filter 242 functions to filter out a foreign material such as dust contained in the ink 209 in the sub tank 210, in order to prevent introduction of the foreign material into the recording head 235.

The fineness of the mesh of the filter 242, or the size of apertures of the filter 242, is adjusted so that a resistance to flow of the ink 209 through the filter 242 becomes larger than a resistance to the ink flow at the clearance d (shown in FIG. 19C) between an external circumferential surface 224 of the piston portion 229 of the plunger 220 and an internal circumferential surface 226 of the cylinder 225. Hence, when the plunger 220 moves in a direction away from the opening 228*b* at the lower end of the cylinder 225, the ink 209 in the internal space of the sub tank 210 is easily introduced into the cylinder 225 from the side of the opening 228*b*, thereby preventing the ink 209 from flowing in the reverse direction from the recording head 235. Thus the ink once pushed out toward the exterior of the cylinder 225 is not pulled back into the cylinder 225, and the meniscuses formed in respective nozzles (not shown) in the recording head 235 are not broken.

The plunger 220 is generally a straight, circular cylinder that vertically moves in the cylinder 225. The plunger 220 is supported by sealing member 213 fitted between the piston bore 212 and the cylinder 225 disposed in the sub tank 210.

The plunger 220 is held biased by a biasing force of a spring 241 (corresponding to an elastic member) to the side of the opening 228*a* of the cylinder 225, that is, upward as seen in FIG. 19A. A combination of the spring 241, the intermediate portion 221 and the upper end portion 222 corresponds to a biasing device. In the state shown in FIG. 19A, namely, before the plunger 220 is pushed down, a lower end surface 223 of the piston portion 229 is located at such a position that the plunger 220 does not to close the introducing holes 227 formed in the cylinder 225.

The recording apparatus includes a driving device (corresponding to a pressurizing-member driving device) for driving the plunger 220, which includes a cam 244 (corresponding to an operating member and a rotary member), an electric motor 247, the spring 241 for biasing the plunger 220 onto the cam 244, and a controller 250. A combination of the cam 244, electric motor 247, and controller 250 corresponds to a pushing device, and a combination of the electric motor 247 and controller 250 corresponds to an operating-member driving device.

The cam 244 is a substantially elliptical plate-like member, and driven or rotated around a cam shaft 245 by the electric motor 247.

A circumference of the cam 244 is held in contact with an upper surface of the rear end portion 222 of the plunger 220. A point in the cam 244 at which the cam 244 contacts the upper surface of the rear end portion 222 when the plunger 220 is located at its uppermost position, will be referred to as a lowermost point 244*a* of the cam 244. A point symmetrical to the lowermost point 244*a* with respect to the cam shaft 245, that is, a point at which a line extending through the lowermost point 244*a* and a center of the cam shaft 245 intersects the circumference of the cam 244, will be referred to as an uppermost point 244*b* of the cam 244.

The dimensions of the cam 244 and the position of the cam shaft 245 are determined such that when the plunger 220 is at its lowermost position, the upper surface of the rear end portion 222 and the uppermost point 244*b* of the cam 244 contact each other. By this arrangement, the plunger 220 can be moved using the electric motor 247, the cam 244, and the spring 241, and thus a user of the inkjet recording apparatus does not need to manually move the plunger 220. Hence, the operation of the plunger can be made more reliably than the case of the manual operation, and where the number of times the plunger is displaced and the amount of a displacement of the plunger are controlled, the control is easily made.

By rotating the cam 244 by the electric motor 247, the plunger 220 can be more reliably moved compared to the case where the plunger 220 is manually moved by the user. Thus, the ink 209 in the cylinder 225 can be reliably supplied to the recording head.

The controller 250 of the driving device controls the velocity at which the plunger 220 moves. By controlling the moving velocity of the plunger 220 by the controller 250, a speed at which the pressurized ink 209 is fed to the recording head 235 can be controlled. Thus, the purging operation for restoring the ejection performance of the inkjet recording apparatus to the initial, excellent level can be performed with high precision and high efficiency.

When a purging operation is performed repeatedly, the intensity in feeding of the ink 209, or the applied pressure by which the ink 209 is fed into the recording head, may be varied as desired. For instance, the controller 250 operates such that the intensity or the applied pressure is larger in a second round of the restoring operation than in a first round, and larger in a third round than in the second round. Further, it may be arranged such that the user can set the pressure at which the plunger 220 pressurizes the ink 209 at various values as needed, by making an input through an operator panel or otherwise. The purging operation can be implemented with various other settings.

<Operation of Ejection Performance Restoring Mechanism>

There will be described an operation of the ejection performance restoring mechanism according to the tenth embodiment, by referring to FIGS. 19A and 19B.

In the state of FIG. 19A, the plunger 220 is not pushed down yet, and biased to its uppermost position by the biasing force of the spring 241.

When the plunger 220 is at its uppermost position, the lower end surface 223 of the piston portion 221 is at the position that the plunger 220 does not to close the introducing holes 227 of the cylinder 225, as described above. Thus, the ink 209 is introduced into the lower portion 225*b* of the internal space of the cylinder 225 below the introducing holes 227, through the introducing holes 227, and stored there.

In this state, the electric motor 247 operates to rotate the cam 244 around the cam shaft 245, to push the plunger 220 downward against the biasing force of the spring 241. The direction in which the cam 244 is rotated may be clockwise or counterclockwise. Thus, the ink 209 present in the lower portion 225*b* of the cylinder 225 below the introducing holes 227 in the state shown in FIG. 19A is pressurized, and the pressurized ink 209 is supplied into the recording head 235 from the opening 228*b* at the lower end of the cylinder 225 and via the filter 242, as shown in FIG. 19B. The ink 209 supplied into the recording head 235 are ejected to the exterior through the nozzles (not shown) along with bubbles and a foreign material such as dust that are present in the recording head 235, and a portion of an ink communication passage in the recording head 235 is filled with the fresh ink 209. The plunger 220 reaches its lowermost position when the cam 244 rotates 180 degrees around the cam shaft 245 to bring the uppermost point 244*b* in the cam 244 into contact with the upper surface of the rear end portion 222.

As the cam 244 continues to rotate from this position in the same direction around the cam shaft 245, the plunger 220 starts moving from the lowermost position of FIG. 19B again to the side opposite to the opening 228*b*. Since there is the clearance d between the external circumferential surface 224 of the piston portion 229 and the internal circumferential surface 226 of the cylinder 225, the ink 209 in the sub tank 210 flows into the cylinder 225 in which the plunger 220 has moved to the side opposite to the opening 228*b* when the piston portion 229 retracts or is moved upward, and the introduced ink 209 is stored in the cylinder 225.

In this way, by moving the plunger 220, the ink 209 is pressure-fed into the recording head 235, not by changing the air pressure in the sub tank 210, but by directly displacing or pressurizing the ink 209. Thus, the bubbles and foreign material such as ink powder present in the recording head 235 can be reliably eliminated.

Then, when the cam 244 moves to the side opposite to the opening 228*b*, the ink 209 in the sub tank 210 flows into the cylinder 225 in which the plunger 220 has moved to the side opposite to the opening 228*b*, through the clearance d between the plunger 220 and the cylinder 225 and also through the introducing holes 227 the ink 209 once discharged to the exterior from the recording head 235 does not return to the recording head 235. Hence, the bubbles and foreign material such as dust do not return to the inside of the recording head 235.

The amount of the ink as wasted when eliminating the bubbles and foreign material corresponds to the inner volume of a part of the cylinder 225 within which the piston 229 is reciprocable, at most. Hence, compared to an arrangement where the nozzles of the recording head 235 are covered by a cap and the ink 209 in the cap and the nozzles is sucked by a negative pressure from the side of the cap, for instance, the present embodiment reduces the amount of the wasted ink.

By having the flow resistance at the filter 242 larger than that at the clearance d, the ink in the sub tank easily flows into the cylinder through the introducing holes 227 and the clearance between the piston portion 229 and the cylinder, and the ink once pushed toward the exterior of the cylinder 225 does not return to the inside of the cylinder 225 via the filter 242 and through the opening 228*b* at the lower end of the cylinder 225, and the meniscuses formed in the nozzles (not shown) are maintained.

In this way, the ejection performance restoring mechanism can pressure-feed the ink into the recording head 235 with stability and without suffering from secular change of components, while the numbers of components and assembly steps of the sub tank 210 are reduced, thereby reducing the cost.

Where the cylinder 225 is integrally formed with the sub tank 210, the precision in assembling the cylinder 225 to the sub tank 210 is improved compared to the case where the cylinder 225 is attached to the sub tank 210 with screw or the like. The improvement in the precision in assembling the cylinder 225 to the sub tank 210 leads to an improvement in the precision in assembling the plunger 220 to the cylinder 225.

Since in the tenth embodiment an attaching member such as screw that is required where the sub tank 210 and the cylinder 225 are separately prepared is made unnecessary, the numbers of components and assembly steps of the sub tank 210 are reduced. Consequently, the structure of the sub tank 210 is simplified, thereby reducing the cost of the sub tank 210. Where the cylinder 225 is formed as a member separate from the sub tank 210, it may be arranged such that a bracket (not shown) or the like is attached to the cylinder 225, and the bracket or the like is attached to an inner surface of the sub tank 210, for instance.

The shape of the cam 244 is not limited to an elliptical shape, but may be circular, for instance. However, when the cam 244 has a circular shape, it is essential that a rotational shaft of the cam 244 is eccentric with respect to a center of the circular shape of the cam 244.

According to the tenth embodiment, the cylinder 225 is fixed to the sub tank 210, namely, integrally formed with the sub tank, the O-ring conventionally employed in order to seal between the plunger and the cylinder is not disposed. Hence, the problem described in the above-mentioned third publication that when the O-ring is damaged, the cylinder falls down to the bottom of the ink tank by its own weight to inhibit the supply of the ink into the recording head, is prevented. The arrangement where the cylinder 225 is fixed to the sub tank 210 omits the mechanism for displacing the cylinder inside the sub tank which is used in the conventional cylinder, thereby simplifying the structure of the sub tank.

The inkjet recording apparatus of the present embodiment including the ejection performance restoring, mechanism is made small in size and low in manufacturing cost.

The tenth embodiment may be variously modified.

For instance, in the tenth embodiment the operation of the plunger 220 is controlled by the electric motor 247, the cam 244, and the controller 250. However, the plunger 220 may be manually pushed down by the user. When the arrangement where the user manually pushes down the plunger 220 is employed, the electric motor 247 and the cam 244 shown in FIGS. 19A and 19B are omitted, and the user manually pushes down the rear end portion 222 of the intermediate portion 221 from the upper side. This arrangement further simplifies the ejection performance restoring mechanism.

Where the inkjet recording apparatus uses a plurality of inks of respective colors, the ejection performance restoring mechanism may be disposed for each of a plurality of sub tank units the respective colors. In this arrangement, it is possible to operate only some of the ejection performance restoring mechanisms that corresponds to the sub tank unit or units requiring the purging operation.

Where the cylinder 225 is short, the upper portion 225*a* of the cylinder 225 located above the bottom wall 210*b* of the sub tank 210 may be omitted.

In each of the first to tenth embodiments where the pressurizing member 32, 82, 87, 92, 97, 229 that directly pressurizes the ink in the sub tank is disposed may be modified such that the member (elastic support member 35, coil spring 103, coil spring 241) that serves to elastically hold or support the pressurizing member is not disposed outside the sub tank, but disposed inside the sub tank. That is, in each of the first to eighth embodiments, the sub tank unit, may be, modified such that the elastic support member 35 is replaced with a, deformable member, and an elastic member such as spring is disposed inside the sub tank to connect the pressurizing member 32, 82, 87, 92, 97 with a bottom surface of the internal space of the sub tank 31, so that the pressurizing member 32, 82, 87, 92, 97 is elastically supported in the sub tank 31 from the under side. Further, In the ninth embodiment, the sub tank unit may be modified such that the spring 103 is omitted, and an elastic member such as spring is disposed inside the sub tank 31 such that the elastic member connects an under surface of an upper wall of the sub tank 31 with the support plate 33, so that the pressurizing member 32 is elastically held from the upper side. Similarly, in the tenth embodiment, the sub tank unit may be modified such that the spring 241 is omitted, and an elastic member such as spring is disposed inside the sub tank 210 such that the elastic member connects the plunger 220 and the sub tank, so that the plunger 220 is elastically held inside the sub tank. The modification for the first to the eighth embodiments may be applied to the ninth and tenth embodiments, and the modification for the ninth and tenth embodiments may be applied to the first to the eighth embodiments.

Eleventh Embodiment

Figure 20A:
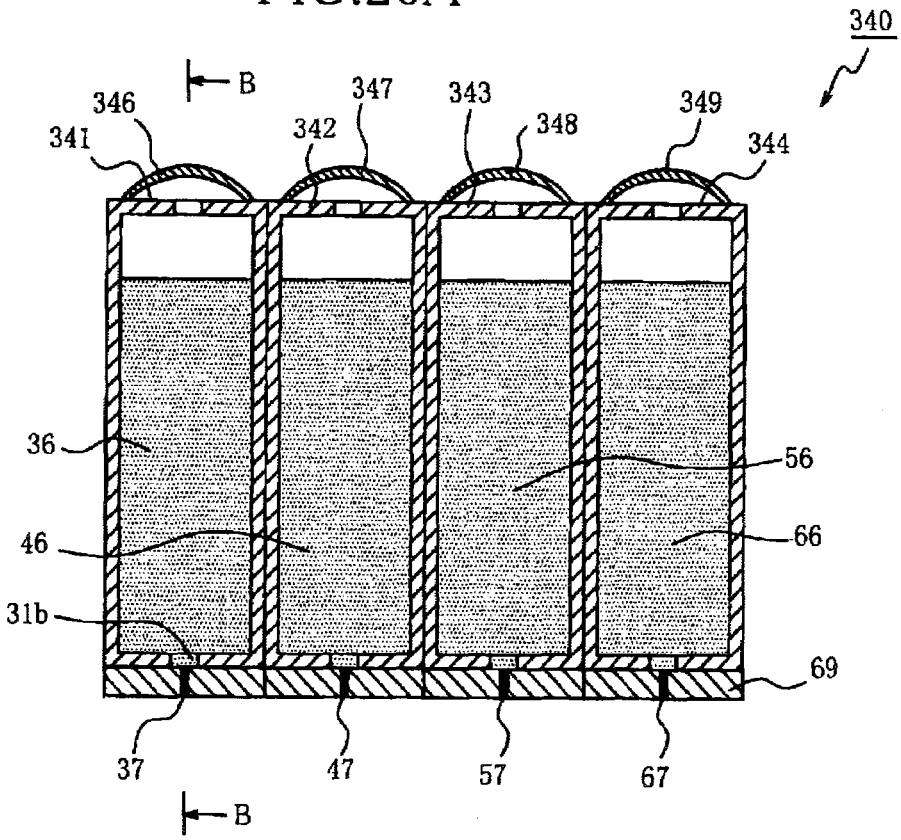
Figure 20B:
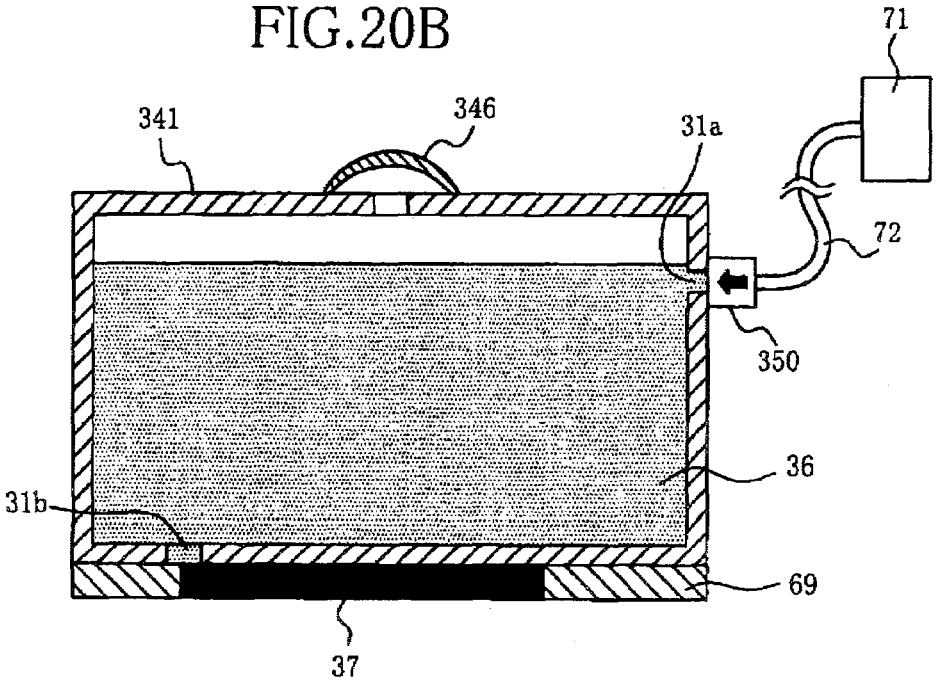

There will be now described an inkjet recording apparatus according to an eleventh embodiment of the invention, by referring to FIGS. 20A and 20B. The recording apparatus of the eleventh embodiment is identical with that of the first to tenth embodiments except the structure for pressure-feeding the ink from the internal space of the sub tank to the recording head, and thus the corresponding elements or parts will be denoted by the same reference numerals and description thereof is omitted.

More specifically, in each of the first to tenth embodiment, a directly pressurizing member such as the pressurizing member 32, 82, 87, 92, 97 and the piston portion 229 of the plunger 220 that directly pressurize the ink in the sub tank is disposed in the sub tank, and the flow resistance generated when the directly pressurizing member is moved to the downstream side of the ink communication passage acts to pressurize the ink on the downstream side of the directly pressurizing member, thereby enabling to efficiently performing the purging operation.

On the other hand, in the eleventh embodiment as shown in FIGS. 20A and 20B, such a directly pressurizing member is not provided in each sub tank 341, 342, 343, 344 (corresponding to a temporary storing chamber) in a head unit 340 mounted on a carriage 4 (as shown in FIG. 3). That is, the positively pressurizing portions as seen in the first to eighth embodiments are not provided in the eleventh embodiment. At an upper portion of each of the sub tanks 341, 342, 343, 344, only an elastic pressurizing member 346, 347, 348, 349 (corresponding to an elastic pressurizing member) is disposed.

The elastic pressurizing member 346, 347, 348, 349 is basically the same as the elastic support member 35, 45, 55, 65 in the first to eighth embodiments, and contacts a presser roller 14. In contact with the presser roller 14, the elastic pressurizing member 346, 347, 348, 349 receives a load therefrom to elastically deform toward the internal space of the sub tank 341, 342, 343, 344, and restores to its original shape upon separation of the presser roller 14 therefrom.

There will be described an operation at the sub tank 342 representatively. When the elastic pressurizing member 346 of the sub tank 342 is brought into contact with the presser roller 14 as the carriage 4 moves, the elastic pressurizing member 346 elastically deforms toward the internal space of the sub tank 342, thereby reducing the inner volume of the internal space. Thus, a pressure is applied to the air in the internal space, and the applied pressure is transmitted to the ink 36 to presses the ink 36 to the downstream side of the ink communication passage, thereby forcibly ejecting the ink 36 in the form of droplets from nozzles 37.

The sub tank 341 has an ink inlet 31*a* through which the ink 36 is introduced from an ink cartridge 71 to the internal space of the sub tank 341. As shown in FIG. 20B, on the upper stream side of the ink inlet 31*a* is disposed a check valve 350 that prevents flow of the ink 36 in a reverse direction, i.e., from the sub tank 341 to the ink cartridge 71 as a main tank. Thus, upon elastic deformation of the elastic pressurizing member 346 to pressurize the internal space of the sub tank 341, the ink 36 does not flow in the reverse direction, thereby preventing a pressure loss due to the reverse ink flow and thus enhancing the efficiency of the purging operation. The check valve 350 corresponds to a reverse flow inhibitor.

Twelfth Embodiment

In each of the first to eleventh embodiments, the inkjet recording apparatus is of continuous supply type where an ink can be kept supplied from an ink cartridge to each sub tank in a head unit mounted on a carriage, via an ink supply tube. However, the invention is applicable to an inkjet recording apparatus of station type where each sub tank is connected to an ink cartridge or a main tank, via an ink supply tube or the like, only when an ink is supplied while a head unit located at a predetermined position. There will be described, by referring to FIG. 21, a station type inkjet recording apparatus according to a twelfth embodiment of the invention, which is identical with the eleventh embodiment except a part only which will be described below. The corresponding elements or parts will be denoted by the same reference numerals and description thereof is omitted.

A station type inkjet recording apparatus is typically constructed such that an ink inlet of the sub tank, through which the ink is introduced from the ink cartridge into the sub tank, is closed while the head unit is moving. In order to prevent a decrease in the pressure inside the sub tank, that is, to prevent the magnitude of the negative pressure inside the sub tank from increasing as the ink stored in the sub tank is used or supplied to the recording head, an atmospheric communication hole that communicates the internal space of the sub tank with the atmosphere to maintain the pressure in the internal space at the atmospheric pressure is typically formed in the sub tank.

There will be described a structure of the sub tank of the station type inkjet recording apparatus and a process of a purging operation according to the twelfth embodiment, with reference to FIG. 21. It is noted that the process of the purging operation illustrated in FIG. 21 is basically the same as that shown in FIG. 6, except the way of converting the rotation of the presser roller 14 into the pressing force for pressurizing the ink in the sub tank.

Figure 21:
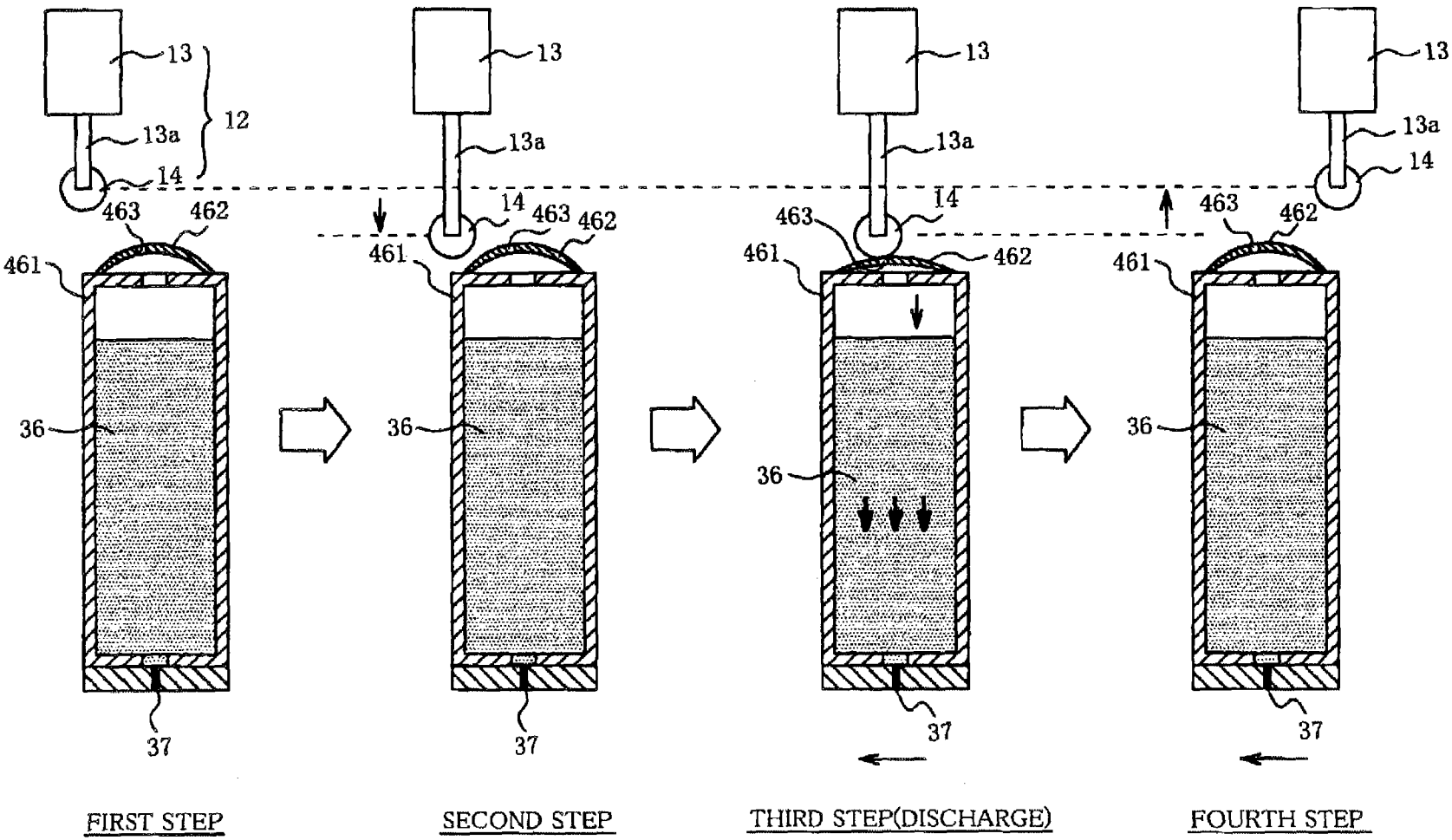
FIG. 21 illustrates a process of restoring an ink ejection performance of a recording head in an inkjet recording apparatus of station type, according to a twelfth embodiment of the invention.

A sub tank 461 (corresponding to a temporary storing chamber) shown in FIG. 21 is different from the sub tank 341 shown in FIG. 20 in the shape of the elastic pressurizing member disposed in an upper portion thereof. That is, as shown in FIG. 21, an elastic pressurizing member 462 (corresponding to an operable member) disposed in an upper portion of the sub tank 461 has an atmospheric communication hole 463 formed at a position slightly off a top of the elastic pressurizing member 462 to a side in a direction of lateral movement of the head unit.

The purging operation is initiated with lowering of the presser roller 14 (first step). Then the sub tank 461 starts laterally moving (second step). As the sub tank 461 continues moving, the elastic pressurizing member 462 is brought into contact with the presser roller 14 and receives a load therefrom to be elastically flattened or deformed toward the internal space of the sub tank 461 (third step). As shown in FIG. 21, in this third step, the atmospheric communication hole 463 formed in the elastic pressurizing member 462 is closed by the presser roller 14 while the elastic pressurizing member 462 is being elastically deformed.

The air in the sub tank 461 is prevented from leaking to the exterior through the atmospheric communication hole 463, upon pressurizing of the air in the internal space by the elastic deformation of the elastic pressurizing member 462, thereby ensuring to sufficiently pressurize the air in the internal space of the sub tank. Hence, the ink ejection performance of the recording head can be effectively restored to its initial excellent level. After the implementation of the purging operation, the presser roller 14 is separated from the elastic pressurizing member 462 (fourth step), with the atmospheric communication hole 463 opened in order to maintain the internal pressure of the sub tank 461 at the level equal to the atmospheric pressure.

The mechanism included in the apparatus for shutting off the ink flow from the main tank while the head unit is laterally moved corresponds to the shutoff device.

Thirteenth Embodiment

An inkjet recording apparatus according to a thirteenth embodiment of the invention will be described with reference to FIGS. 22-29.

Figure 22:
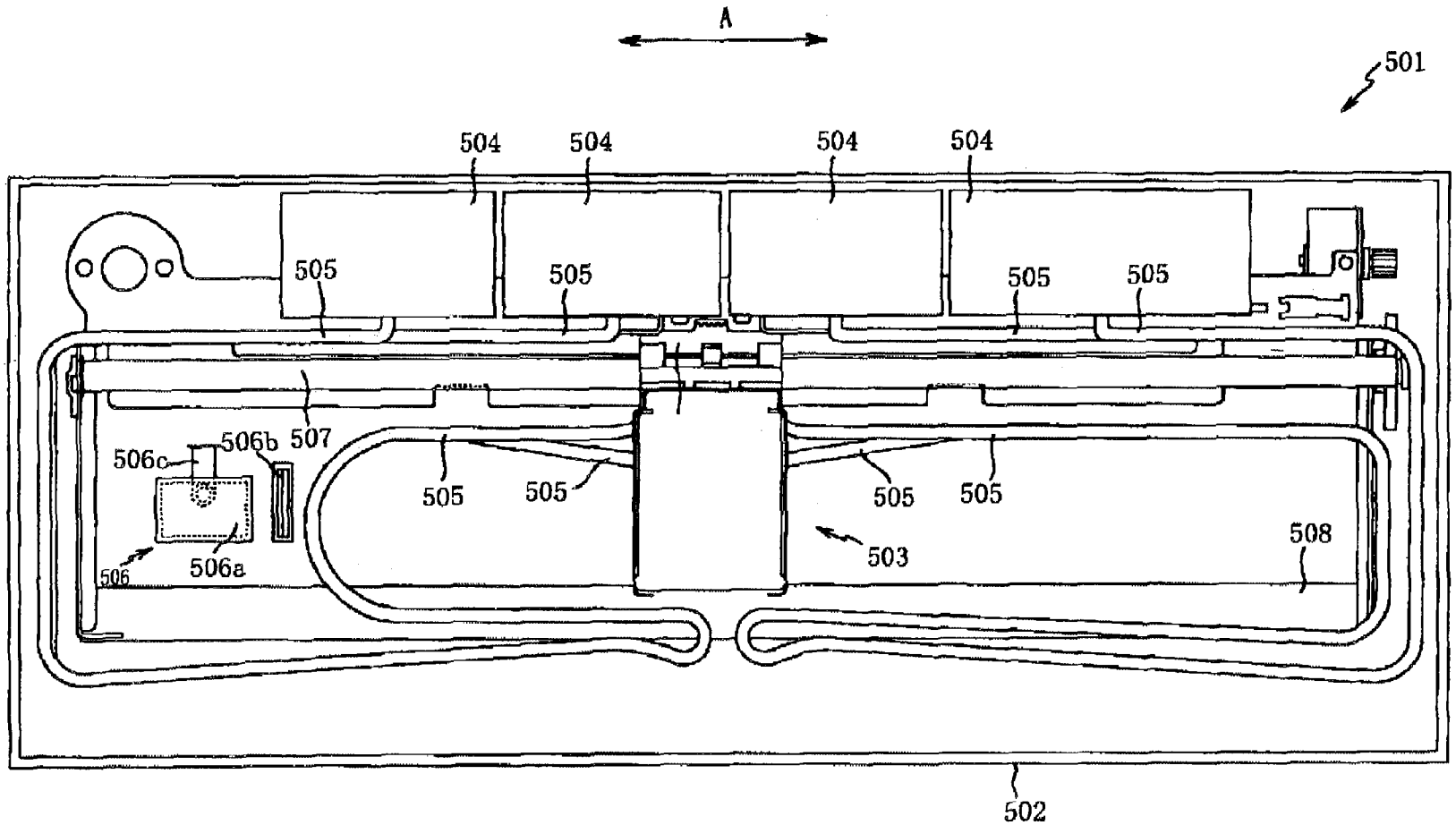
FIG. 22 is a schematic plan view showing an internal structure of an inkjet recording apparatus according to a thirteenth embodiment of the invention.

FIG. 22 shows an internal structure of an inkjet recording apparatus 501 of the thirteenth embodiment. The inkjet recording apparatus 501 includes a mainbody frame 502 of fire-retardant resin, a head unit 503 disposed inside the frame 502 and ejecting droplets of inks therefrom onto a recording medium such as a sheet of paper, four ink cartridges 504 (corresponding to main tanks) as an ink supply source, that store inks to be supplied to the head unit 503, the tubes 505 via which the inks in the ink cartridges 504 are supplied to the head unit 503, and a restoring unit 506.

The head unit 503 is mounted on a carriage 503*a* that is reciprocated in a main scanning direction indicated by arrow A in FIG. 22, and includes an inkjet recording head 515 (shown in FIG. 24) disposed at the bottom of the carriage 503*a*. Droplets of the inks are ejected from the inkjet recording head 515 onto the recording medium.

A guide rod 507 is disposed in the apparatus 501 to extend laterally or in a longitudinal direction of the frame 502, and an end portion or a guide rod attaching portion of the carriage 503*a* is slidably fitted on the guide rod 507.

An end of the head unit 503 opposite to that end portion of the carriage 503*a* is supported by a guide bar 508 disposed to extend in the longitudinal direction of the frame, 502. The carriage 503*a* is coupled with a belt wound around a pulley mounted on an output shaft of a CR motor (carriage motor) 516 shown in FIG. 26. The CR motor 516 is operated to circulate the belt in order to reciprocate the carriage 503*a* in the longitudinal direction of the frame 502, i.e., in the main scanning direction, across a predetermined area corresponding to a predetermined moving range.

The ink supply source, i.e., the four ink cartridges 504 correspond to ink tanks, and are arranged in a row along the longitudinal direction of the frame 502. The ink cartridges 504 are removably attached on the frame 502.

The ink cartridges 504 air-tightly accommodate black, yellow, cyan, and magenta inks, respectively. The inks in the ink cartridges 504 are supplied to sub tanks or buffer tanks 611*a* which may be called airtraps (corresponding to temporary storing chambers) in respective sub tank units 511, 511, 511, 511 (shown in FIG. 23) disposed over the recording head 515, through the tubes 505. The inks supplied to the sub tanks 511*a* are then supplied into the inset recording head 515, namely, four ink passages for respective colors inside the recording head 515.

Figure 24:
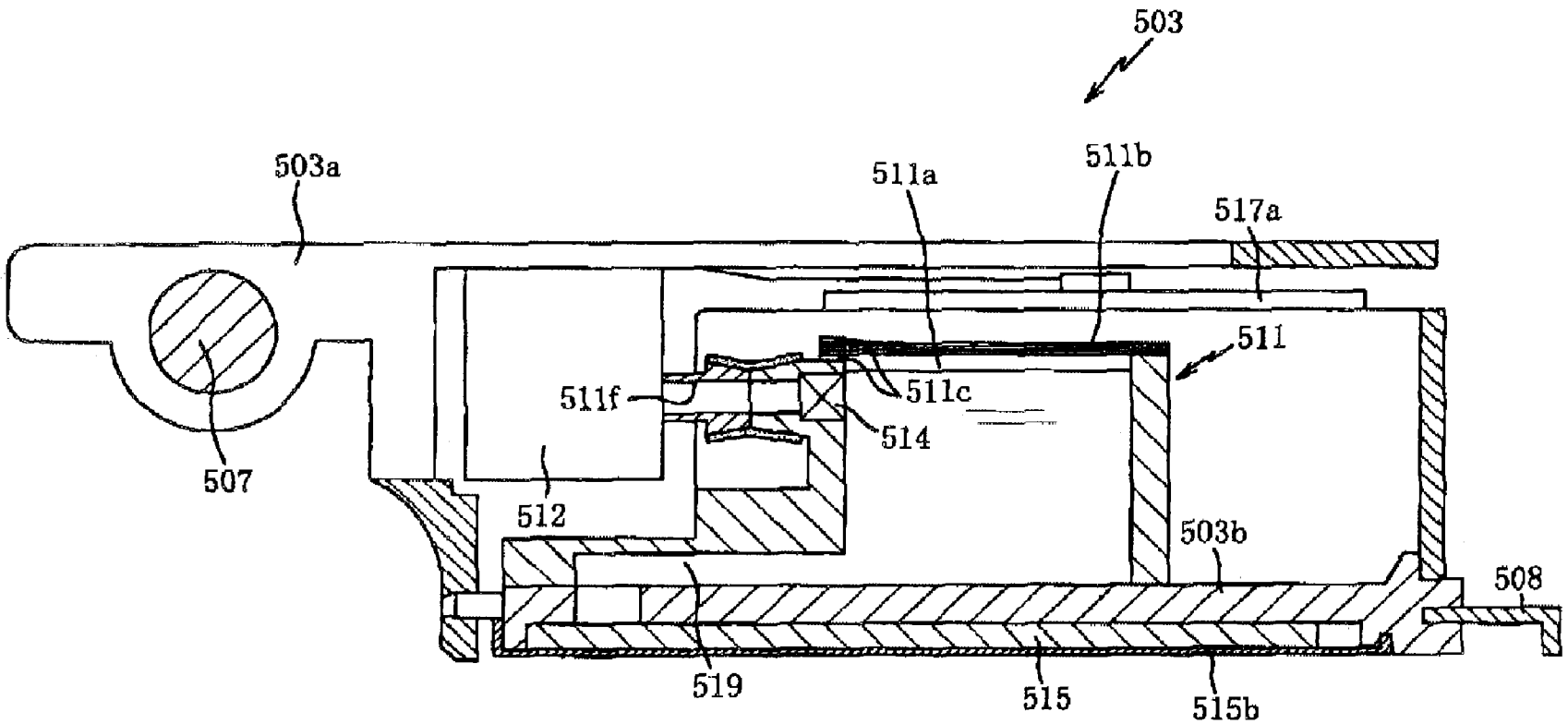
FIG. 24 is a cross-sectional view of the head unit as taken along line 24-24 in FIG. 23.

As shown in FIG. 24, each of the sub tanks 511 has a conducting polymer actuator 511*b* (corresponding to an actuator of a second pressure-feed portion), to which a voltage is applied to perform purging, as described later.

At a leftmost portion of the frame 502, there is disposed the restoring unit 506 that receives the inks as discharged from the recording head 515 in a purging operation. The restoring unit 506 is situated at a position outside a recording area within which the recording head 515 performs recording on the recording medium, and this position corresponds to a retracted position of the head unit 503.

The restoring unit 506 includes a cap 506*a* that is to be opposed to a nozzle surface of the recording head 515 to receive the inks as discharged from the recording head 515, a discharge tube 506*c* for communicating the cap 506*a* with a waste ink container (not shown), and a wiper blade 506*b* that wipes off the inks adhering to the nozzle surface in the purging operation.

When the purging operation is performed using the restoring unit 506, the CR motor 516 is operated to move the carriage 503*a* to a predetermined purging position for the purging operation. When the head unit 503 reaches the purging position, a drive source (not shown) is operated to have the nozzle surface of the recording head 515 opposed to the cap 506*a*, and the conducting polymer actuators 51*b* of the sub tanks 511 are applied with a voltage to discharge the inks into the cap 506*a*.

After the purging operation is terminated, the drive source is operated in a direction opposite to the previous direction in order to separate the cap 506*a* away from the nozzle surface, and a cam mechanism (not shown) is operated to bring the wiper blade 506*b*, which is a plate-like member of rubber, into contact with the nozzle surface. With the nozzle surface in contact with the wiper blade 506*b*, the head unit 503 is slightly moved in a lateral direction of the apparatus 501 so as to wipe off the inks adhering to the nozzle surface by means of the wiper blade 506*b*.

Figure 23:
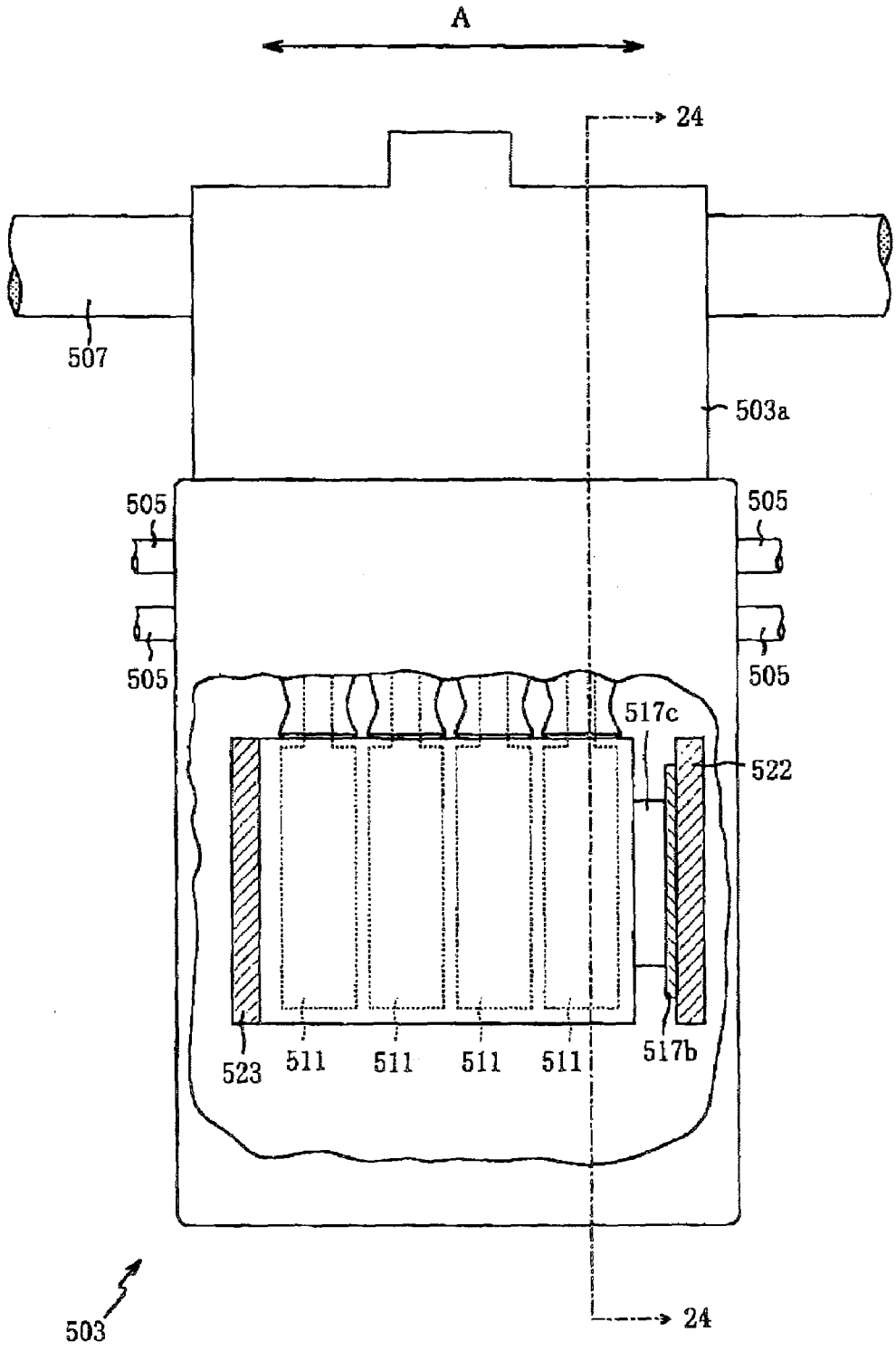
FIG. 23 is a plan view showing an internal structure of a head unit of the recording apparatus.

Referring next to FIGS. 23 and 24, there will be described the head unit 503. FIG. 23 is a cross-sectional view of an internal structure of the head unit 503, and FIG. 24 is a cross-sectional view taken along line 24-24 in FIG. 23. As shown in FIGS. 23 and 24, the head unit 503 includes the recording head 515 supported in such a manner as to be exposed to the exterior at a bottom of the box-shaped carriage 503*a*, four joints 512, and four sub tank units (or airtrap units) 511 each disposed above the recording head 515, and two heatsinks 522, 523 disposed to surround the sub tank units 511.

Each of the four joints 512 is located on the rear side of one of the sub tank units 511 to communicate the corresponding tube 505 with an internal space of the sub tank 511*a* of the sub tank unit 511.

The sub tank units 511 are disposed at the center of a space inside a housing 503*b* (shown in FIG. 24) of the head unit 503. The sub tanks 511*a* in the respective sub tank units 511 store or accumulate bubbles contained in the inks supplied through the tubes 505. That is, a filter or the like (not shown) is disposed in each sub tank unit 511 in order to separate bubbles contained in the ink. The separated bubbles accumulate by its own buoyancy in an upper portion of the sub tank (or buffer tank or airtrap) 511*a* to form an air mass.

An upper wall of the sub tank unit 511 is provided by the conducting polymer actuator 511*b*, and a pair of electrodes 511*c* are disposed at an end of the conducting polymer actuator 511*b*. When a voltage is applied to the electrodes 511*c*, the conducting polymer actuator 511*b* deforms to positively pressurize the fluid, that is, the deformation of the conducting polymer actuator 511*b* pressurizes the air, and then the ink is pressurized via the air, in the sub tank 511*a*. To apply a voltage to the electrodes 511*c*, a driver IC 517*c* (shown in FIG. 26) is connected to the electrodes 511*c*.

An ink introducing passage 611*f* is disposed between each sub tank 511*a* and a corresponding one of the joints 512. That is, the ink is introduced from the joint 512 into the sub tank 511*a* via the ink introducing passage 511*f*. A check valve 514 (corresponding to a reverse flow inhibitor) is disposed in the ink introducing passage 511*f*. The check valve 514 permits flow of the ink in a direction from the joint 512 into the sub tank 511*a*, but inhibits flow of the ink in an opposite direction, namely, from the sub tank 511*a* to the joint 512.

When the purging operation is performed for the recording head 515, a voltage is applied to each pair of electrodes 511*c* in order to deform each conducting polymer actuator 511*b* toward the internal space of the sub tank 511*a*, thereby reducing an inner volume of the sub tank 511*a*. Thus, the ink tends to flow in the direction from the sub tank 511*a* toward the joint 512, but the flow in this direction is inhibited by the check valve 514. Hence, the ink in the sub tank 511*a* is pressure-fed only into the recording head 515. Thus, a pressure loss due to the reverse ink flow is prevented, and the efficiency of the purging operation is accordingly enhanced.

The heatsinks 522, 523 are formed by bending, into an L-like shape, a sheet or plate of a metal having a high thermal conductivity, such as aluminum and copper. The longer segments and the shorter segments of the L-shapes of the heatsinks 522, 523 are respectively opposed to extend in parallel, so that internal corners of the heatsinks 522, 523 are located diagonally to each other. Namely, the heatsinks 522, 523 are assembled to define a substantially rectangular space inside of the heatsinks 522, 533.

An end of a flat portion of the heatsink 522 that corresponds to an upper side of the rectangular space, and an end of a flat portion of the heatsink 523 that corresponds to a lateral side of the rectangular space, are connected to each other, thereby allowing heat transfer therebetween. Between an end of the other flat portion of the heatsink 523 that corresponds to a lower side of the rectangular space, and an end of the other flat portion of the heatsink 522 that corresponds to the other side of the rectangular space, there is disposed the driver IC 517*c* (shown in FIG. 23), thereby allowing heat transfer between each of the heatsinks 522, 523 and the driver IC 517*c*.

The driver IC 517*c* is mounted on a flexible circuit or wiring board 517*b* one of whose two opposite ends is connected to a circuit board 517*a* in the carriage 503*a*. The other end of the flexible circuit or wiring board 517*b* is connected to the recording head 515. The driver IC 517*c* is a drive circuit of a semiconductor integrated circuit that converts print data signals serially transferred from a control circuit board 530 (shown in FIG. 26 and described later) disposed in a main-body of the apparatus 501, into parallel signals corresponding to the respective nozzles, then converts the parallel signals into voltage signals representative of magnitudes of voltage at which driving elements or active portions (corresponding to first pressure-feed portions) provided for the respective nozzles are actuated, and outputs the voltage signals.

The nozzle surface of the recording head 515 is covered by a cover plate 515*b* except open ends of the nozzles, in order to prevent the recording medium contacts the recording head 515 when the recording medium is deformed.

Figure 25:
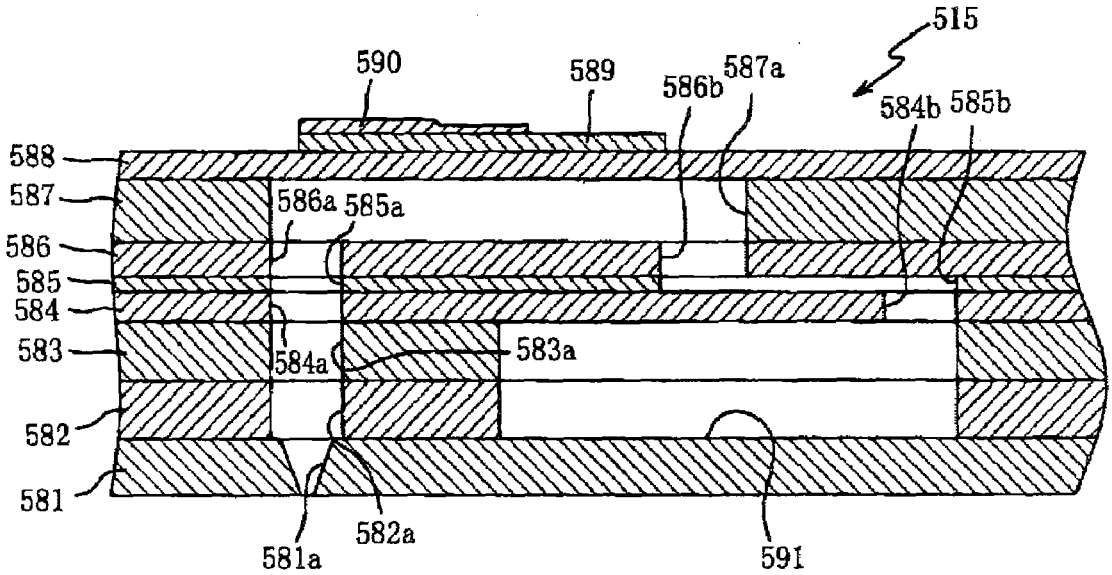
FIG. 25 is a schematic cross-sectional view of an inkjet recording head of the head unit.

Referring next to FIG. 25, there will be described in detail the recording head 515. FIG. 25 is a cross-sectional view schematically showing a structure of the recording head 515. The recording head 515 is a laminate formed by stacking and bonding with an adhesive eight plates one on another. The eight plates are a nozzle plate 581, two manifold plates 582, 583, a spacer plate 584, an aperture plate 585, a base plate 586, a cavity plate 587, and a piezoelectric sheet 588.

The nozzle plate 581 has the nozzles 581*a*. The manifold plates 582, 583 have throughholes 582*a*, 583*a* that communicate the nozzles 581*a* with pressure chambers 587*a* formed in the cavity plate 587, and common ink chambers (corresponding to manifolds) that store the inks supplied from the ink cartridges or the ink tanks 504.

The spacer plate 584 has throughholes 584*a* that communicate the throughholes 583*a* as communication holes formed in the manifold plate 583 with the pressure chambers 687*a*, and the throughholes 584*b* that communicate the common ink chambers with restricting portions 585*b* formed in the aperture plate 585. The aperture plate 585 has throughholes 585*a* that communicate the throughholes 584*a* formed in the spacer plate 584 with the pressure chambers 587*a*, and the restricting portions 585*b* as a large number of ink passages having a small diameter that communicate the common ink chambers with the pressure chambers 587*a*.

The base plate 586 has throughholes 586*a* that communicate the nozzles 581*a* with the pressure chambers 587*a*, and connecting passages 586*b* that communicate the restricting portions 585*b* with the pressure chambers 587*a*. Through the thicknesses of the base plate 586, the aperture plate 585, and the spacer plate 584, ink supply ports (not shown) are formed. The inks from the ink cartridges or the ink tanks 504 are supplied into the common ink chambers formed in the manifold plates 582, 583 through the ink supply ports.

The cavity plate 587 has the pressure chambers 587*a* corresponding to the respective nozzles 581*a*. Each pressure chamber 587*a* has a planar shape extending along the major surfaces of the cavity plate 587.

In the two manifold plates 582, 583 are formed the common ink chambers, that are located in plan view in an area corresponding to an area in which the pressure chambers 587*a* are arranged in the cavity plate 587. Further, the common ink chambers are located in side view closer to the nozzles 581*a* formed in the nozzle plate 581 than the pressure chambers 587*a*.

In the thus constructed recording head 515, the inks as supplied from the ink cartridges 504 into the common ink chambers through the ink supply ports (not shown) are distributed to the pressure chambers 587*a* via the restricting portions 585*b*. Then, the inks flow from the pressure chambers 587*a* to the respectively corresponding nozzles 581*a* via the throughholes 586*a*, 585*a*, 584*a*, 583*a*, 582*a*.

On an upper surface of the piezoelectric sheet 588, drive electrodes 589 are disposed at respective positions corresponding to the pressure chambers 587*a*. On the drive electrodes 589 are disposed contact lands 590 that are connected to the driver IC 517*c* through the flexible circuit or wiring board 517*b*. Each of the drive electrodes 589 and a piezoelectric sheet 588 cooperate to form one of the active portions. When a voltage is applied to each of the drive electrodes 589, a corresponding one of the pressure chambers 587*a* is pressurized, thereby ejecting a droplet of the ink from the corresponding nozzle 581*a*.

Figure 26:
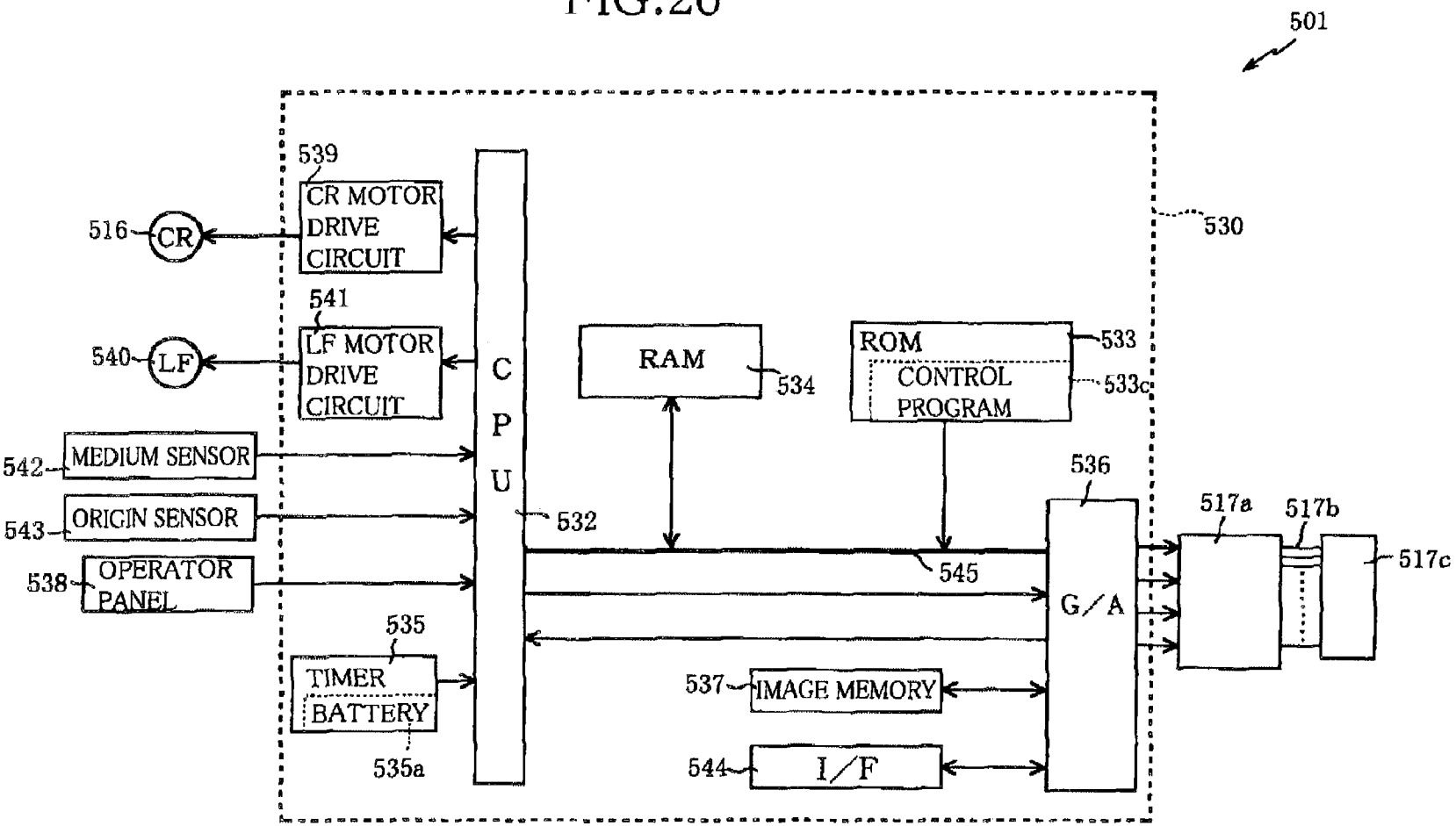
FIG. 26 is a block diagram of an electrical structure of the recording apparatus.

Referring now to FIG. 26, there will be described a configuration of an electrical circuit of the inkjet recording apparatus 501 constructed as described above. FIG. 26 is a schematic block diagram of the electrical circuit configuration. A controller for controlling the inkjet recording apparatus 501 includes the control circuit board 530 in the mainbody of the inkjet recording apparatus 501, and the circuit board 517*a* mounted in the carriage. The control circuit board 530 in the mainbody includes a one-chip microcomputer (CPU) 532, a ROM 533 storing various control programs executed by the CPU 532 and data of various fixed values, a RAM 534 as a memory for temporarily storing various data, a timer 535, an image memory 537, and a gate array (G/A) 536, for instance.

The CPU 532 as a computing unit operates to control various kinds of processing such as that of the purging operation, in accordance with a control program 533*a* stored in the ROM 533. The CPU 532 generates print timing signals and reset signals that are transferred to the gate array 536 (described later). To the CPU 532 are connected an operator panel 538 through which a user inputs instructions such as an instruction to perform recording, a CR motor drive circuit 539 for driving a carriage motor (CR motor) 516 that laterally moves the head unit 503, a LF motor drive circuit 541 for driving a line feed motor (LF motor) 540 that feeds the recording medium, a medium sensor 542 for detecting a leading end of the recording medium, and an origin sensor 543 for detecting an original position of the head unit 503. Operation of these connected devices is controlled by the CPU 532.

The timer 535 counts the time, such as date, and has a battery 535*a* in order that the timer 535 can keep counting the time even while the inkjet recording apparatus 501 is shut off from a power source. The timer 535 is reset each time a second actuator (described later) is operated in the purging operation. The time counted by the timer 535 is read when the inkjet recording apparatus 501 is powered on, or cyclically at predetermined time intervals. When the time counted is longer than a predetermined threshold, purging is performed by applying the conducting polymer actuator 511*b* with a voltage at a value adjusted such that the longer the counted or elapsed time is, the higher the voltage applied to the conducting polymer actuator 511*b* is.

Based on the print timing signals transferred from the CPU 532 and the image data stored in the image memory 537, the gate array 536 outputs print data based on which an image of the image data is recorded on the recording medium, transfer clock signals synchronized with the print data, latch signals, parameter signals based on which basic print waveform signals are generated, and ejection timing signals cyclically outputted. These signals are transferred to the circuit board 517*a* that then transfers these signals to the driver IC 517*c* through the flexible circuit or wiring board 517*b*. The driver IC 517*c* accordingly drives the recording head 515, to eject ink droplets therefrom.

When the purging operation is performed, the CPU 532 transfers control signals to the gate array 536, which transfers signals corresponding to the received control signals to the driver IC 517*c* via the circuit board 517*a* and the flexible circuit or wiring board 517*b*. The driver IC 517*c* applies the voltage as set by the CPU 532 to the electrodes 511*c* of the conducting polymer actuator 511*b*.

The gate array 536 stores in the image memory 537 the image data as received from an external device such as a host computer via a USB interface 544, and generates data reception interrupt signals based on the image data. The interrupt signals are transferred to the CPU 532.

Figure 27A:
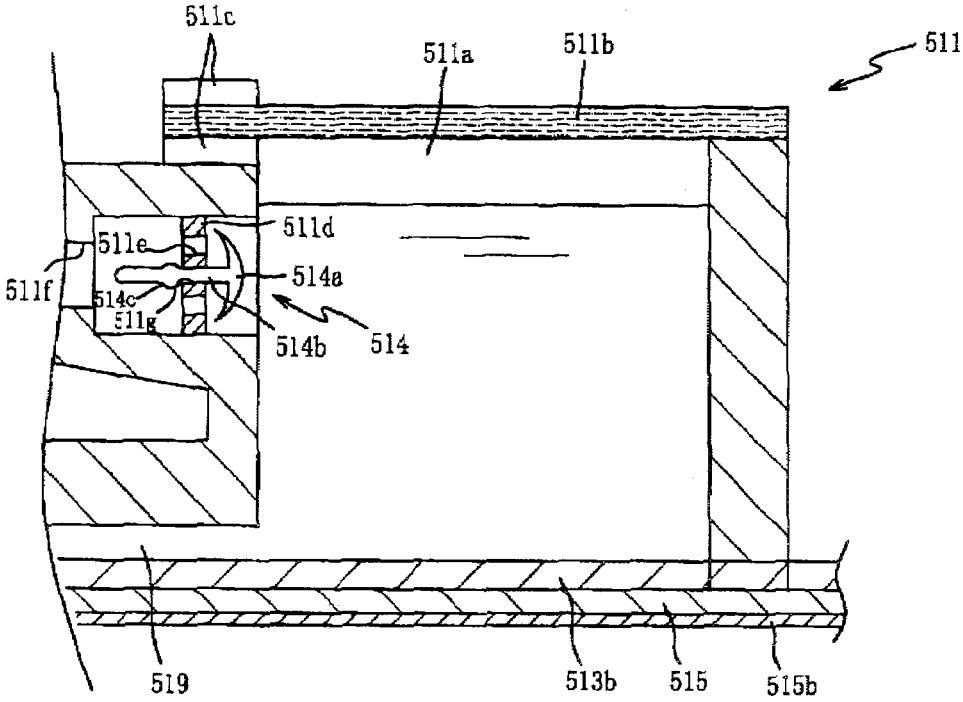
Figure 27B:
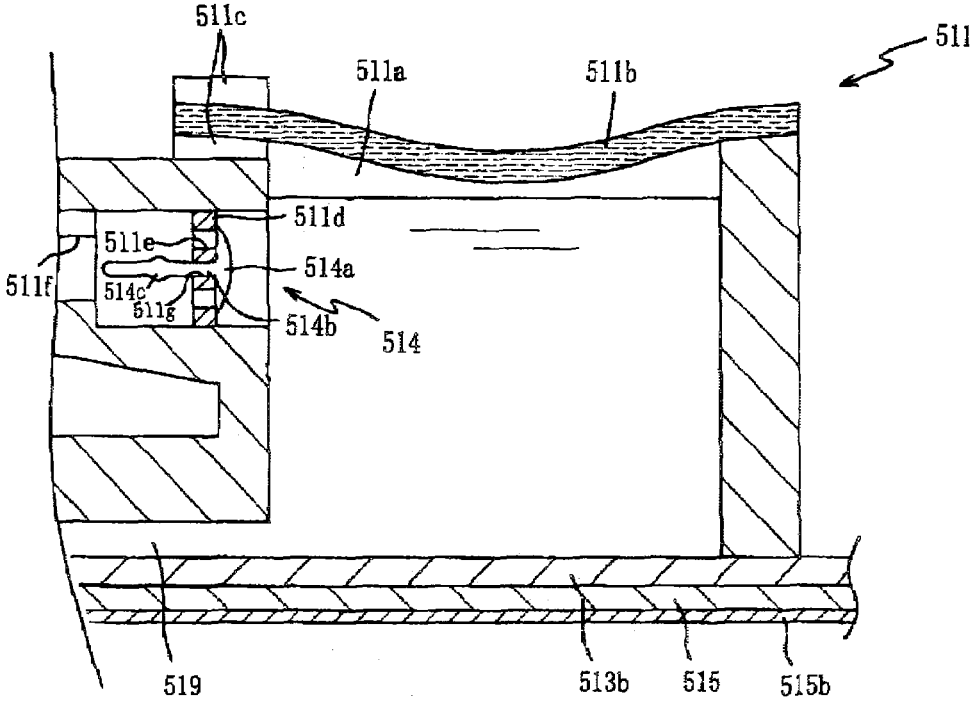

Referring now to FIGS. 27A and 27B, there will be described in detail the check valve 514 and the sub tank unit 511. FIGS. 27A and 27B are cross-sectional views of the check valve 514 and the sub tank unit 511. In each ink introducing passage 511*f*, a partition wall 511*d* is disposed. The partition wall 511*d* has a major surface perpendicular to the flow of the ink through the ink introducing passage 511*f*. Through the partition wall 511*d*, there are formed a shaft hole 511*g* through which a shaft portion 514*b* of a check valve 514 is slidably inserted, and a plurality of ink inlets 511*e* around the shaft hole 511*g*.

The check valve 514 is integrally formed of an elastic resin material to include a thin-film dish-like portion 514*a* whose surface is opposed to the ink inlets 511*e*, and the shaft portion 514*b* connected to the thin-film dish-like portion 514*a*. There is a thickened portion 514*c* in the shaft portion 514*b*. The shaft portion 514*b* is slidably inserted through the shaft hole 511*g* formed in the partition wall 511*d*, and normally engages at the thickened portion 514*c* with the partition wall 511*d* to establish a state where the dish-like portion 514*a* is separated from the ink inlets 511*e*.

Hence, in the normal state, the ink can flow from the ink introducing passage 511*f* into the sub tank 511*a* through the ink inlets 511*e*.

On the other hand, when flow of the ink in the direction from the sub tank 511*a* back to the ink introducing passage 511*f* occurs, the dish-like portion 514*a* is pushed to be brought into close contact with the partition wall 511*d* to close the ink inlets 511*e*, thereby inhibiting the ink flow in the reverse direction.

FIG. 27A shows the normal state or non-operated state where a voltage is not applied to the conducting polymer actuator 511*b*, and the dish-like portion 514*a* of the check valve 514 is held off the partition wall 511*d*. On the other hand, FIG. 27B shows the state where the inner volume of the sub tank 511*a* is reduced with the conducting polymer actuator 511*b* deformed by application of the voltage thereto. In the latter state, the internal pressure of the sub tank 511*a* is increased, and the dish-like portion 514*a* of the check valve 514 closely contacts the partition wall 511*d* to close the ink inlets 511*e*. Hence, the ink in the sub tank 511*a* is supplied to the recording head 515 via a communicating passage 519.

Figure 28A:
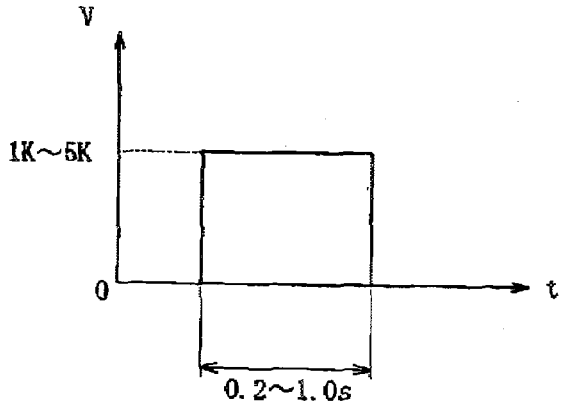
FIG. 28A presents a voltage as applied to the conducting polymer actuator.
Figure 28B:
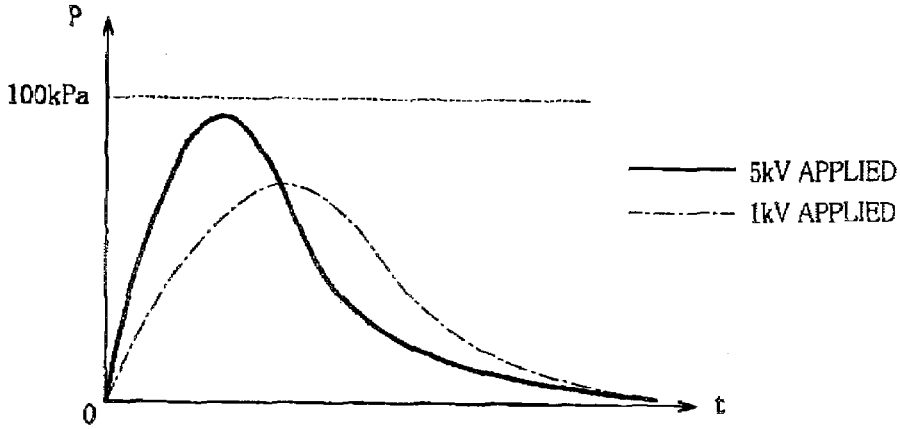
FIG. 28B represents change in the internal pressure of the sub tank when each of voltages 5 kV and 1 kV is applied to the conducting polymer actuator.

Referring next to FIGS. 28A and 28B, there will be described the change in the internal pressure of the sub tank 511*a* upon application of a voltage on the conducting polymer actuator 511*b*. FIG. 28A shows the voltage applied to the conducting polymer actuator 511*b* versus time length, and FIG. 28B is a graph representing the change in the internal pressure of the sub tank 511*a* upon application of the voltage on the conducting polymer actuator 511*b*.

In the graph of FIG. 28A, the abscissa represents time length, and the ordinate represents the voltage (unit: volt V) applied to the conducting polymer actuator 511*b*, that is, a constant voltage of 1 kV to 5 kV is applied for 0.2-1.0 seconds in a rectangular waveform.

In the graph of FIG. 28B, the abscissa represents time, and the ordinate represents the internal pressure P (unit: pascal Pa) of the sub tank 511*a*. The solid line represents the change in the internal pressure P when a voltage of 5 kV is applied to the conducting polymer actuator 511*b*, and the chain line represents the change in the internal pressure P when a voltage of 1 kV is applied.

Where a thickness of the conducting polymer actuator 511*b* is 0.1-1.0 mm, a gas volume of the sub tank 511*a* is about 0.1 cc, and an amount of deformation of the conducting polymer actuator 511*b* is about 50% of the gas volume, a peak pressure Δp of the sub tank 511*a* is 1 atm (which equals 1 atmosphere), since P·V is constant and the following equation is established:

$$0.1\ \text{cc} \times 1\ \text{atm} = 0.05\ \text{cc} \times (1\ \text{atm} + \Delta p).$$

However, since the ink is discharged from the nozzles 581*a* as the conducting polymer actuator 511*b* deforms, the peak value varies depending on the voltage applied to the conducting polymer actuator 511*b*. As shown in FIG. 28B, the higher the voltage applied to the conducting polymer actuator 511*b* is, the more abrupt the rise of the internal pressure of the sub tank 511*a* is and the larger the peak value becomes. Conversely, the lower the voltage applied to the conducting polymer actuator 511*b* is, the less abrupt the rise of the internal pressure of the sub tank 511*a* is, and the smaller the peak value becomes.

Hence, as the voltage applied to the conducting polymer actuator 511*b* increases, the ink in the sub tank is abruptly pressurized, and the applied pressure is transmitted to the ink in the recording head 515, thereby discharging the ink from the nozzles 581*a*.

Figure 29:
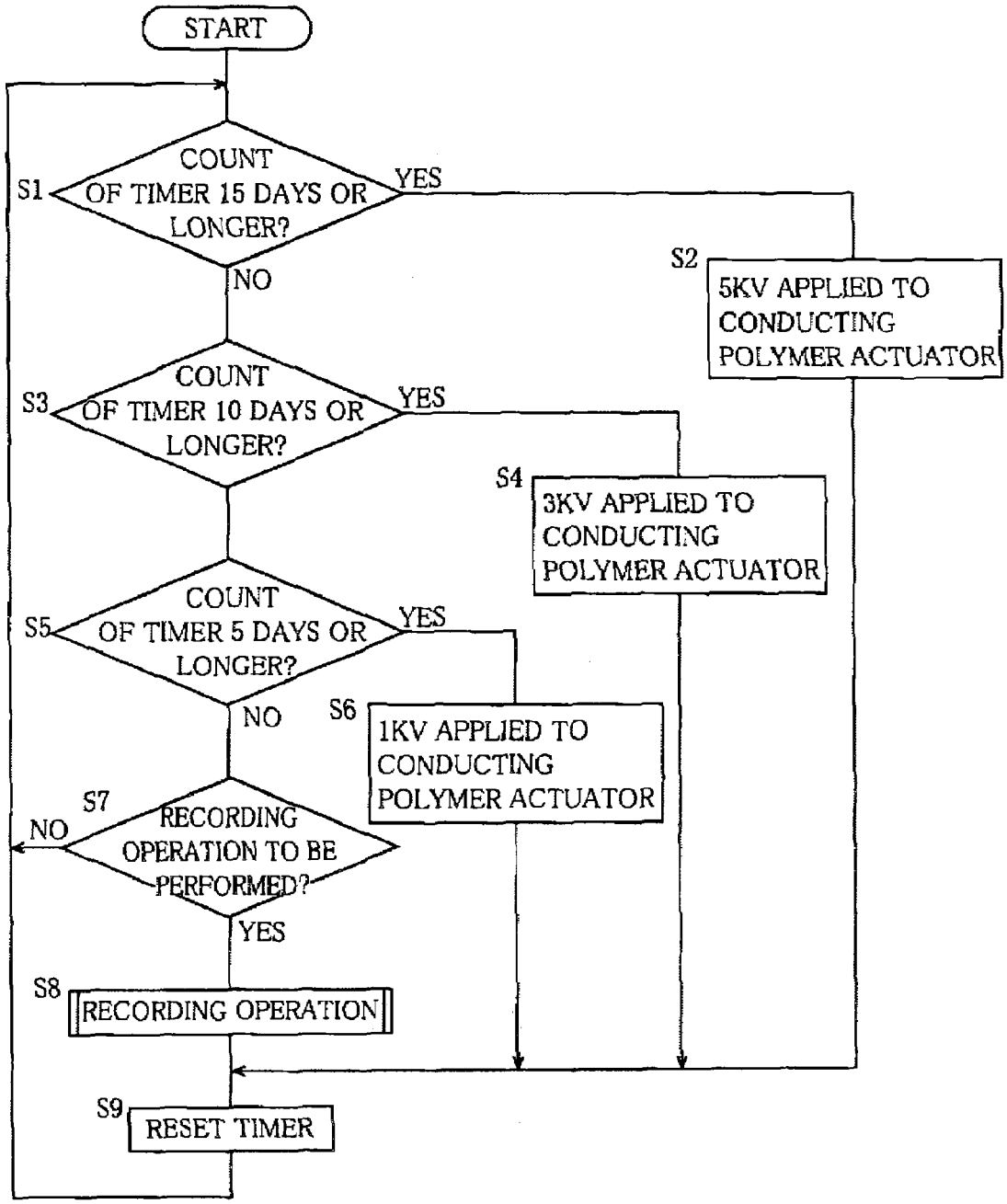
FIG. 29 is a flowchart illustrating a program of a recording operation implemented in the recording apparatus.

There will be now described the purging operation, by referring to a flowchart of FIG. 29 illustrating processing implemented by the CPU 532 in the purging operation. The processing of the purging operation is activated when the inkjet recording apparatus 501 is powered on. The processing of the purging operation is initiated with step S1 in which it is determined whether the count of the timer 535 is 15 days or longer. When it is determined that the count of the timer 535 is 15 days or longer, that is, when an affirmative decision (YES) is obtained in step S1, there is a high possibility that the performance of the recording head to eject ink droplets is deteriorated, and thus the flow goes to step S2 to apply a voltage of 5 kV to the conducting polymer actuator 511*b*. Hence, the internal pressure of the sub tank 511*a* is abruptly raised, thereby powerfully discharging the ink from the nozzles.

When the count of the timer 535 is under 15 days, that is, when a negative decision (NO) is obtained in step S1, the flow goes to step S3 to determine whether the count of the timer 535 is ten days or longer. When the count of the timer is ten days or longer, that is, when an affirmative decision (YES) is obtained in step S3, the flow goes to step S4 to apply a voltage of 3 kV to the conducting polymer actuator 511*b*. The internal pressure of the sub tank 511*a* is accordingly raised, thereby discharging the ink form the recording head.

When the count of the timer 535 is under ten days, that is, when a negative decision (NO) is obtained in step S3, the flow goes to step S5 to determine whether the count of the timer 535 is five days or longer. When the count is five days or longer, that is, when an affirmative decision (YES) is obtained in step S5, the flow goes to step S6 to apply a voltage of 1 kV to the conducting polymer actuator 511*b*. The internal pressure of the sub tank 511*a* is accordingly raised, and the ink is discharged.

When the count of the timer 535 is under five days, that is, when a negative decision (NO) is obtained in step S5, the flow goes to step S7 to determine whether the print data based on which the recording is to be performed has been received. When it is determined that the print data has been received, that is, when an affirmative decision is obtained in step S7, the flow goes to step S8 to perform the recording by pressurizing the pressure chambers 587*a* by applying voltage to the drive electrodes 589 of the actuators formed in the recording head 515, in accordance with the print data. When it is determined that the print data has not been received, that is, when a negative decision (NO) is obtained in step S7, the flow returns to step S1.

When the recording in step 88 and the purging operation in step S2, S4 and S6 have been performed, the flow goes to step S9 to reset the count of the timer 535 to 0, and then returns to step S1.

A portion of the controller that operates to make the selection of the voltage to be applied to the conducting polymer actuator 511*b* corresponds to a voltage changer, and a portion of the controller that operates to increase the voltage to be applied to the actuator with increase in the time counted by the timer corresponds to a voltage increasing portion.

It may be arranged such that the timer 535 is provided for each of the sub tank units, and the purging operation is performed for the sub tanks independently of one another.

As described above, the recording apparatus 501 of the thirteenth embodiment includes the sub tank 511*a* that stores the ink supplied from the ink cartridge or ink tank 504, and a part of the sub tank 511*a* is defined by the conducting polymer actuator 511*b*, in other words, the upper wall of the sub tank 511*a* is constituted by the conducting polymer actuator 511*b*, which is deformed by an amount larger than that of the driving element or active portions of the recording head, while the check valve 514 corresponding to a reverse flow inhibitor is disposed in the ink introducing passage 511*f* through which the ink is introduced into the sub tank from the main tank or the ink cartridge, in order to inhibit the reverse flow of the ink. Hence, the purging operation can be implemented by applying a voltage to the conducting polymer actuator 511*b*, thereby omitting a pump conventionally required for the purging operation, and downsizing the inkjet recording apparatus 501. The sub tank 511*a*, essentially having a function to accumulate and store the bubbles contained in the ink as supplied from the main tank and bubbles generated in the ink introducing passage 511*f*, can also serve to implement the purging operation, thereby reducing the manufacturing cost and size of the apparatus. Further, the pressure applied to the ink in the sub tank is made stable. The arrangement that the voltage applied to the conducting polymer actuator 511*b* is selectable among a plurality of values enables a purging operation optimum for the state of use of the inkjet recording apparatus 501. The noise generated by the deformation of the conducting polymer actuator 511*b* is low compared to the noise generated by a conventional pump or the like for the purging. The present inkjet recording apparatus can be produced by improving the conventional inkjet recording apparatus, and thus does not involve increase in the manufacturing cost. Since the sub tanks are provided for respective inks of different colors, the purging operation can be selectively implemented depending on the state of use of the respective inks. Since the value of the voltage applied to the conducting polymer actuator is varied so that the pressure applied to the ink in the sub tank is varied according to the time that has elapsed since the ink ejection or discharge was last performed, the voltage can be applied to the ink at an appropriate value in the purging operation. Since the material forming the conducting polymer actuator is available easily and at low cost, the purging mechanism can be produced inexpensively.

In the thirteenth embodiment, when a recording operation or a purging operation is performed, the timer 535 is reset to restart count of the time. However, the timer may be one like a clock that indicates the absolute time. In this case, the time when a recording or purging operation is implemented is stored in a non-volatile memory such as EEPROM, and the time elapsed since then is calculated by making a comparison between the current time and the stored time.

The conducting polymer actuator 511*b* may be formed of bio-metal or artificial muscle.

Fourteenth Embodiment

Figure 30A:
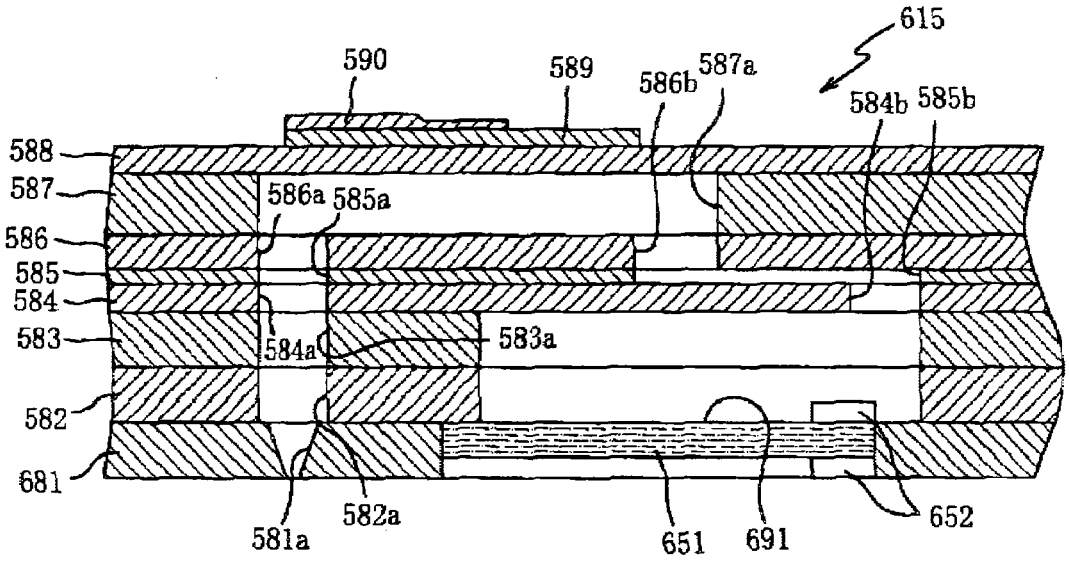
FIGS. 30A and 30B are cross-sectional views of a recording head in an inkjet recording apparatus according to a fourteenth embodiment of the invention.
Figure 30B:
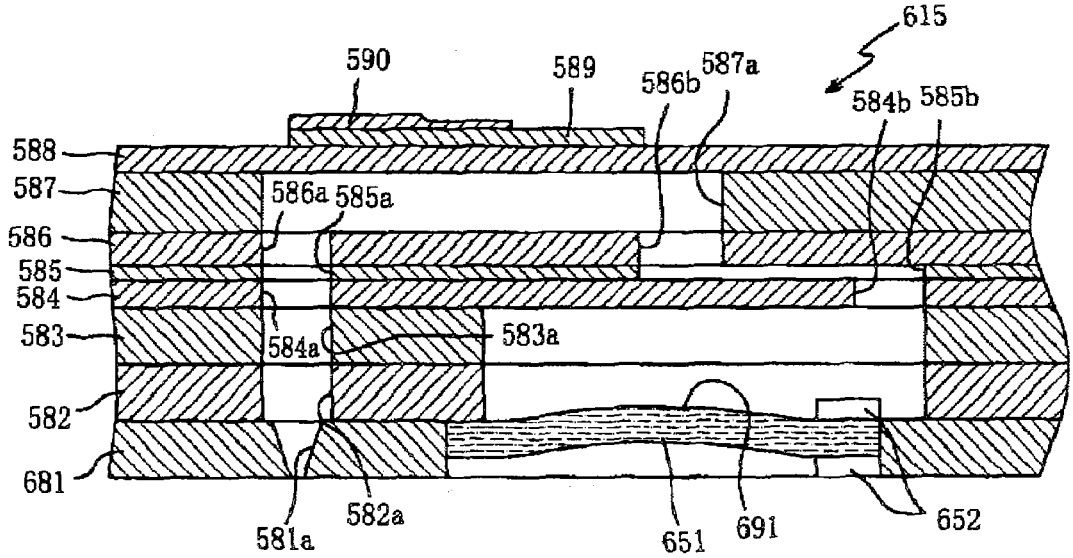

There will be now described an inkjet recording apparatus according to a fourteenth embodiment of the invention, by referring to FIGS. 30A and 30B. Only a part different from the thirteenth embodiment will be described. The elements or parts corresponding to those in the thirteenth embodiment will be denoted by the same reference numerals and description thereof is omitted.

According to the fourteenth embodiment, a sub tank 611*a* does not have the conducting polymer actuator 511*b* as used in the thirteenth embodiment. However, a recording head 615 of the inkjet recording apparatus of the fourteenth embodiment is constructed such that a conducting polymer actuator 551 and a pair of electrodes 552 are disposed at a bottom of each of common ink chambers formed in two manifold plates 582, 583. The electrodes 652 are connected to a driver IC 517*c* and controlled by a CPU 532, similarly to the thirteenth embodiment.

In the fourteenth embodiment, a check valve 614 (shown in FIG. 31) is disposed in a communicating passage 519 that communicates a sub tank 611*a* with the recording head 615. The check valve 614 allows flow of ink in a direction from the sub tank 611*a* to the recording head 615, but inhibits flow of the ink in the reverse direction, that is, from the recording head 615 to the sub tank 611*a*.

FIG. 30A is a cross-sectional view of the recording head 615 in a normal or non-operated state, and FIG. 30B shows a state where the conducting polymer actuator 651 is deformed upon application of a voltage to the conducting polymer actuator 651 in a purging operation.

In the fourteenth embodiment, the conducting polymer actuators 651 are disposed at the common ink chambers formed in the recording head 615, and the purging can be implemented by applying a voltage to the conducting polymer actuator 651. In other words, in the fourteenth embodiment, the common ink chambers correspond to temporary storing chambers and function in a similar way as the sub tanks in the thirteenth embodiment. Thus, the pump conventionally required for the purging operation is omitted, thereby reducing the size of the inkjet recording apparatus, similarly to the thirteenth embodiment. By adjusting the voltage applied to the conducting polymer actuator 651, a purging operation optimum for the state of use of the inkjet recording apparatus is enabled. Further, since a mechanism for the purging is formed inside the recording head, a portion of an ink communication passage which portion is between the main tank and the ink supply port of the inkjet recording head can be produced at low cost.

The conducting polymer actuator 651 may be formed of bio-metal or artificial muscle.

Although there have been described the presently preferred embodiments of the invention, the invention is not limited to the details of the embodiments, but it is to be understood that the invention may be embodied with various other changes and modifications, without departing from the scope and spirit of the invention.

Figure 32:
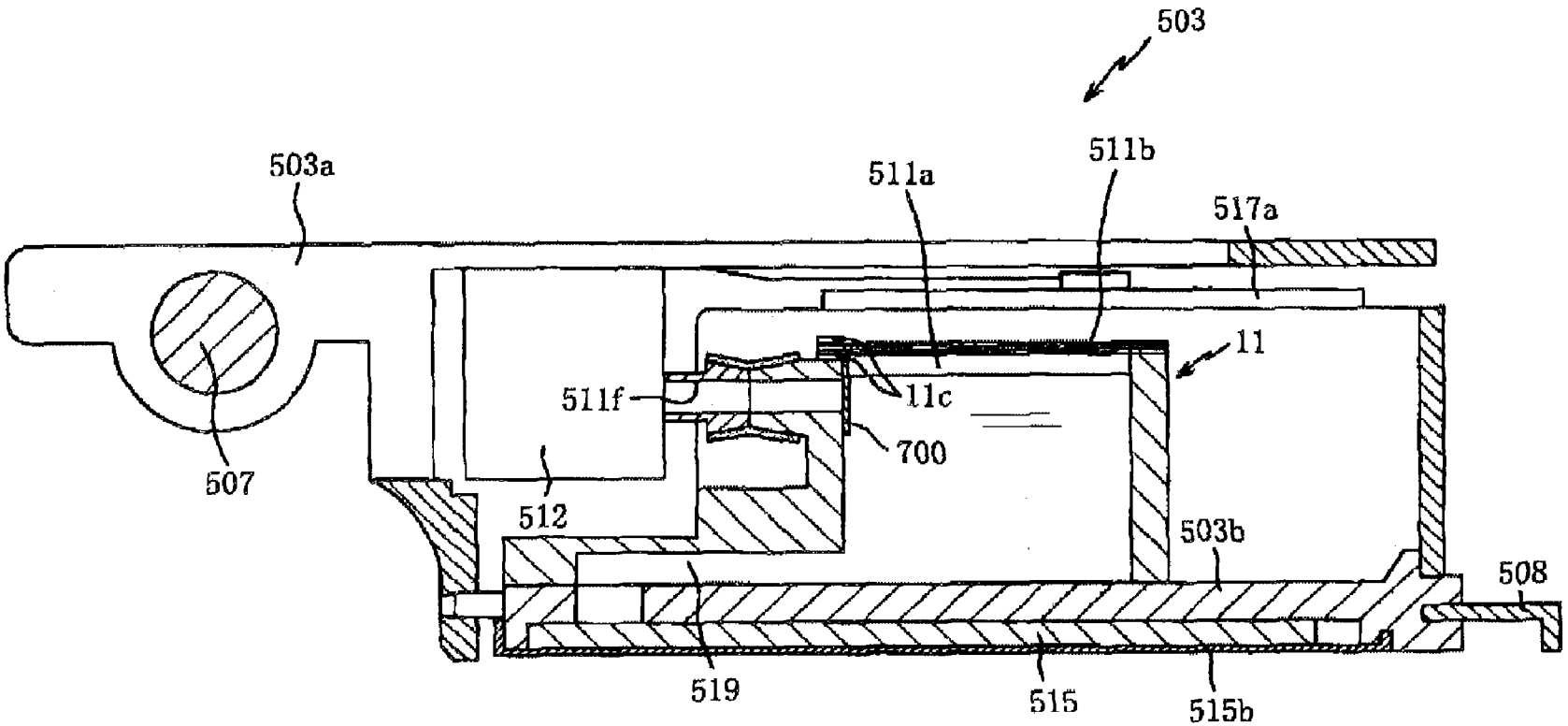
FIG. 32 is a cross-sectional view of a head unit of an inkjet recording apparatus according to a fifteenth embodiment of the invention.
Figure 33:
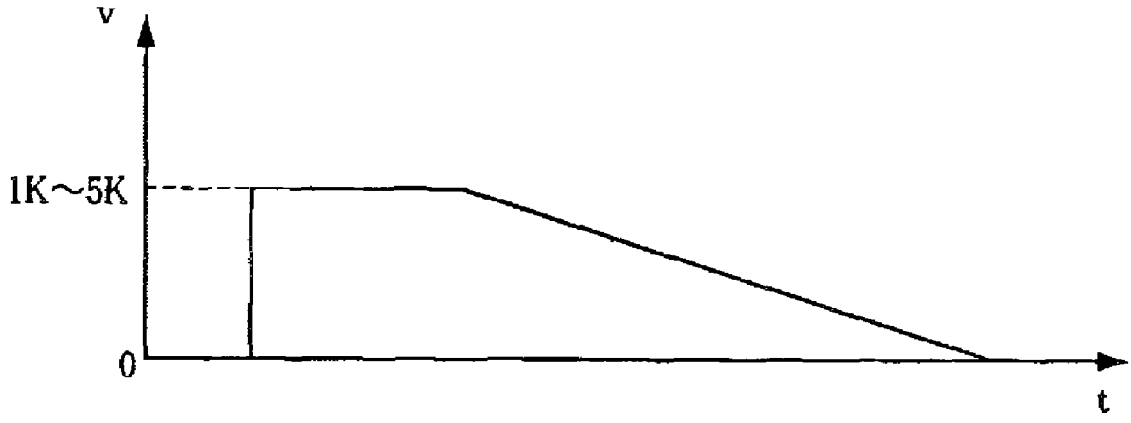
FIG. 33 presents a voltage as applied to the conducting polymer actuator versus time.
Figure 34:
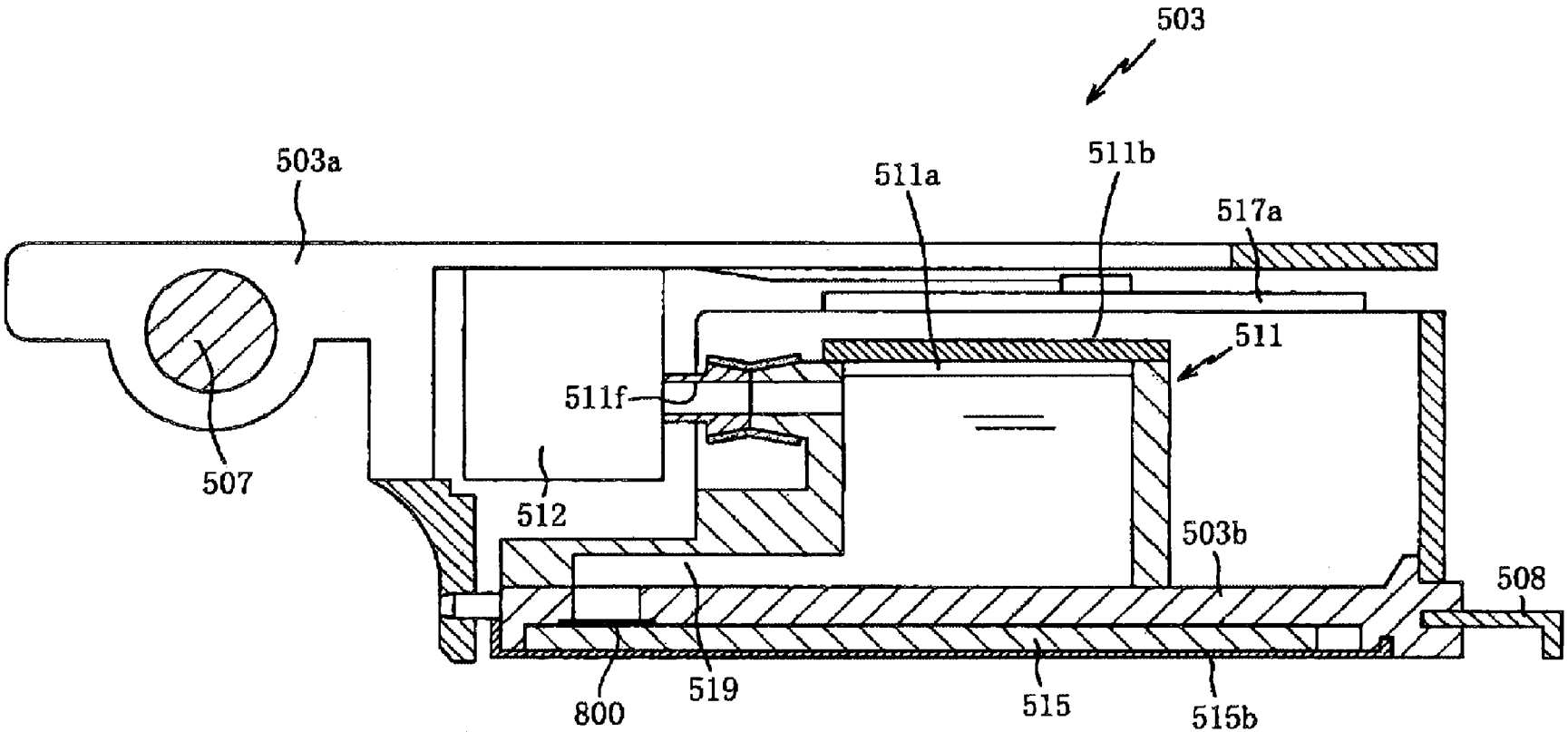
FIG. 34 is a cross-sectional view of a head unit of an inkjet recording apparatus according to a sixteenth embodiment of the invention.

For instance, in the embodiment of FIG. 24, the check valve 514 is disposed between the sub tank 511*a* and the joint 512. However, the check valve 514 may be replaced with a flow restrictor (corresponding to a flow resistance generator) 700 such as filter or multihole plate member as shown in FIG. 32. In this case, it is desirable that the voltage applied to the conducting polymer actuator 511*b* is abruptly increased and slowly decreased, as shown in FIG. 33. According to this arrangement, the conducting polymer actuator 511*b* is abruptly deformed toward the internal space of the sub tank 511*a*, in turn abruptly decreasing the inner volume of the sub tank 511*a* as a pressure chamber. Thus, the ink tends to flow from the sub tank 511*a* toward the joint 512 as well as toward the inkjet recording head 515. However, since the flow restrictor 700 gives a flow resistance that becomes larger as the speed of the ink flow increases, the internal pressure in the sub tank 511*a* is sufficiently raised, thereby allowing a sufficient amount of the ink to flow into the recording head 515, from which the ink is discharged. The purging is thus performed. Thereafter, the voltage is gently decreased in order to slowly restore the conducting polymer actuator 511*b* to its original flat shape, thereby increasing the inner volume of the sub tank 511*a* at a low speed. This entails introduction of the ink into the sub tank 511*b* from the joint 512, but since the speed of the introduced ink is relatively low, the flow resistance given by the flow restrictor 700 is relatively small and the internal pressure of the sub tank 511*a* does not much decrease. Hence, the meniscuses of the ink formed in the nozzles 581*a* of the recording head 515 are maintained.

Figure 31:
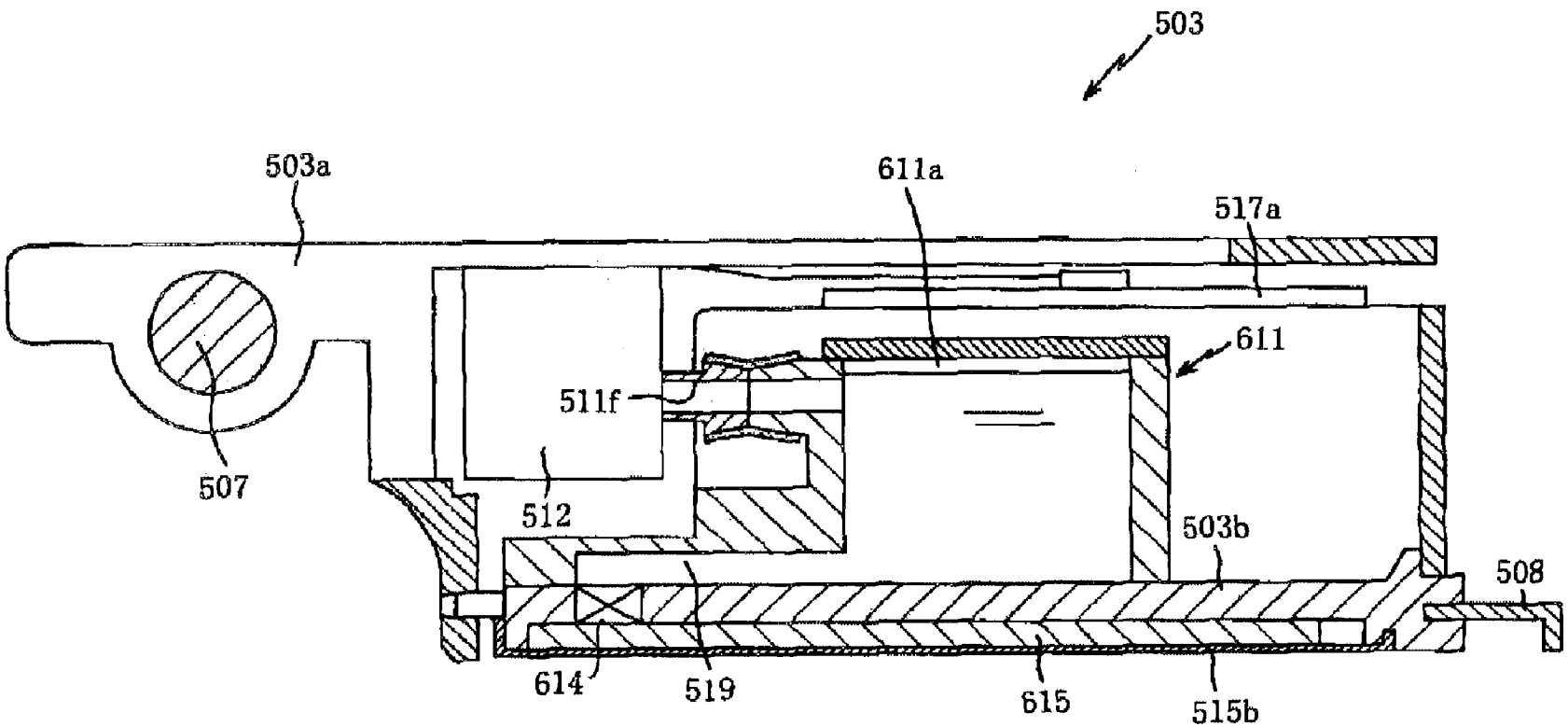
FIG. 31 is a cross-sectional view of a head unit of the inkjet recording apparatus.

Further, in the embodiment shown in FIG. 31, the check valve 614 is disposed in the communicating passage 615 between the sub tank 611*a* and the inkjet recording head 615. However, the check valve 614 may be replaced with a flow restrictor 800 (corresponding to a flow resistance generator). In this case, too, it is desirable that the voltage applied to the conducting polymer actuator 511*b* is abruptly increased and gently decreased, in order to obtain the same operation and effect as in the embodiment shown in FIG. 31.

In each of the above-described embodiments, the inkjet recording head is mounted on the carriage and laterally moved. However, the principle of the invention is applicable to an inkjet recording apparatus in which the recording head is fixed in position.

The timing the purging operation is to be implemented is not limited to those in the above-described embodiments, but may be set as desired. For instance, the purging operation may be implemented each time a predetermined time has elapsed from the last implemented purging operation, or each time a predetermined number of times the recording operation has been implemented. Alternatively, the purging operation may be implemented cyclically and irrespectively of implementation of the recording operation.

It is to be understood that the invention is applicable not only to the inkjet recording apparatus as described above, but may be applied to various types of liquid droplet ejecting apparatuses in which a liquid stored in a sub tank is ejected in the form of droplets from a nozzle, for instance: a soldering machine that automatically performs soldering on various printed wiring boards or others by ejecting a molten solder from a nozzle; an apparatus that is used in manufacturing of an organic EL display and forms an organic film by ejecting a polymer organic EL material in a manner like in an inkjet recording head; and an apparatus for ejecting resin in the form of a slurry from a nozzle.

What is claimed is:

1. A liquid droplet ejecting apparatus comprising:

a tank storing a liquid;

a nozzle from which the liquid is ejected in the form of a droplet;

a first pressure-feed portion which is disposed between the tank and the nozzle, and pressure-feeds the liquid as supplied from the tank, to eject the liquid droplet from the nozzle;

a second pressure-feed portion which has an inner volume larger than that of the first pressure-feed portion, and is disposed between the tank and the first pressure-feed portion, the second pressure-feed portion pressure-feeding the liquid as supplied from the tank to the nozzle via the first pressure-feed portion, to eject the liquid from the nozzle in an amount larger than an amount of the liquid ejected by the first pressure-feed portion as the liquid droplet; and the second pressure-feed portion including:

a pressure chamber;

a pressurizing member that pressurizes the liquid in the pressure chamber by decreasing an inner volume of the pressure chamber; and a liquid communication passage which holds the tank and the nozzle in communication with each other via the pressure chamber, and which includes a flow resistance generator which is disposed in at least one of a portion of the liquid communication passage between the tank and the pressure chamber, and a portion of the liquid communication passage between the pressure chamber and the nozzle, the flow resistance generator giving a flow resistance to the liquid as flowing in the at least one of the two portions of the liquid communication passage.

2. The liquid droplet ejecting apparatus according to claim 1, wherein the second pressure-feed portion comprises:

a cylinder;

the pressurizing member being slidably fitted in the cylinder such that the pressurizing member forms on a front side thereof the pressure chamber and is capable of advancing and retracting; and the liquid communication passage including an upstream portion through which the tank and the pressure chamber are held in communication with each other via the flow resistance generator.

3. The liquid droplet ejecting apparatus according to claim 2, wherein the pressurizing member is a piston loosely fitted in the cylinder, and the flow resistance generator included in the upstream portion of the liquid communication passage is constituted by a clearance between an external circumferential surface of the piston and an internal circumferential surface of the cylinder.

4. The liquid droplet ejecting apparatus according to claim 3, wherein the pressure chamber has a liquid supply port communicated with the nozzle, and a multihole member which gives a flow resistance to the liquid flowing through the liquid supply port is disposed at the liquid supply port, the multihole member constituting the flow resistance generator.

5. The liquid droplet ejecting apparatus according to claim 3, wherein the cylinder has an introducing hole which is formed in an axially intermediate portion of the cylinder to be in communication with the clearance, and through which the liquid is introduced from a space which is in communication with the tank, into the cylinder.

6. The liquid droplet ejecting apparatus according to claim 2, wherein the pressurizing member is constituted by a throughhole member having at least one throughhole formed through the throughhole member in an axial direction thereof, and the throughhole member constitutes the flow resistance generator.

7. The liquid droplet ejecting apparatus according to claim 2, wherein the pressurizing member is constituted by a throughhole member having a plurality of throughholes, each of which is formed through the throughhole member in an axial direction thereof, and which have a same cross-sectional area, and the throughhole member constitutes the flow resistance generator.

8. The liquid droplet ejecting apparatus according to claim 7, wherein the throughholes are a plurality of pairs of throughholes, each pair being arranged symmetrically with respect to an axis of the throughhole member.

9. The liquid droplet ejecting apparatus according to claim 2, wherein the pressurizing member is constituted by a porous member having a large number of throughholes each formed through the throughhole member in an axial direction thereof, and the porous member constitutes the flow resistance generator.

10. The liquid droplet ejecting apparatus according to claim 2, wherein the tank serves as a main, tank, and the apparatus further comprises a temporary storing chamber disposed between the tank and the nozzle and the cylinder is fixed to the temporary storing chamber.

11. The liquid droplet ejecting apparatus according to claim 2, wherein the tank serves as a main tank, the apparatus further comprises a temporary storing chamber disposed between the tank and the nozzle, the pressurizing member is fitted in the temporary storing chamber such that the pressurizing member is slidable on the temporary storing chamber, and the temporary storing chamber constitutes the cylinder.

12. The liquid droplet ejecting apparatus according to claim 11, wherein the temporary storing chamber has an elongate cross-sectional shape whose contour is constituted by a smooth curve, and the pressurizing member has a cross-sectional shape the same as that of the temporary storing chamber.

13. The liquid droplet ejecting apparatus according to claim 1, further comprising a pressurizing-member driving device which advances the pressurizing member at a first speed and retracts the pressurizing member at a second speed lower than the first speed.

14. The liquid droplet ejecting apparatus according to claim 3, wherein the pressurizing-member driving device includes a biasing device which biases the pressurizing member in a retracting direction in which the pressurizing member is retracted.

15. The liquid droplet ejecting apparatus according to claim 14, wherein a biasing force of the biasing device is set at a value such that the pressurizing member is retracted at a speed not to break a meniscus formed in an end portion of the nozzle.

16. The liquid droplet ejecting apparatus according to claim 14, wherein the biasing device includes:

an elastic member held by the cylinder; and a connecting member which connects the elastic member with the pressurizing member.

17. The liquid droplet ejecting apparatus according to claim 14, wherein the pressurizing-member driving device includes a pushing device which advances the pressurizing member against a biasing force of the biasing device.

18. The liquid droplet ejecting apparatus according to claim 17, further comprising a head unit, and wherein the biasing device includes:

an operable member held by the head unit;

a transmitting device which connects the operable member with the pressurizing member in order to transmit a movement of the operable member to the pressurizing member; and an elastic member which biases the operable member and the pressurizing member in the retracting direction, and wherein the pushing device includes:

an operating member which operates the operable member; and an operating-member driving device which displaces the operating member to have the operating member operate the operable member.

19. The liquid droplet ejecting apparatus according to claim 18, wherein the operating-member driving device is capable of varying a speed at which the operating member is displaced.

20. The liquid droplet ejecting apparatus according to claim 17, further comprising:

a head unit including the nozzle, the first pressure-feed portion and the second pressure-feed portion; and a unit moving device which moves the head unit within a predetermined moving range, and wherein the pushing device is disposed at a pushing position located inside the moving range.

21. The liquid droplet ejecting apparatus according to claim 20, wherein the biasing device includes:

an operable member held by the head unit;

a transmitting device which connects the operable member with the pressurizing member in order to transmit a movement of the operable member to the pressurizing member; and an elastic member which biases the operable member and the pressurizing member in the retracting direction, and wherein the pushing device operates the operable member as a result of the movement of the head unit by the unit moving device, the pushing device being disposed at a position to move, against a resilience of the elastic member, the operable member and the pressurizing member in a direction to advance the pressurizing member.

22. The liquid droplet ejecting apparatus according to claim 21, wherein the operable member is formed of an elastic material and serves as the elastic member also.

23. The liquid droplet ejecting apparatus according to claim 20, wherein the pushing device includes:

an operable member held by the head unit;

an operating member which operates the operable member; and an operating-member moving device which moves the operating member in a second direction which intersects a first direction in which the head unit is moved, between a retracted position where the operating member does not operate the operable member, and an operating position where the operating member operates the operable member.

24. The liquid droplet ejecting apparatus according to claim 23, wherein the operating-member moving device is capable of moving the operating member to any one of a plurality of positions as the operating position.

25. The liquid droplet ejecting apparatus according to claim 23, further comprising an association controller which controls the unit moving device and the operating-member moving device in association with each other, thereby changing at least one of: an operation initiating position at which the operating member starts operating the operable member; an operation terminating position at which the operating member separates from the operable member; an operation range within which the operating member keep operating the operable member; and an operation speed at which the operating member operates the operable member.

26. The liquid droplet ejecting apparatus according to claim 23, wherein the second pressure-feed portion includes the operable member, and wherein the head unit includes a plurality of temporary storing chamber units each of which has the nozzle, the first pressure-feed portion, and the second pressure-feed portion, and which are arranged in a direction parallel to the direction in which the head unit is moved by the unit moving device, the apparatus further comprising a determining portion which determines whether each of the operable members of the respective second pressure-feed portions is to be operated by the pushing device when the temporary storing chamber unit passes by the pushing device.

27. The liquid droplet ejecting apparatus according to claim 20, wherein the unit moving device is capable of varying a velocity at which the head unit is moved, to a plurality of values.

28. The liquid droplet ejecting apparatus according to claim 20, wherein the biasing device includes:

an operable member held by the head unit;

a transmitting device which connects the operable member with the pressurizing member in order to transmit a movement of the operable member to the pressurizing member; and an elastic member which biases the operable member and the pressurizing member in the retracting direction, and wherein the pushing device includes an operating member in the form of a rotary member which rotates around a rotational axis perpendicular to a direction in which the head unit is moved by the unit moving device, and the rotary member operates the operable member.

29. The liquid droplet ejecting apparatus according to claim 20, wherein the biasing device includes:

an operable member held by the head unit;

a transmitting device which connects the operable member with the pressurizing member in order to transmit a movement of the operable member to the pressurizing member; and an elastic member which biases the operable member and the pressurizing member in the retracting direction, wherein the pushing device includes:

an operating member which operates the operable member as a result of the movement of the head unit by the unit moving device, and wherein the unit moving device stops the head unit at at least one position between a first position where the operating member is brought into contact with the operable member as a result of the movement of the head unit by the unit moving device and a second position where the operating member separates from the operable member as a result of the movement of the head unit.

30. The liquid droplet ejecting apparatus according to claim 1, wherein the pressurizing member constitutes at least a part of the pressure chamber, and deforms to change an inner volume of the pressure chamber upon application of a voltage to the pressurizing member, and wherein the communication passage includes the flow resistance generator between the pressure chamber and the tank.

31. The liquid droplet ejecting apparatus according to claim 1, wherein the liquid is an ink, and the liquid droplet ejecting apparatus performs recording on a recording medium by ejecting droplets of the ink from the nozzle.

32. A liquid droplet ejecting apparatus comprising:

a main tank which stores a liquid;

a head unit including:

a temporary storing chamber which temporarily stores the liquid as supplied from the main tank;

a nozzle; and a first pressure-feed portion which pressure-feeds the liquid as supplied from the temporary storing chamber to the nozzle so that the liquid is ejected from the nozzle in the form of a droplet;

an unit moving device which moves the head unit within a predetermined moving range;

a second pressure-feed portion including:

the temporary storing chamber; and an operable member which protrudes from an external wall surface of the temporary storing chamber, and is moved toward an internal space of the temporary storing chamber, so that the liquid is pressure-fed to the nozzle via the first pressure-feed portion from the temporary storing chamber; and an operating member which operates the operable member as a result of the movement of the head unit by the unit moving device, such that the operable member is moved toward the internal space of the temporary storing chamber.

33. The liquid droplet ejecting apparatus according to claim 32, wherein the operable member is constituted by an elastic pressurizing member which protrudes from an external wall surface of the temporary storing chamber, and is elastically deformed toward the internal space of the temporary storing chamber in order to reduce an inner volume of the temporary storing chamber, thereby ejecting the liquid from the nozzle.

34. The liquid droplet ejecting apparatus according to claim 33, wherein the temporary storing chamber includes a shut-off device which shuts off flow of the liquid from the main tank while the head unit is moved by the unit moving device, and the elastic pressurizing member has an atmospheric communication hole which communicates an internal space of the temporary storing chamber with the atmosphere, and is closed by the operating member.

35. The liquid droplet ejecting apparatus according to claim 32, further comprising:

a cylinder fixed to the temporary storing chamber;

a pressurizing member which is slidably fitted in the cylinder at a fitting portion such that, the pressurizing member forms on a front side thereof the pressure chamber and is capable of advancing and retracting;

a connecting device which connects the pressurizing member and the operable member, such that the pressurizing member is advanced and retracted as a result of the movement of the operable member;

the liquid in the pressure chamber being pressure-fed to the nozzle by the advancing of the pressurizing member.

36. The liquid droplet ejecting apparatus according to claim 32, further comprising a reverse flow inhibitor which is disposed between the temporary storing chamber and the main tank, and allows flow of the liquid in a direction from the main tank toward the temporary storing chamber, but inhibits flow of the liquid in the opposite direction from the temporary storing chamber toward the main tank.

37. The liquid droplet ejecting apparatus according to claim 32, further comprising an operating-member moving device which moves the operating member in a second direction which intersects a first direction in which the head unit is moved, between a retracted position where the operating member does not operate the elastic pressurizing member and an operating position where the operating member operates the elastic pressurizing member.

38. The liquid droplet ejecting apparatus according to claim 32, wherein the liquid is an ink, and the liquid droplet ejecting apparatus performs recording on a recording medium by ejecting droplets of the ink from the nozzle.

39. A liquid droplet ejecting apparatus comprising:

a head unit including:

a temporary storing chamber which temporarily stores the liquid as supplied from the exterior;

a nozzle; and a first pressure-feed portion which pressure-feeds the liquid as supplied from the temporary storing chamber to the nozzle so that the liquid is ejected from the nozzle in the form of a droplet;

a second pressure-feed portion including an actuator which constitutes at least a part of a wall of the temporary storing chamber and is deformed upon application of a voltage to the actuator to change an inner volume of the temporary storing chamber, the second pressure-feed portion pressure-feeding the liquid to the nozzle via the first pressure-feed portion to eject the liquid from the nozzle; and a reverse flow restrictor which is disposed on an upstream side of the temporary storing chamber with respect to flow of the liquid, and allows flow of the liquid from the exterior into the temporary storing chamber, but restricts flow of the liquid in the opposite direction from the temporary storing chamber toward the exterior.

40. The liquid droplet ejecting apparatus according to claim 39, wherein the temporary storing chamber stores the liquid along with bubbles contained in the liquid.

41. The liquid droplet ejecting apparatus according to claim 40, further comprising a flow resistance generator which is disposed between the temporary storing chamber and the first pressure-feed portion, and gives a flow resistance to flow of the liquid between the temporary storing chamber and the first pressure-feed portion.

42. The liquid droplet ejecting apparatus according to claim 41, further comprising a carriage which holds the temporary storing chamber, the first pressure-feed portion, the nozzle, and the second pressure-feed portion, and moves within a predetermined moving range.

43. The liquid droplet ejecting apparatus according to claim 39, comprising a plurality of sets each including the temporary storing chamber, the first pressure-feed portion, and the nozzle.

44. The liquid droplet ejecting apparatus according to claim 39, wherein the head unit includes:

a cavity plate in which a plurality of recesses to become a plurality of pressure chambers are formed;

a piezoelectric sheet which is disposed on the cavity plate, and has a plurality of active portions that deform upon application of a voltage thereto;

a manifold plate, which is disposed on a side of the cavity plate opposite to the piezoelectric sheet, and forms a manifold in communication with the pressure chambers;

a plurality of the first pressure-feed portions being provided by a plurality of combinations each consisting of one of the recesses and one of the active portions; and the manifold constituting the temporary storing chamber.

45. The liquid droplet ejecting apparatus according to claim 39, further comprising a voltage changer which changes the voltage applied to the actuator to one of a plurality of values.

46. The liquid droplet ejecting apparatus according to claim 45, further comprising a timer which counts an elapsed time from a moment when the application of the voltage to the actuator is initiated, and wherein the voltage changer includes a voltage increasing portion which increases the voltage applied to the actuator with increase in the time counted by the timer.

47. The liquid droplet ejecting apparatus according to claim 39, wherein the actuator is constituted by a conducting polymer actuator.

48. The liquid droplet ejecting apparatus according to claim 39, wherein the liquid is an ink, and the liquid droplet ejecting apparatus performs recording on a recording medium by ejecting the ink in the form of droplets from the nozzle.

* * * * *